US007060423B2

(12) United States Patent
Yamane et al.

(10) Patent No.: US 7,060,423 B2
(45) Date of Patent: Jun. 13, 2006

(54) HEAT-DEVELOPABLE PHOTOSENSITIVE MATERIAL AND IMAGE FORMING METHOD

(75) Inventors: Katsutoshi Yamane, Kanagawa (JP); Yasuhiko Goto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/191,485

(22) Filed: Jul. 10, 2002

(65) Prior Publication Data

US 2003/0118953 A1 Jun. 26, 2003

(30) Foreign Application Priority Data

| | | |
|---|---|---|
| Jul. 12, 2001 | (JP) | P.2001-212445 |
| Jul. 27, 2001 | (JP) | P.2001-227838 |
| Nov. 14, 2001 | (JP) | P.2001-349031 |
| Dec. 11, 2001 | (JP) | P.2001-346122 |

(51) Int. Cl.
*G03C 5/16* (2006.01)
*G03C 1/498* (2006.01)

(52) U.S. Cl. ..... 430/350; 430/619; 430/945

(58) Field of Classification Search ..... 430/619, 430/350, 617, 568, 567, 620, 363, 945
See application file for complete search history.

(56) References Cited

U.S. PATENT DOCUMENTS

| | | | | |
|---|---|---|---|---|
| 4,173,483 | A * | 11/1979 | Habu et al. | 430/575 |
| 4,223,082 | A | 9/1980 | Rosenfeld | |
| 5,958,668 | A * | 9/1999 | Matsumoto et al. | 430/619 |
| 6,143,488 | A * | 11/2000 | Uytterhoeven et al. | 430/619 |
| 6,165,705 | A | 12/2000 | Dankosh et al. | |

FOREIGN PATENT DOCUMENTS

| | | | |
|---|---|---|---|
| EP | 0 071 488 | A1 | 2/1983 |
| EP | 0 497 362 | A1 | 8/1992 |
| EP | 0 851 284 | A1 | 7/1998 |
| EP | 1096310 | A2 * | 5/2001 |
| JP | 8-297345 | | 11/1996 |
| JP | 2785129 | | 5/1998 |
| JP | 2000-305213 | A | 11/2000 |
| JP | 2001-100358 | A | 4/2001 |
| WO | WO 97/48014 | | 12/1997 |
| WO | WO 97/48015 | | 12/1997 |

* cited by examiner

*Primary Examiner*—Thorl Chea
(74) *Attorney, Agent, or Firm*—Sughrue Mion, PLLC

(57) ABSTRACT

The heat-developable photosensitive material of the present invention comprises a support, a photosensitive silver halide, a non-photosensitive organic silver salt, a heat developer and a binder, wherein the photosensitive silver halide is a specific photosensitive silver halide.

6 Claims, 1 Drawing Sheet

HEAT-DEVELOPABLE PHOTOSENSITIVE MATERIAL AND IMAGE FORMING METHOD

FIELD OF THE INVENTION

The present invention relates to a heat-developable photosensitive material and an image forming method using it.

BACKGROUND OF THE INVENTION

In recent years, reduction of amount of waste processing solutions is strongly desired in the medical fields from the standpoints of environmental protection and space savings. Techniques relating to photosensitive heat-developable photographic materials for use in medical diagnosis and photomechanical processes are required which enables efficient exposure by a laser image setter or laser imager and formation of a clear black image having high resolution and sharpness. The heat-developable photosensitive photographic materials can provide users with a simple and non-polluting heat development processing system that eliminates the use of solution-type processing chemicals.

Although the same is required also in the field of general image-forming materials, the image for medical diagnosis in particular must be finely drawn and therefore, high image quality with excellent sharpness and graininess is needed. Moreover, in view of diagnostic convenience, an image of cold black tone is preferred. At present, various hard copy systems using a pigment or a dye are commercially available as a general image-forming system, such as ink jet printer and electrophotography, however, these are not a satisfactory output system for the medical-use image.

On the other hand, thermal image forming systems using an organic silver salt are described, for example, in U.S. Pat. Nos. 3,152,904 and 3,457,075, B. Shely, *Thermally Processed Silver Systems*, and Sturge, V. Walworth and A. Shepp (compilers), *Imaging Processes and Materials,* 8th ed., page 2, Neblette (1989).

In particular, heat-developable photosensitive materials generally have a photosensitive layer comprising a binder matrix having dispersed therein a catalytic amount of a photocatalyst (for example, silver halide), a reducing agent, a reducible silver salt (for example, organic silver salt) and if desired, a color toner for controlling the silver tone. The heat-developable photosensitive material after image exposure is heated at a high temperature (for example, 80° C. or more) to bring about an oxidation-reduction reaction between the reducible silver salt (acting as an oxidizing agent) and the reducing agent and thereby form a black silver image. The oxidation-reduction reaction is accelerated by the catalytic action of a silver halide latent image produced by the exposure. Therefore, the black silver image is formed in the exposed area. This is disclosed in many publications including U.S. Pat. No. 2,910,377 and Japanese Patent Publication No. 4924/1968. As a medical image forming system by using a heat-developable photosensitive material, "FM-DP L" (Fuji Medical Dry Imager) is put on the market.

For the production of a thermal image forming system using an organic silver salt, there are two methods, that is, solvent application; and application of a coating solution which contains, as a main binder, an aqueous dispersion of fine polymer particles and then drying. The latter method needs only a simple production equipment and is suited for mass production, because a step for collecting a solvent is unnecessary.

Such an image forming system using an organic silver salt is however accompanied with such a serious problem as a deterioration in image shelf life after development, particularly, deterioration in printout when it is exposed to light because of a lack of a fixing step. As a means for improving such a deterioration in printout, a method of making use of AgI formed by the conversion of an organic silver salt is disclosed in U.S. Pat. No. 6,143,488 or European Patent No. 0922995. The above-disclosed method of using iodine for conversion of an organic silver salt however cannot be adopted as a practical image forming system, because sensitivity attained by the method is insufficient.

In addition, photosensitive materials making use of AgI are described in WO97-48014, WO97-48015, U.S. Pat. No. 6,165,705, Japanese Patent Laid-Open No. 297345/1996, and Japanese Patent No. 2785129. They have not attained satisfactory levels of sensitivity and fogging and are insufficient for practical use as a photosensitive material to be exposed to laser light. There is therefore a demand for the development of a method fully utilizing silver halide having a high silver iodide content.

Although an image forming method and a photosensitive material using a blue to ultraviolet laser light are disclosed in Japanese Patent Laid-Open No. 1 305213/2000, they are low in a silver iodide content and insufficient in sensitivity.

SUMMARY OF THE INVENTION

An object of the present invention is therefore to provide a heat-developable photosensitive material that has high sensitivity and can provide a high image quality in spite of being a silver halide photosensitive material rich in silver iodide; and an image forming method using the material.

Another object of the present invention is to provide a heat-developable photosensitive material that has a high sensitivity, is excellent in development stability and at the same time, is excellent in photoimage shelf life after development.

An object of the present invention has been attained by the below-described heat-developable photosensitive materials.

(1) A heat-developable photosensitive material (a first embodiment) comprising:

a transparent support;

a photosensitive silver halide;

a non-photosensitive organic silver salt;

a heat developer; and a binder, wherein the photosensitive silver halide has a silver iodide content of 5 mol % to 100 mol %, and the heat-developable photosensitive material is a heat-developable photosensitive material to be exposed to a light having a peak intensity at a wavelength of 350 nm to 450 nm under an illuminance of 1 $mW/mm^2$ or greater.

(2) A heat-developable photosensitive material (a first embodiment) comprising:

a transparent support;

a photosensitive silver halide;

a non-photosensitive organic silver salt;

a heat developer; and a binder, wherein the photosensitive silver halide has a direct transition absorption derived from a silver-iodide-rich crystal structure, and the heat-developable photosensitive material is a heat-developable photosensitive material to be exposed to a light having a peak intensity at a wavelength of 350 nm to 450 nm under an illuminance of 1 $mW/mm^2$ or greater.

(3) The heat-developable photosensitive material according to the item (1) or (2), wherein the photosensitive silver halide has a grain size of 5 nm to 80 nm.

(4) The heat-developable photosensitive material according to the item (1) or (2), wherein the photosensitive silver halide is a photosensitive silver halide that has been formed in the absence of the organic silver salt.

(5) The heat-developable photosensitive material according to the item (1) or (2), wherein the photosensitive silver halide has a mean silver iodide content of 10 mol % to 100 mol %.

(6) The heat-developable photosensitive material according to the item (5), wherein the silver halide has a mean silver iodide content of 40 mol % to 100 mol %.

(7) The heat-developable photosensitive material according to the item (1) or (2), wherein the pAg on the layer surface of the heat-developable photosensitive material is 1 to 5.5.

(8) A method for forming an image, which comprises:

exposing a heat-developable photosensitive material to a light having a peak intensity at a wavelength of 350 nm to 450 nm under an illuminance of 1 mW/mm$^2$ or greater, in which the heat-developable photosensitive material comprises a transparent support, a photosensitive silver halide, non-photosensitive organic silver salt, a heat developer and a binder, the photosensitive silver halide having a silver iodide content of 5 mol % to 100 mol %; and then heat developing the exposed material.

(9) A method for forming an image, which comprises:

exposing a heat-developable photosensitive material to a light having a peak intensity at a wavelength of 350 nm to 450 nm under an illuminance of 1 mW/mm$^2$ or greater, in which the heat-developable photosensitive material comprises a transparent support, a photosensitive silver halide, non-photosensitive organic silver salt, a heat developer and a binder, the photosensitive silver halide having a direct transition absorption derived from a silver-iodide-rich crystal structure; and then heat developing the exposed material.

(10) The method for forming an image according to the item (8) or (9), wherein the photosensitive silver halide has a grain size of 5 nm to 80 nm.

(11) The method for forming an image according to the item (8) or (9), wherein the photosensitive silver halide is a photosensitive silver halide that has been formed in the absence of the organic silver salt.

(12) The method for forming an image according to the item (8) or (9), wherein the photosensitive silver halide has a mean silver iodide content of 10 mol % to 100 mol %.

(13) The method for forming an image according to the item (12), wherein the photosensitive silver halide has a mean silver iodide content of 40 mol % to 100 mol %.

(14) The method for forming an image according to the item (8) or (9), wherein the pAg on the layer surface of the heat-developable photosensitive material is 1 to 5.5.

(15) The method for forming an image according to the item (8) or (9), wherein an exposure light source is a semiconductor laser having a light-emitting peak intensity at 390 nm to 430 nm.

(16) A heat-developable photosensitive material (a second embodiment) comprising:

a support;

a photosensitive silver halide;

a non-photosensitive organic silver salt;

a heat developer;

a binder; and an organic polyhalogen compound, wherein the photosensitive silver halide has a silver iodide content of 40 mol % to 100 mol % and has a mean grain size of 5 nm to 90 nm.

(17) The heat-developable photosensitive material according to the item (16), wherein the photosensitive silver halide has a silver iodide content of 70 mol % to 100 mol %.

(18) The heat-developable photosensitive material according to the item (16), wherein the photosensitive silver halide has a silver iodide content of 90 mol % to 100 mol %.

(19) The heat-developable photosensitive material according to the item (16), wherein the photosensitive silver halide has a mean grain size of 5 nm to 70 nm.

(20) The heat-developable photosensitive material according to the item (16), wherein the photosensitive silver halide is a photosensitive silver halide that has been formed in the absence of the non-photosensitive organic acid silver salt.

(21) The heat-developable photosensitive material according to the item (16), wherein the coating amount of the photosensitive silver halide is 0.5 mol % to 15 mol % per mole of the non-photosensitive organic silver salt.

(22) The heat-developable photosensitive material according to the item (21), wherein the coating amount of the photosensitive silver halide is 0.5 mol % to 12 mol % per mole of the non-photosensitive organic silver salt.

(23) The heat-developable photosensitive material according to the item (21), wherein the coating amount of the photosensitive silver halide is 0.5 mol % to 7 mol % per mole of the non-photosensitive organic silver salt.

(24) The heat-developable photosensitive material according to the item (21), which is a heat-developable photosensitive material to be heat developed at 110° C. to 130° C.

(25) The heat-developable photosensitive material according to the item (16), which is a heat-developable photosensitive material that has been spectrally sensitized so as to have a spectral sensitivity peak at a wavelength of 600 nm to 900 nm.

(26) A method for forming an image, which comprises carrying out exposure and recording of the heat-developable photosensitive material according to any one of the items (16) to (25) by using a semiconductor laser.

(27) The method for forming an image according to the item (26), wherein the exposure and recording is carried out under illuminance of 0.1 W/mm$^2$ or greater.

DETAILED DESCRIPTION OF THE INVENTION

Figure 1:
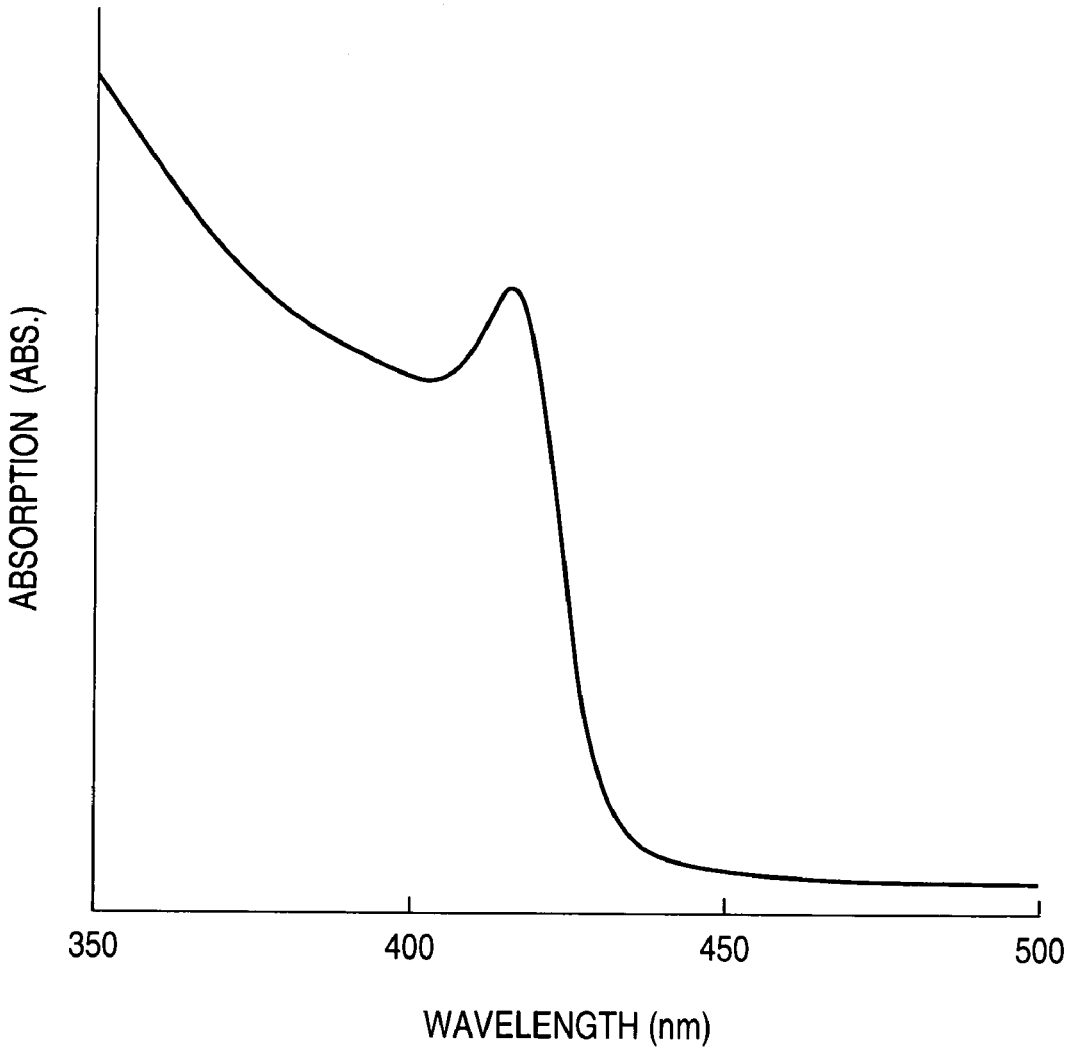
FIG. 1 is a diagram illustrating optical absorption of a silver iodide emulsion preferably used in the present invention.

The present invention will next be described specifically.

It is important that the photosensitive silver halide to be used in the invention is a silver iodide rich emulsion containing, as a halogen component, silver iodide in an amount of 5 mol % or greater but not greater than 100 mol %. A silver halide rich in silver iodide usually has only a low sensitivity so that its commercial value is regarded to be low.

A portion of a silver halide in the invention preferably has a phase absorbing light by direct transition. It is well known that at an exposure wavelength of the invention from 350 nm to 450 nm, absorption due to this direct transition can be realized when a silver halide has a silver-iodide-rich structure with a hexagonal wurtzite structure or cubic zinc-blend structure. However, a silver halide having such an absorption structure had usually a low sensitivity and photographically, had a low utility value.

The study by the present inventor has revealed that high sensitivity and high sharpness can be attained by exposing such a silver-iodide-rich photosensitive material, which is a heat-developable photosensitive material having a non-photosensitive organic acid silver salt and a heat developer, to light under a high illuminance of 1 $mW/mm^2$ or greater for a short period (not greater than 1 second, preferably not greater than $10^{-2}$ second, more preferably not greater than $10^{-4}$ second). Exposure under high illuminance for $10^{-5}$ second or less is particularly preferred. Such a short-period exposure is preferably effected in plural times as needed.

According to the above-described study, the size of the silver halide is preferably 80 nm or less. The invention apparently exhibits its effects particularly when the silver halide has such a small grain size.

The present invention will hereinafter be described more specifically.

The silver halide for use in the invention has preferably a silver iodide content of from 5 mol % to 100 mol %. A mean silver iodide content is preferably from 10 mol % to 100 mol %, more preferably from 40 mol % to 100 mol %, still more preferably from 70 mol % to 100 mol %, and especially, from 90 mol % to 100 mol %. The greater the silver iodide content, the more apparently the advantage of the invention is exhibited.

The silver halide of the invention preferably exhibits, between 350 nm to 450 nm, direct transition absorption derived from a silver iodide crystal structure. Whether the silver halide has light absorption due to direct transition or not can be easily distinguished by the existence of an exciton absorption resulting from direct transition at around 400 nm to 430 nm. Absorption of a silver halide can easily be found by measuring through a spectrophotometer a silver halide emulsion applied onto a film.

FIG. 1 illustrates optical absorption of a silver iodide emulsion which is preferably employed in the invention. As is apparent from the diagram, there exists absorption due to an exciton of a silver-iodide-rich phase at around 420 nm.

Such a direct-transition optical-absorption type silver-iodide-rich phase may exist singly or it may preferably exist, joined with a silver halide, such as silver bromide emulsion, silver chloride emulsion, silver iodobromide emulsion, silver iodochloride emulsion or mix crystals thereof, which exhibits indirect transition absorption in a wavelength region of 350 nm to 450 nm.

In such joined grains, the total silver iodide content is preferably from 5 mol % to 100 mol %. A mean silver iodide content is more preferably from 10 mol % to 100 mol %, more preferably from 40 mol % to 100 mol %, still more preferably from 70 mol % to 100 mol %, especially from 90 mol % to 100 mol %.

Such a silver halide phase which absorbs light by direct transition usually shows strong optical absorption. It has however lower sensitivity than an indirect-transition silver halide phase which exhibits only weak absorption so that it has not been utilized industrially.

In the invention, it has been found that a desirable sensitivity is available by adjusting an illuminance at 1 $mW/mm^2$ or greater when such a silver halide photosensitive material is exposed at 350 nm to 450 nm.

An exposure wavelength is more preferably from 370 nm to 430 nm, still more preferably from 390 nm to 430 nm, especially from 390 nm to 420 nm.

The silver halide of the invention exhibits its properties preferably at a grain size of from 5 nm to 80 nm. It has been found that silver halide grains having a phase exhibiting direct transition absorption is able to have a sufficient sensitivity by adjusting its grain size to 80 nm or less.

The photosensitive silver halide has preferably a grain size of from 5 nm to 60 nm, more preferably from 10 nm to 50 nm. The term "grain size" as used herein means a diameter of silver halide grains when they are converted into spheres of the same volume.

The heat-developable photosensitive materials of the present invention exhibit favorable characteristics when exposed to light at a high silver ion concentration, that is, at a low pAg on the layer surface. The pAg on the layer surface is preferably from 1 to 5.5, more preferably from 2 to 5, especially from 3 to 4.5. It is important to carry out high-illuminance and short period exposure while maintaining the pAg on the layer surface low.

The pAg on the layer surface of the coated photosensitive material can be measured by the below-described manner. After dropping of 300 μl of distilled water to 1 $cm^2$ of the photosensitive material, thereby breaking the layer surface, the resulting material is allowed to stand for 30 minutes. The potential is then measured using a pAg electrode and the pAg is calculated from the potential thus obtained.

The method of forming a photosensitive silver halide is well known in the art and, for example, the methods described in *Research Disclosure*, No. 17029 (June, 1978) and U.S. Pat. No. 3,700,458 may be used. Specifically, a method of adding a silver-supplying compound and a halogen-supplying compound to gelatin or other polymer solution to prepare a photosensitive silver halide and mixing the silver halide with an organic silver salt is used. In addition, the methods described in Japanese Patent Laid-Open No. 119374/1999 (paragraph Nos. 0217 to 0224) and Japanese Patent Application Nos. 98708/1999 and Japanese Patent Application Laid-Open No. 347335/2000 are also preferably used.

Examples of the shape of silver halide grain include cubic form, octahedral form, tabular form, spherical form, bar form and potato-like form and among these, cubic grain is particularly preferred in the present invention. A silver halide grain having a rounded corner is also preferably used.

The face index (Miller indices) of the outer surface of the photosensitive silver halide grain is not particularly limited, however, {100} faces capable of giving a high spectral sensitization efficiency upon adsorption of a spectral sensitizing dye preferably occupy a high percentage. The percentage is preferably 50% or more, more preferably 65% or more, still more preferably 80% or more. The percentage of {100} faces according to the Miller indices can be determined by the method described in T. Tani, *J. Imaging Sci.*, 29, 165 (1985) using the adsorption dependency of {111} face and {100} face when a sensitizing dye is adsorbed.

In the present invention, a silver halide grain having, on the outermost surface thereof, a hexacyano metal complex allowed to exist is preferred. Examples of the hexacyano metal complex include $[Fe(CN_6)]^{4-}$, $[Fe(CN_6)]^{3-}$, $[Ru(CN_6)]^{4-}$, $[Os(CN_6)]^{4-}$, $[Co(CN_6)]^{3-}$, $[Rh(CN_6)]^{3-}$, $[Ir(CN_6)]^{3-}$, $[Cr(CN_6)]^{3-}$ and $[Re(CN_6)]^{3-}$. In the present invention, hexacyano Fe complexes are preferred.

The hexacyano metal complex is present in the form of ion in an aqueous solution and therefore, the counter cation is not important, however, use of cations easily miscible with water and suitable for the precipitation operation of a silver halide emulsion, for example, alkali metal ions such as sodium ion, potassium ion, rubidium ion, cesium ion and lithium ion, ammonium ions, and alkylammonium ions (e.g., tetramethylammonium ion, tetraethylammonium ion, tetrapropylammonium ion, tetra(n-butyl)ammonium ion) is preferred.

The hexacyano metal complex may be added after mixing it with water, a mixed solvent of water and an appropriate organic solvent miscible with water (for example, an alcohol, ether, glycol, ketone, ester or amide), or gelatin.

The amount of the hexacyano metal complex is preferably from $1\times10^{-5}$ to $1\times10^{-2}$ mol, more preferably from $1\times10^{-4}$ to $1\times10^{-3}$ mol, per mol of silver.

For allowing the hexacyano metal complex to exist on the outermost surface of a silver halide grain, the hexacyano metal complex is directly added after completion of the addition of an aqueous silver nitrate solution used for the grain formation but before initiation of the chemical sensitization step of performing chalcogen sensitization such as sulfur sensitization, selenium sensitization and tellurium sensitization or noble metal sensitization such as gold sensitization, for example, before the completion of charging step, during the water washing step, during the dispersion step, or before the chemical sensitization step. In order to stop growth of silver halide fine grains, the hexacyano metal complex is preferably added without delay after the grain formation but before the completion of charging step.

The addition of hexacyano metal complex may be started after silver nitrate which is added for the grain formation is added to consume 96% by mass of the total amount but is preferably started after 98% by mass, more preferably 99% by mass, of the total amount is added.

The hexacyano metal complex added after an aqueous silver nitrate solution is added immediately before the completion of grain formation can adsorb to the outermost surface of a silver halide grain and most of the complexes thus adsorbed form a sparingly-soluble salt with silver ion on the grain surface. This silver salt of hexacyano ferrate (II) is a salt more sparingly soluble than AgI and therefore, the fine grains can be prevented from re-dissolving, whereby silver halide fine grains having a grain size can be produced.

The photosensitive silver halide grain for use in the present invention contains a metal of Group VIII to Group X in the Periodic Table (showing Group I to Group XVIII) or a metal complex thereof.

The metal of Group VIII to Group X of the Periodic Table or center metal of the metal complex is preferably rhodium, ruthenium or iridium. One metal complex may be used or two or more complexes of the same metal or different metals may also be used in combination.

The metal complex content is preferably from $1\times10^{-9}$ to $1\times10^{-3}$ mol per mol of silver.

These metals and metal complexes and the addition methods therefor are described in Japanese Patent Laid-Open No. 225449/1995, Japanese Patent Laid-Open No. 65021/1999 (paragraph Nos. 0018 to 0024) and Japanese Patent Laid-Open No. 119374/1999 (paragraph Nos. 0227 to 0240).

Furthermore, metal atoms (for example, $[Fe(CN)_6]^{4-}$) which can be contained in the silver halide grain for use in the present invention, and the methods for desalting and chemical sensitization of a silver halide emulsion are described in Japanese Patent Laid-Open No. 84574/1999 (paragraph Nos. 0046 to 0050), Japanese Patent Laid-Open No. 65021/1999 (paragraph Nos. 0025 to 0031) and Japanese Patent Laid-Open No. 119374/1999 (paragraph Nos. 0242 to 0250).

As the gelatin contained in the photosensitive silver halide emulsion for use in the present invention, various gelatins can be used. In order to maintain good dispersion state of the photosensitive silver halide emulsion in the organic silver salt-containing coating solution, a low molecular weight gelatin having a molecular weight of 500 to 60,000 is preferably used. This low molecular weight gelatin may be used either upon grain formation or upon dispersion after desalting, but latter is preferred.

In the present invention, various compounds known as a supersensitizer may be used for elevating the spectral sensitization efficiency. Examples of the compounds for use in the present invention include the compounds described in European Patent No. 587338, U.S. Pat. Nos. 3,877,943 and 4,873,184, and Japanese Patent Laid-Open Nos. 341432/1993, 109547/1999 and 111543/1998.

It is preferred that in the present invention, the photosensitive silver halide grain has been chemically sensitized by sulfur sensitization, selenium sensitization or tellurium sensitization. As the compounds preferably used in the sulfur sensitization, selenium sensitization and tellurium sensitization, known compounds, for example, compounds described in Japanese Patent Laid-Open No. 128768/1995 can be used.

Particularly in the present invention, tellurium sensitization is preferred and the compounds described in Japanese Patent Laid-Open No. 65021/1999 (paragraph No. 0030) and the compounds represented by formulas (II), (III) and (IV) of Japanese Patent Laid-Open No. 313284/1993 are more preferred.

In the present invention, the chemical sensitization may be performed at any stage if it is after the grain formation but before the coating. Examples of the timing of performing the chemical sensitization include, after desalting, (1) before spectral sensitization, (2) simultaneously with spectral sensitization, (3) after spectral sensitization and (4) immediately before coating. Particularly, the chemical sensitization is preferably performed after the spectral sensitization.

The amount of a sulfur, selenium or tellurium sensitizer for use in the present invention varies depending on the silver halide grain, chemical ripening conditions and the like, but these sensitizers each is preferably used in an amount of $10^{-8}$ to $10^{-2}$ mol, preferably about $10^{-7}$ to $10^{-3}$ mol, per mol of silver halide. In the present invention, the conditions for the chemical sensitization are not particularly limited but the pH is from 5 to 8, the pAg is from 6 to 11 and the temperature is from about 40 to 95° C.

In the silver halide emulsion for use in the present invention, a thiosulfonic acid compound may be added by the method described in European Patent Laid-Open No. 293917.

In the photosensitive material for use in the present invention, only one kind of a photosensitive silver halide emulsion may be used or two or more kinds of emulsions (for example, emulsions different in the average grain size, in the halogen composition, in the crystal habit or in the chemical sensitization conditions) may be used in combination. By using a plurality of photosensitive silver halides different in sensitivity, gradation can be controlled.

Examples of the technique related to these include Japanese Patent Laid-Open Nos. 119341/1982, 106125/1978, 3929/1972, 55730/1973, 5187/1971, 73627/1975 and 150841/1982. Any two of plural photosensitive silver halide emulsions used in combination are preferably different in sensitivity by at least 0.2logE.

The amount of the photosensitive silver halide is preferably, in terms of the coated silver amount per $m^2$ of the photosensitive material, from 0.03 to 0.6 g/m , more preferably from 0.07 to 0.4 g/m$^2$, most preferably from 0.05 to 0.3 g/m$^2$. Also, the amount of the photosensitive silver halide is preferably from 0.01 to 0.3 mol, more preferably from 0.02 to 0.2 mol, still more preferably from 0.03 mol to 0.15 mol, per mol of the organic silver salt.

As the method and conditions for mixing the photosensitive silver halide and the organic silver salt which have been prepared individually, usable is a method of mixing the silver halide grains and the organic silver salt each after the completion of preparation, in a ball mill, a sand mill, a colloid mill, a vibration mill, a homogenizer or the like, or a method of preparing the organic silver salt by adding thereto, at arbitrary timing during the preparation of the organic silver salt, the photosensitive silver halide of which preparation has been completed.

Thus, the silver halide in the present invention is preferably formed in the absence of an organic acid silver salt. Upon mixing, it is preferred for controlling the photographic properties to mix two or more organic silver salt water dispersions with two or more photosensitive silver salt water dispersions.

In the present invention, the timing of adding the silver halide to a coating solution of an image forming layer is from 180 minutes before the coating to immediately before the coating, preferably from 60 minutes to 10 seconds before the coating. The mixing method and the mixing conditions are not particularly limited insofar as the effect of the present invention can be satisfactorily brought out.

Specifically, a method of mixing silver halide with the solution in a tank designed to give a desired average residence time which is calculated from the addition flow rate and the liquid transfer amount to the coater, or a method using a static mixer as described in N. Harnby, F. Edwards and A. W. Nienow (translated by Koji Takahashi), *Ekitai Kongo Gijutsu* (*Liquid Mixing Technique*), Chap. 8, Nikkan Kogyo Shinbun Sha (1989) may be used.

The gradation of the photosensitive material is arbitrary, but an average contrast for effective exhibition of the effect of the present invention is preferably from 1.5 to 10.0 at an optical density from 1.5 to 3.0.

The term "average contrast" as used herein means a gradient of a line connecting the points at optical densities of 1.5 and 3.0 in a characteristic curve drawn with the abscissa being a logarithm of the exposure amount of laser and the ordinate being an optical density, after heat development, of the photosensitive material exposed at that exposure amount.

The average contrast is preferably from 1.5 to 10, especially from 2.0 to 7, still more preferably from 2.5 to 6 for preventing character thinning.

(Explanation of Silver Halide)

In the present invention, it is important to use, as the photosensitive silver halide, a silver-iodide-rich emulsion having a silver iodide content of from 40 mol % to 100 mol % as its halogen composition. No particular limitation is imposed on the remaining 60 mol % and the remaining portion can be selected from silver chloride and silver bromide, with silver bromide being particularly preferred.

Use of such a silver-iodide-rich emulsion makes it possible to design a preferable heat-developable photosensitive material which is excellent in the shelf life of image after development, particularly, which shows an extremely small increase in fogging even when exposed to light. The silver iodide content preferably falls within a range of from 70 mol % to 100 mol %, more preferably from 80 mol % to 100 mole %. The silver iodide content of from 90 mol % to 100 mol % is particularly preferred from the viewpoint of shelf life of photoimage after development.

The halogen composition distribution within the grain may be uniform or the halogen composition may be stepwise or continuously changed. A silver halide grain having a core/shell structure may also be preferably used.

With respect to the structure, the core/shell grain preferably has from 2 to 5-ply structure, more preferably from 2 to 5-ply structure. A core-rich silver iodide structure or shell-rich silver iodide structure can also be employed preferably. Furthermore, a technique of localizing silver bromide on the grain surface may also be preferably used.

The silver-iodide-rich emulsion to be used in the present invention is required to have an average grain size of from 5 nm to 90 nm. If the grain size of the silver halide is large, the coated amount of the silver halide necessary for attaining a sufficient maximum density increases.

The present inventor has found that a large coated amount of the silver iodide emulsion, which is preferably employed in the present invention, markedly suppresses development, lowers sensitivity and causes a development-time-dependent deterioration in density stability, and when silver halide grains exceed a certain grain size, a predetermined development time does not produce maximum density.

They have also found that if the amount is limited, sufficient developability is available even if silver iodide is used. It is thus necessary to reduce the size of silver halide grains in order to attain the maximum optical density while limiting the amount of silver iodide.

More preferable average grain size of silver halide is from 5 nm to 70 nm, still more preferably from 5 nm to 55 nm, especially from 10 nm to 45 nm.

The term "average grain size" as used herein means an average of diameters of silver halide particles converted into spheres of the same volume.

The coated amount of such silver halide grains is, per mole of silver of an organic acid silver salt which will be described later, from 0.5 mol % to 15 mol %, preferably from 0.5 mol % to 12 mol %, still more preferably from 0.5 mol % to 9 mol %, especially from 0.5 mol % to 7 mol %, more especially from 1 mol % to 7 mol %. A silver halide amount set at as less as from 0.5 mol % to 5 mol % is particularly preferred.

In order to avoid marked development suppression due to the silver-iodide-rich emulsion found by the present inventor, addition of a silver halide in a small amount is very important. To attain an appropriate maximum optical density (Dmax) in spite of the addition of the silver halide in such a small amount, the silver halide must have a sufficiently small grain size.

The method of forming a photosensitive silver halide is well known in the art and, for example, the methods described in *Research Disclosure*, No. 17029 (June, 1978) and U.S. Pat. No. 3,700,458 may be used. Specifically, a method of adding a silver-supplying compound and a halogen-supplying compound to gelatin or another polymer solution to prepare a photosensitive silver halide and mixing the silver halide with an organic silver salt is used. In addition, the methods described in Japanese Patent Laid-Open No. 119374/1999 (paragraph Nos. 0217 to 0224) and Japanese Patent Application Nos. 98708/1999 and 42336/2000 are also preferably used.

Examples of the shape of a silver halide grain include cubic form, octahedral form, tabular form, spherical form, bar form and potato-like form. The silver-iodide-rich emulsion of the present invention has a complex shape. A joint grain as shown in P164-FIG. 1 of R. L. JENKINS et al. *J.*

*of Photo. Sci.,* 28,(1980) is preferably employed. A tabular grain as illustrated in FIG. 1 of the same publication is also preferably employed. A silver halide grain having rounded corners is also preferably used.

Although the face index (Miller indices) of the outer surface plane of a photosensitive silver halide grain is not particularly limited, {100} faces capable of giving a high spectral sensitization efficiency upon adsorption of a spectral sensitizing dye preferably occupy a high percentage. The percentage is preferably 50% or greater, more preferably 65% or greater, still more preferably 80% or greater.

The percentage of {100} faces according to the Miller indices can be determined by the method described in T. Tani, *J. Imaging Sci.,* 29, 165 (1985) utilizing the adsorption dependency of {111} face and {100} face when a sensitizing dye is adsorbed.

In the present invention, a silver halide grain having, on the outermost surface thereof, a hexacyano metal complex allowed to exist is preferred. Examples of the hexacyano metal complex include $[Fe(CN_6)]^{4-}$, $[Fe(CN_6)]^{3-}$, $[Ru(CN_6)]^{4-}$, $[Os(CN_6)]^{4-}$, $[Co(CN_6)]^{3-}$, $[Rh(CN_6)]^{3-}$, $[Ir(CN_6)]^{3-}$, $[Cr(CN_6)]^{3-}$ and $[Re(CN_6)]^{3-}$. In the present invention, hexacyano Fe complexes are preferred.

The hexacyano metal complex is present in the form of ion in an aqueous solution and therefore, the counter cation is not important but use of a cation easily miscible with water and suitable for the precipitation operation of a silver halide emulsion is preferred. Examples thereof include alkali metal ions such as sodium ion, potassium ion, rubidium ion, cesium ion and lithium ion, ammonium ions, and alkylammonium ions (e.g., tetramethylammonium ion, tetraethylammonium ion, tetrapropylammonium ion, tetra (n-butyl)ammonium ion).

The hexacyano metal complex may be added after mixing it with water, a mixed solvent of water and an appropriate organic solvent miscible with water (for example, an alcohol, ether, glycol, ketone, ester or amide), or gelatin.

The amount of the hexacyano metal complex is preferably from $1\times10^{-5}$ to $1\times10^{-2}$ mol, more preferably from $1\times10^{-4}$ to $1\times10^{-3}$ mol, per mol of silver.

For allowing the hexacyano metal complex to exist on the outermost surface of a silver halide grain, the hexacyano metal complex is directly added after the addition of an aqueous silver nitrate solution to be used for the grain formation is completed but before starting the chemical sensitization step of performing chalcogen sensitization such as sulfur sensitization, selenium sensitization and tellurium sensitization or noble metal sensitization such as gold sensitization, for example, before the completion of charging step, during the water washing step, during the dispersion step, or before the chemical sensitization step. In order to prevent growth of silver halide fine grains, the hexacyano metal complex is preferably added immediately after the grain formation but before the completion of charging step.

The addition of hexacyano metal complex may be started after silver nitrate to be added for the grain formation is added to consume 96% by mass of the total amount, preferably 98% by mass, especially 99% by mass.

The hexacyano metal complex added after an aqueous silver nitrate solution is added immediately before the completion of grain formation can adsorb to the outermost surface of a silver halide grain and most of the complexes adsorbed form a sparingly-soluble salt with silver ion on the grain surface.

This silver salt of hexacyano ferrate (II) is a salt more sparingly soluble than AgI and therefore, the fine grains can be prevented from re-dissolving, making it possible to produce silver halide fine grains having a small grain size.

The photosensitive silver halide grain for use in the present invention contains a metal of Group VIII to Group X in the Periodic Table (showing Group I to Group XVIII) or a metal complex thereof. The metal of Group VIII to Group X of the Periodic Table or center metal of the metal complex is preferably rhodium, ruthenium or iridium. These metal complexes may be used alone, or two or more complexes with the same or different metals may also be used in combination.

The metal or metal complex content is preferably from $1\times10^{-9}$ to $1\times10^{-3}$ mol per mol of silver. These heavy metals and metal complexes and the addition methods therefor are described in Japanese Patent Laid-Open No. 225449/1995, Japanese Patent Laid-Open No. 65021/1999 (paragraph Nos. 0018 to 0024) and Japanese Patent Laid-Open No. 119374/1999 (paragraph Nos. 0227 to 0240).

Furthermore, metal atoms (for example, $[Fe(CN)_6]^{4-}$) which can be contained in the silver halide grain for use in the present invention, and the methods for desalting and chemical sensitization of a silver halide emulsion are described in Japanese Patent Laid-Open No. 84574/1999 (paragraph Nos. 0046 to 0050), Japanese Patent Laid-Open No. 65021/1999 (paragraph Nos. 0025 to 0031) and Japanese Patent Laid-Open No. 119374/1999 (paragraph Nos. 0242 to 0250).

As the gelatin to be contained in the photosensitive silver halide emulsion for use in the present invention, various gelatins can be used. In order to maintain good dispersion state of the photosensitive silver halide emulsion in the organic-silver-salt-containing coating solution, a low molecular weight gelatin having a molecular weight of 500 to 60,000 is preferably used. This low molecular weight gelatin may be used either upon grain formation or upon dispersion after desalting, but latter is preferred.

As the sensitizing dye usable in the present invention, a sensitizing dye capable of spectrally sensitizing a silver halide grain in the desired wavelength region upon adsorption to the silver halide grain and having a spectral sensitivity suited for the spectral characteristics of an exposure light source can be advantageously selected.

It is particularly preferred that the photosensitive material of the present invention has been spectrally sensitized to have a spectral sensitivity peak at 600 nm or greater but not greater than 900 nm.

Examples of the sensitizing dye and the addition method therefor include those described in Japanese Patent Laid-Open No. 65021/1999 (paragraph Nos. 0103 to 0109), compounds represented by formula (II) of Japanese Patent Laid-Open No. 186572/1998, dyes represented by formula (I) of Japanese Patent Laid-Open No. 119374/1999 including compounds of paragraph No. 0106, dyes described in U.S. Pat. Nos. 5,510,236 and 3,871,887 (Example 5), dyes disclosed in Japanese Patent Laid-Open No. 96131/1990 and Japanese Patent Laid-Open No. 48753/1984, and those described in European Patent No. 0803764A1 (page 19, line 38 to page 20, line 35) and Japanese Patent Application Nos. 86865/2000, 102560/2000 and 205399/2000. These sensitizing dyes may be used singly or in combination of two or more thereof.

In the present invention, the sensitizing dye may be added at any time after desalting but before the coating of the emulsion, more preferably, after desalting until initiation of chemical ripening In the present invention, the sensitizing dye may be added in a desired amount according to the performance such as sensitivity or fogging, but the amount is preferably from $10^{-6}$ to 1 mol, more preferably from $10^{-4}$ to $10^{-1}$ mol, per mol of silver halide in the photosensitive layer.

In the present invention, a supersensitizer may be used for improving the spectral sensitization efficiency. Examples of the supersensitizer for use in the present invention include the compounds described in European Patent No. 587338, U.S. Pat. Nos. 3,877,943 and 4,873,184, Japanese Patent Laid-Open Nos. 341432/1993, 109547/1999 and 111543/1998.

It is preferred that the photosensitive silver halide grain of the present invention has been chemically sensitized by sulfur sensitization, selenium sensitization or tellurium sensitization. As the compound preferably used for sulfur sensitization, selenium sensitization or tellurium sensitization, known compounds, for example, compounds described in Japanese Patent Laid-Open No. 128768/1995 can be used. In the present invention, tellurium sensitization is particularly preferred and the compounds described in Japanese Patent Laid-Open No. 65021/1999 (paragraph No. 0030) and the compounds represented by formulas (II), (III) and (IV) of Japanese Patent Laid-Open No. 313284/1993 are more preferred.

In the present invention, the chemical sensitization may be performed at any stage after the grain formation but before the coating. Examples of the timing of performing the chemical sensitization include, after desalting, (1) before spectral sensitization, (2) simultaneously with spectral sensitization, (3) after spectral sensitization and (4) immediately before coating. The chemical sensitization after spectral sensitization is particularly preferred.

The amount of a sulfur, selenium or tellurium sensitizer for use in the present invention varies depending on the silver halide grain used, chemical ripening conditions and the like, but the sensitizer is preferably used in an amount of $10^{-8}$ to $10^{-2}$ mol, preferably about $10^{-7}$ to $10^{-3}$ mol, per mol of silver halide. In the present invention, no particular limitation is imposed on the conditions for chemical sensitization, but the pH is from 5 to 8, the pAg is from 6 to 11 and the temperature is about 40 to 95° C.

In the silver halide emulsion for use in the present invention, a thiosulfonic acid compound may be added by the method described in European Patent Laid-Open No. 293,917.

In the photosensitive material for use in the present invention, photosensitive silver halide emulsions may be used either singly or two or more kinds of emulsions (for example, emulsions different in the average grain size, in the halogen composition, in the crystal habit or in the chemical sensitization conditions) in combination. By using a plurality of photosensitive silver halide emulsions different in sensitivity, gradation can be controlled.

Examples of the technique related to them include those described in Japanese Patent Laid-Open Nos. 119341/1982, 106125/1978, 3929/1972, 55730/1973, 5187/1971, 73627/1975 and 150841/1982. Any two of plural photosensitive silver halide emulsions used in combination are preferably different in sensitivity by at least 0.2logE.

It is particularly preferred that the silver-iodide-rich emulsion of the present invention is formed in the presence of a non-photosensitive organic acid silver salt. A sufficient sensitivity cannot always be attained by the method of forming a silver halide by adding a halogenating agent to an organic acid silver salt.

Examples of the method of forming a silver halide in the absence of a non-photosensitive organic silver salt include a method of mixing a photosensitive silver halide with an organic silver salt, which have been prepared separately, by a high-speed agitator or in a ball mill, a sand mill, a colloid mill, a vibration mill, a homogenizer or the like, or a method of completing preparation of an organic silver salt after mixing a photosensitive silver halide, of which preparation has been completed, at any time during preparation of the organic silver salt. By either method, effects of the present invention are available preferably.

In the present invention, the silver halide is preferably added to a coating solution of an image forming layer at any time from 180 minutes before coating to immediately before coating, preferably from 60 minutes to 10 seconds before coating. No particular limitation is imposed on the mixing method and the mixing conditions insofar as the effect of the present invention can be fully brought out.

Specific examples include a method of mixing the silver halide with the solution in a tank designed to give a desired average residence time which is calculated from the addition flow rate and the liquid transfer amount to the coater, or a method using a static mixer as described in N. Harnby, M. F. Edwards and A. W. Nienow (translated by Koji Takahashi), *Ekitai Kongo Gijutsu* (*Liquid Mixing Technique*), Chap. 8, Nikkan Kogyo Shinbun Sha (1989) may be used.

The organic silver salt usable in the present invention is relatively stable to light but forms a silver image when heated at 80° C. or greater in the presence of an exposed photocatalyst (e.g., a latent image of photosensitive silver halide) and a reducing agent. The organic silver salt may be any organic substance containing a source capable of reducing silver ion.

Such a non-photosensitive organic silver salt is described in Japanese Patent Laid-Open No. 62899/1998 (paragraphs 0048 to 0049), European Patent Laid-Open No. 0803764A1 (lines 24, page 18 to line 37, page 19), European Patent Laid-Open No. 0962812A1, Japanese Patent Laid-Open No. 349591/1999, Japanese Patent Laid-Open No. 7683/2000, and Japanese Patent Laid-Open No. 72711/2000. The organic silver salt is preferably a silver salt of an organic acid, particularly a silver salt of a long chain aliphatic carboxylic acid (having from 10 to 30 carbon atoms, preferably from 15 to 28 carbon atoms). Preferred examples of the silver salt of a fatty acid include silver behenate, silver arachidate, silver stearate, silver oleate, silver laurate, silver caproate, silver myristate and silver palmitate, and mixtures thereof.

Of these organic acid salts, preferred in the present invention is use of salts of a fatty acid having a silver behenate content of 50 mol % or greater, more preferably 80 mol % or greater, still more preferably 90 mol % or greater.

The form of the organic silver salt usable in the present invention is not particularly limited and any one in the needle, bar, tabular and scaly form may be used.

In the present invention, organic silver salts in the scaly form are preferred. Those in the form of a short needle having a ratio of a long axis to a short axis not greater than 5, rectangular parallelopiped, cube or potato-like amphoteric grain are preferably employed. These organic silver salt grain features less fogging upon heat development than a long-needle grain having 5 or greater as a ratio of a long axis to a short axis.

In the present invention, a scaly organic silver salt is defined as follows. Supposing that the shape of an organic acid silver salt grain is caused to approximate to a rectangular parallelopiped and the sides thereof are designated as a, b, c (c may be equal to b) in the order of increasing length as a result of observation through an electron microscope, x is determined based on the calculation using shorter values of a and b.

$$x=b/a$$

In such a manner, x of about 200 grains is determined. When grains satisfy a relationship of an average value x (average)≧1.5, it is defined as a scaly grain. The relationship is preferably 30≧x (average)≧1.5, more preferably 20≧x (mean)≧2.0. For your reference, the needle grain falls within the following range: 1≧x (average)<1.5.

In the scaly grain, the value (a) can be regarded as the thickness of a tabular grain having a principal plane having (b) and (c) as its sides. The average of (a) is preferably from 0.01 μm to 0.23 μm, more preferably from 0.1 μm to 0.20 μm. The average of c/b is preferably from 1 to 6, more preferably from 1.05 to 4, still more preferably from 1.1 to 3, especially from 1.1 to 2.

The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, further preferably 50% or less. The form of the organic silver salt can be determined from a transmission electron microscope image of organic silver salt dispersion.

Another method for determining the monodispesibility is a method of determining the standard deviation of a volume weight average diameter of the organic silver salt. The percentage (coefficient of variation) of the value obtained by dividing the standard deviation by the volume weight average diameter is preferably 100% or less, more preferably 80% or less, still more preferably 50% or less.

For the measurement of monodispersibility, the grain size (volume weight average diameter) can be determined, for example, by exposing an organic silver salt dispersed in a solution to a laser ray and determining an autocorrelation function of the fluctuation of the scattered light on the basis of a time change.

Known processes can be applied to the preparation of the organic silver salt usable in the present invention and dispersion thereof. Examples of the processes used as reference include those described in the above-described Japanese Patent Laid-Open No. 62899/1998, European Patent Laid-Open No. 0803763A1, European Patent Laid-Open No. 0962812A1, Japanese Patent Laid-Open Nos. 349591/1999, 7683/2000, and 72711/2000, Japanese Patent Application Laid-Open Nos. 348228 to 30/1999, 203413/1999, 90093/2000, 195621/2000, 191226/2000, 213813/2000, 214155/2000 and 191226/2000.

If a photosensitive silver salt is present together upon dispersion of the organic silver salt, fog increases and sensitivity seriously decreases. Therefore, it is preferred to contain substantially no photosensitive silver salt upon dispersion.

In the present invention, the amount of the photosensitive silver salt to be dispersed in a water dispersion is preferably 1 mol % or less, more preferably 0.1 mol % per mol of the organic silver salt in the solution. It is still more preferred that the photosensitive silver salt is not added positively.

In the present invention, a photosensitive material can be produced by mixing the organic silver salt water dispersion and the photosensitive silver salt water dispersion. The mixing ratio of the organic silver salt to the photosensitive silver salt can be selected according to the purpose, however, a ratio of the photosensitive silver salt to the organic silver salt is preferably from 1 to 30 mol %, more preferably from 2 to 20 mol %, especially from 3 to 15 mol %.

A method of using two or more organic silver salt water dispersions and two or more photosensitive silver salt water dispersions upon mixing is preferably employed for controlling the photographic properties.

The organic silver salt for use in the present invention may be used in any desired amount, however, the amount in terms of silver is preferably from 0.1 to 5 g/m$^2$, more preferably from 0.3 to 3 g/m$^2$, still more preferably from 0.5 to 2.0 g/m$^2$.

The heat-developable photosensitive material of the present invention preferably contains a heat developer serving as a reducing agent for the organic silver salt. The reducing agent for the organic silver salt may be any substance (preferably an organic substance) capable of reducing silver ion into metal silver.

Such a reducing agent is described in Japanese Patent Laid-Open No. 65021/1999 (paragraph Nos. 0043 to 0045) and European Patent Laid-Open No. 0803764A1 (page 7, line 34 to page 18, line 12).

In the present invention, the reducing agent is preferably a hindered phenol reducing agent or a bisphenol reducing agent, having, a substituent at the ortho position of the phenolic hydroxyl group, more preferably a compound represented by the below-described formula (I).

Formula (R)

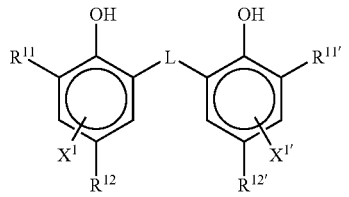

wherein $R^{11}$ and $R^{11'}$ each independently represents a $C_{1-20}$ alkyl group; $R^{12}$ and $R^{12'}$ each independently represents a hydrogen atom or a substituent capable of substituting to the benzene ring; L represents a group —S— or —CHR$^{13}$—; $R^{13}$ represents a hydrogen atom or a $C_{1-20}$ alkyl group; and $X^1$ and $X^{1'}$ each independently represents a hydrogen atom or a group capable of substituting to the benzene ring.

A description will next be made of the Formula (R) in detail.

$R^{11}$ and $R^{11'}$ each independently represents a substituted or unsubstituted $C_{12}$o alkyl group. The substituent for the alkyl group is not particularly limited but preferred examples include aryl groups, a hydroxy group, alkoxy groups, aryloxy groups, alkylthio groups, arylthio groups, an acylamino group, a sulfonamide group, a sulfonyl group, a phosphoryl group, an acyl group, a carbamoyl group, an ester group, a ureido group, a urethane group and halogen atoms.

$R^{12}$ and $R^{12'}$ each independently represents a hydrogen atom or a substituent capable of substituting to the benzene ring, and $X^1$ and $X^{1'}$ each independently represents a hydrogen atom or a group capable of substituting to the benzene ring. Preferred examples of these groups capable of substituting to the benzene ring include alkyl groups, aryl groups, halogen atoms, alkoxy groups and an acylamino group.

L represents a group —S— or —$CHR^{13}$—. $R^{13}$ represents a hydrogen atom or a $C_{1-20}$ alkyl group and the alkyl group may have a substituent.

Specific examples of the unsubstituted alkyl group represented by $R^{13}$ include a methyl group, an ethyl group, a propyl group, a butyl group, a heptyl group, a undecyl group, an isopropyl group, a 1-ethylbenzyl group and a 2,4,4-trimethylpentyl group. Examples of the substituent for the alkyl group are the same as the substituent for $R^{11}$.

$R^{11}$ and $R^{11'}$ each preferably represents a secondary or tertiary $C_{3-15}$ alkyl group and specific examples include an isopropyl group, an isobutyl group, a t-butyl group, a t-amyl group, a t-octyl group, a cyclohexyl group, a cyclopentyl group, 1-methylcyclohexyl group and a 1-methylcyclopropyl group.

$R^{11}$ and $R^{11'}$ each is preferably a tertiary $C_{4-12}$ alkyl group, more preferably a t-butyl group, a t-amyl group or a 1-methylcyclohexyl group, most preferably a t-butyl group.

$R^{12}$ and $R^{12'}$ each preferably represents a $C_{1-20}$ alkyl group and specific examples include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group. Of these, more preferred are a methyl group, an ethyl group, a propyl group, an isopropyl group and a tert-butyl group.

$X^1$ and $X^{1'}$ are each preferably a hydrogen atom, a halogen atom or an alkyl group, more preferably a hydrogen atom.

L is preferably a group —$CHR^{13}$—.

$R^{13}$ is preferably a hydrogen atom or a $C_{1-15}$ alkyl group and preferred examples of the latter include a methyl group, an ethyl group, a propyl group, an isopropyl group or a 2,4,4-trimethylpentyl group. As $R^{13}$, particularly preferred is a hydrogen atom, a methyl group, a propyl group or an isopropyl group.

When $R^{13}$ is a hydrogen atom, $R^{12}$ and $R^{12'}$ are each preferably a $C_{2-5}$ alkyl group, more preferably an ethyl group or a propyl group, most preferably an ethyl group.

When $R^{13}$ is a primary or secondary $C_{1-8}$ alkyl group, $R^{12}$ and $R^{12'}$ are each preferably a methyl group. As the primary or secondary $C_{1-8}$ alkyl group represented by $R^{13}$, more preferred is a methyl group, an ethyl group, a propyl group or an isopropyl group, with a methyl group, an ethyl group or a propyl group being still more preferred.

When $R^{11}$, $R^{11'}$, $R^{12}$ and $R^{12'}$ are all a methyl group, $R^{13}$ is preferably a secondary alkyl group. In this case, the secondary alkyl group represented by $R^{13}$ is preferably an isopropyl group, an isobutyl group or a 1-ethylpentyl group, more preferably an isopropyl group.

The above-described reducing agent differs in heat developability and developed silver color tone, depending on what are used in combination as $R^{11}$, $R^{11'}$, $R^{12}$, $R^{12'}$ and $R^{13}$. The above-described properties can be controlled by the use of at least two reducing agents in combination, so it is preferred to do so, though depending on the purpose.

Specific examples of the reducing agent for use in the present invention including the compounds represented by the formula (R) are set forth below, however, the present invention is not limited thereto.

(I-1)

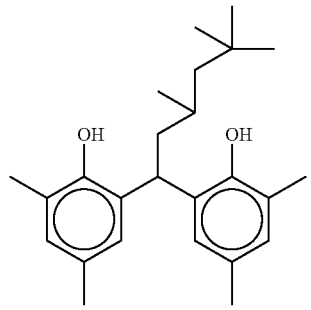

(I-2)

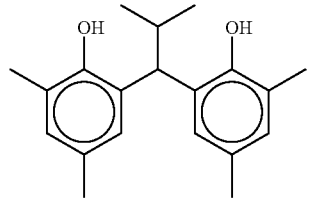

(I-3)

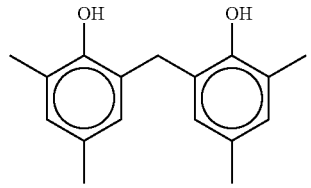

(I-4)

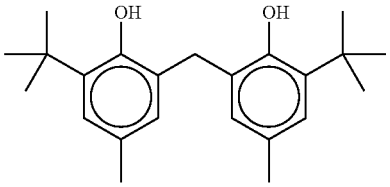

(I-5)

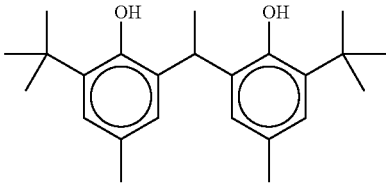

(I-6)

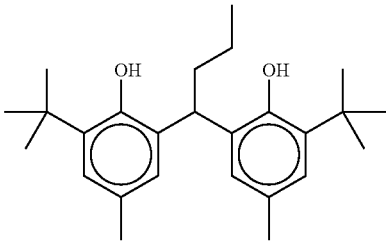

(I-7)

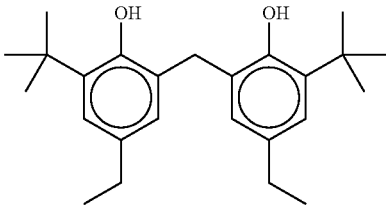

-continued
(I-8)
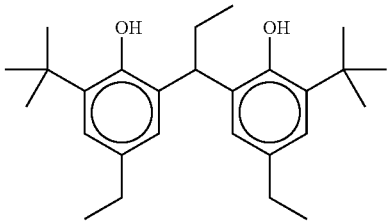
(I-9)
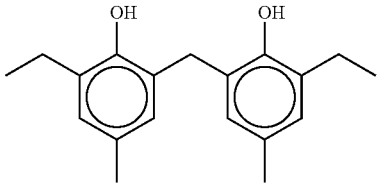
(I-10)
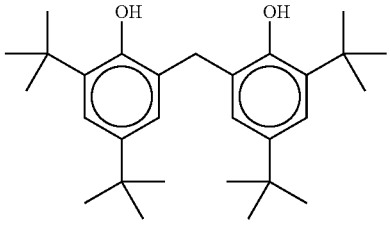
(I-11)
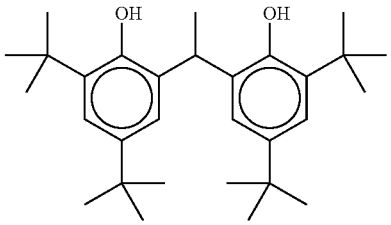
(I-12)
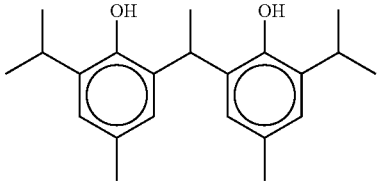
(I-13)
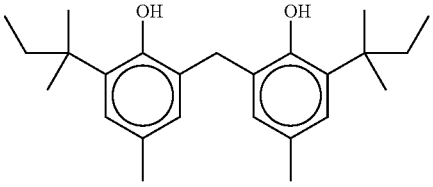
(I-14)
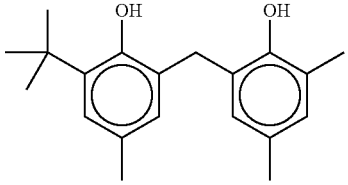
-continued
(I-15)
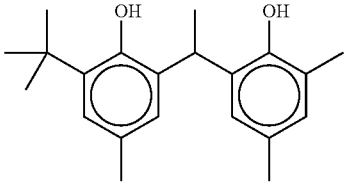
(I-16)
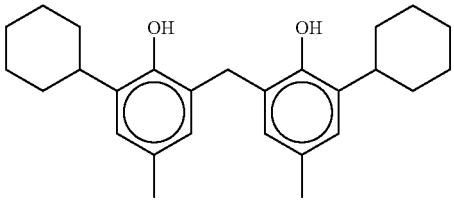
(I-17)
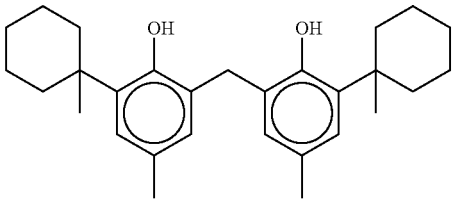
(I-18)
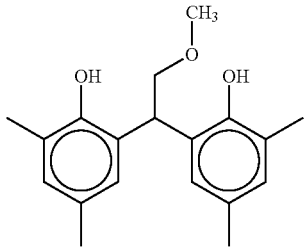
(I-19)
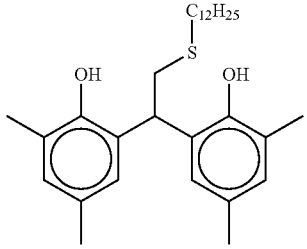
(I-20)
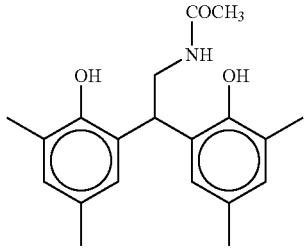
(I-21)
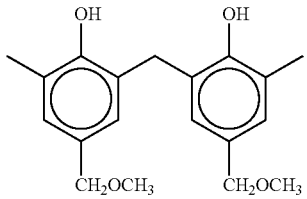

-continued
(I-22)
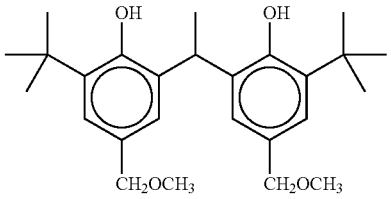
(I-23)
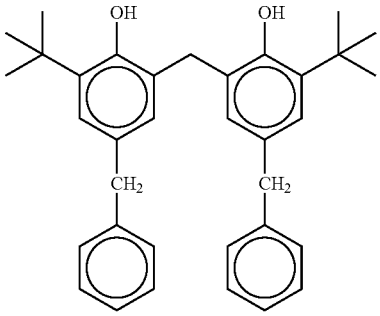
(I-24)
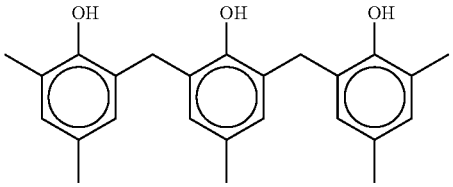
(I-25)
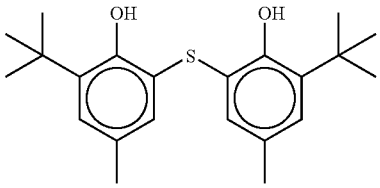
(I-26)
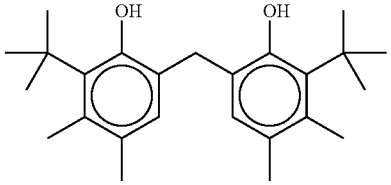
(I-27)
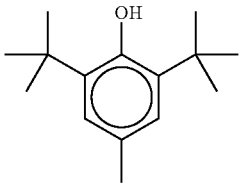
(I-28)
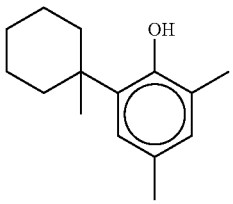
-continued
(I-29)
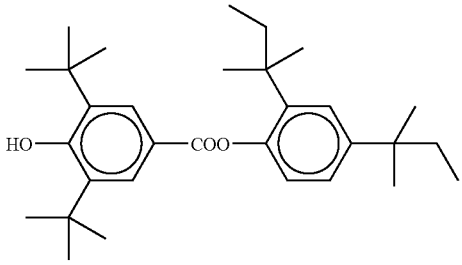
(I-30)
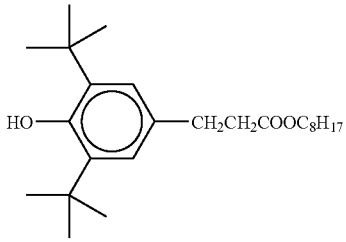
(I-31)
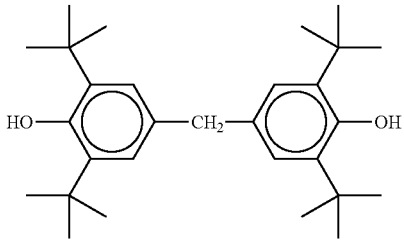
(I-32)
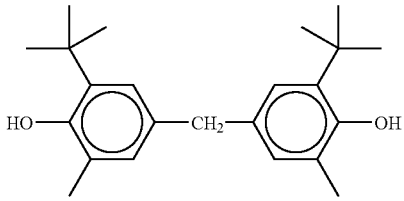
(I-33)
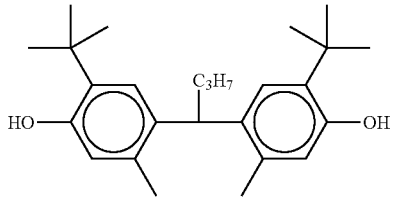
(I-34)
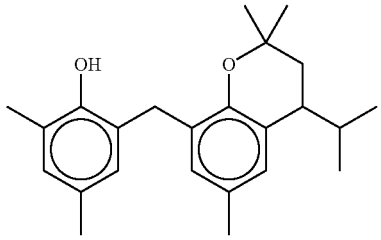
In the present invention, the reducing agent is preferably added in an amount of 0.1 to 3.0 g/$m^2$, more preferably 0.2 to 1.5 g/$m^2$, still more preferably 0.3 to 1.0 g/$m^2$.
The surface side having thereon an image forming layer preferably contains the reducing agent in an amount of 5 to 50 mol %, more preferably 8 to 30 mol %, still more preferably 10 to 20 mol % per mol of silver. The reducing agent is preferably contained in an image forming layer.

The reducing agent may be incorporated in the coating solution in any form, for example, in the form of a solution, an emulsified dispersion or a solid fine grain dispersion and the resulting coating solution is then incorporated in the photosensitive material.

Examples of the well-known emulsification dispersion method include a method of dissolving the reducing agent using an oil such as dibutyl phthalate, tricresyl phosphate, glyceryl triacetate or diethyl phthalate, or an auxiliary solvent such as ethyl acetate or cyclohexanone, and mechanically forming an emulsified dispersion.

Examples of the solid fine grain dispersion method include a method of dispersing the reducing agent in the powder form in an appropriate solvent such as water using a ball mill, a colloid mill, a vibrating ball mill, a sand mill, a jet mill, a roller mill or an ultrasonic wave, thereby preparing a solid dispersion. At this time, a protective colloid (e.g., polyvinyl alcohol) or a surfactant (for example, an anionic surfactant such as sodium triisopropylnaphthalenesulfonate (a mixture of three substances different each other in the substitution position of an isopropyl group)) may be used. In the above-described mills, it is the common practice to use beads such as zirconia as a dispersion medium. In the dispersion, Zr eluted from these beads may be mixed and it is usually mixed in an amount of from 1 ppm to 1000 ppm, though depending on the dispersing conditions. The content of Zr in the photosensitive material not greater than 0.5 mg per g of silver is permissible.

It is preferred to add an antiseptic (e.g., benzoisothiazolinone sodium salt) to the aqueous dispersion.

In the heat-developable photosensitive material of the present invention, preferably used as a development accelerator are sulfonamide phenol derivatives represented by formula (A) described in Japanese Patent Application No. 267222/2000, hindered phenol compounds represented by the formula (II) described in Japanese Patent Laid-Open No. 92075/2001, hydrazine compounds represented by the formula (I) described in Japanese Patent Laid-Open No. 62895/1998 or Japanese Patent Laid-Open No. 15116/1999, or represented by the formula (1) described in Japanese Patent Application No. 074278/2001, and phenol or naphthol compounds represented by the formula (2) described in Japanese Patent Application No. 76240/2000.

These development accelerators are used in an amount of from 0.1 to 20 mol %, preferably from 0.5 to 10 mol %, more preferably 1 to 5 mol % relative to the reducing agent. Similar methods to those employed for the reducing agent can be applied to the introduction of the development accelerator to the photosensitive material, but addition as a solid dispersion or emulsified dispersion is especially preferred.

When it is added as an emulsified dispersion, addition as an emulsified dispersion obtained using a high-boiling-point solvent which is a solid at room temperature and a low-boiling point auxiliary solvent or addition as a so-called oilless emulsified dispersion without using a high-boiling-point solvent is preferred.

A description will next be made of a hydrogen bond forming compound.

In the case where the reducing agent for use in the present invention has an aromatic hydroxyl group (—OH), particularly, in the case of a bisphenol as described above, a non-reducing compound having a group capable of forming a hydrogen bond with such a group is preferably used in combination.

Examples of the group capable of forming a hydrogen bond with a hydroxyl group or amino group include a phosphoryl group, a sulfoxide group, a sulfonyl group, a carbonyl group, an amide group, an ester group, a urethane group, a ureido group, a tertiary amino group and a nitrogen-containing aromatic group. of these, preferred are the compounds having a phosphoryl group, a sulfoxide group, an amide group (provided that it does not have a >N—H group but has been blocked like >N—Ra (wherein Ra is a substituent excluding H)), a urethane group (provided that it does not have a >N—H group but has been blocked like —N—Ra (wherein Ra is a substituent excluding H)) or a ureido group (provided that it does not have a >N—H group but has been blocked like —N—Ra (wherein Ra is a substituent excluding H)).

In the present invention, the hydrogen bond forming compound is particularly preferably a compound represented by the following formula (D):

Formula (D)

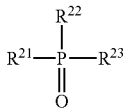

In formula (D), $R^{21}$ to $R^{23}$ each independently represents an alkyl group, an aryl group, an alkoxy group, an aryloxy group, an amino group or a heterocyclic group, and each may be unsubstituted or substituted.

When $R^{21}$ to $R^{23}$ each have a substituent, examples of the substituent include halogen atoms, alkyl groups, aryl groups, alkoxy groups, amino groups, an acyl group, an acylamino group, alkylthio groups, arylthio groups, a sulfonamide group, an acyloxy group, an oxycarbonyl group, a carbamoyl group, a sulfamoyl group, a sulfonyl group and a phosphoryl group. The substituent is preferably an alkyl group or an aryl group and examples thereof include a methyl group, an ethyl group, an isopropyl group, a t-butyl group, a t-octyl group, a phenyl group, a 4-alkoxyphenyl group and a 4-acyloxyphenyl group.

Specific examples of the alkyl group represented by each of $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group and a 2-phenoxypropyl group.

Examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Examples of the aryloxy group include a phenoxy group, a cresyloxy group, an isopropylphenoxy group, a 4-t-butylphenoxy group, a naphthoxy group and a biphenyloxy group. Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

$R^{21}$ to $R^{23}$ each preferably represents an alkyl group, an aryl group, an alkoxy group or an aryloxy group. In view of the effect of the present invention, at least one of $R^{21}$ to $R^{23}$ is preferably an alkyl group or an aryl group and more preferably, two or more thereof are an alkyl group or an aryl group. In view of the availability at a low cost, it is preferred that $R^{21}$ to $R^{23}$ all represent the same group.

Specific examples of the hydrogen bond forming compound including the compound represented by formula (D) for use in the present invention are set forth below, however, the present invention is not limited thereto.

(II-1)

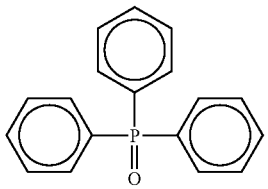

(II-2)

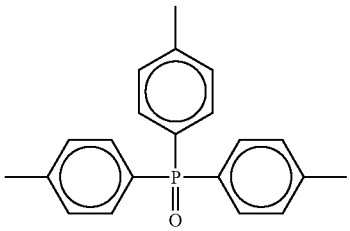

(II-3)

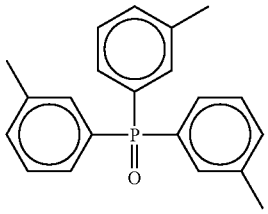

(II-4)

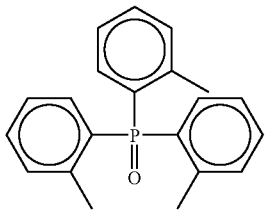

(II-5)

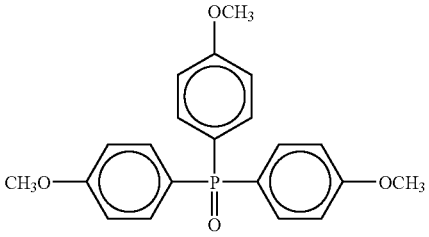

-continued (II-6)

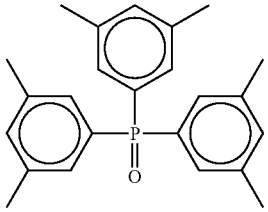

(II-7)

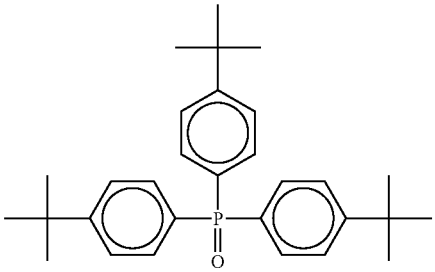

(II-8)

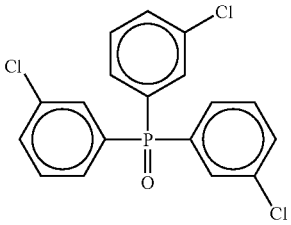

(II-9)

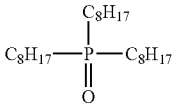

(II-10)

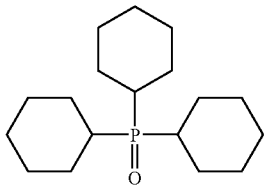

(II-11)

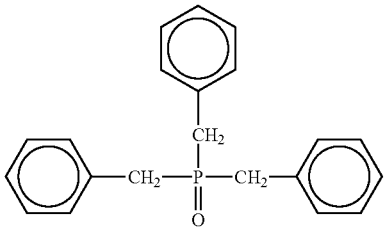

(II-12)

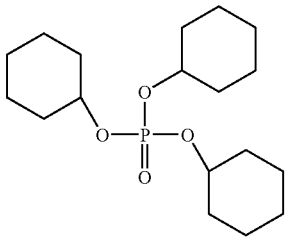

-continued (II-13)

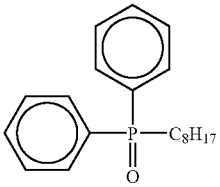

(II-14)

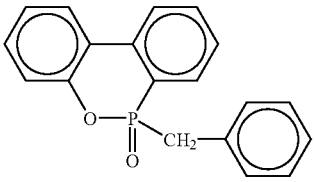

(II-15)

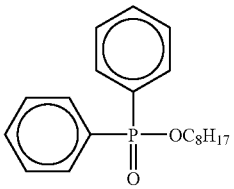

(II-16)

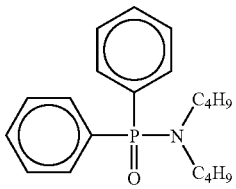

(II-17)

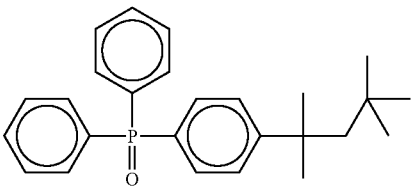

(II-18)

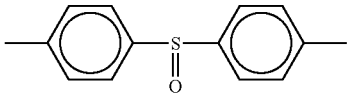

(II-19)

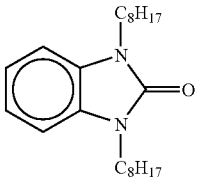

(II-20)

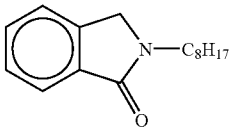

(II-21)

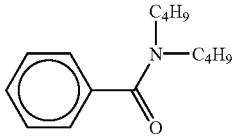

In addition to these compounds, specific examples of the hydrogen bond forming compound include those described in European Patent No. 1096310, Japanese Patent Application Nos. 270498/2000 and 124796/2001.

The compound represented by formula (D) for use in the present invention is, similar to the reducing agent, incorporated into a coating solution in the form of a solution, an emulsified dispersion or a solid fine grain dispersion and used in the photosensitive material. In the solution state, this compound forms a hydrogen bond forming complex with a compound having a phenolic hydroxyl group or an amino group and depending on the combination of the reducing agent and the compound represented by formula (D), the complex can be isolated in the crystal state. Use of the thus-isolated crystal powder as a solid fine grain dispersion is particularly preferred for attaining stable performance. Alternatively, a method of mixing the reducing agent with the compound represented by formula (D) each in the powder form and dispersing the resulting mixture in a sand grinder mill by using an appropriate dispersant, thereby forming a complex is also preferably used.

The compound of the formula (D) for use in the present invention is preferably used in an amount of from 1 to 200 mol %, more preferably from 10 to 150 mol %, still more preferably from 20 to 100 mol %, based on the reducing agent.

A description will next be made of the binder to be used in the present invention.

As the binder for the organic-silver-salt-containing layer in the present invention, any polymer may be used and the suitable binder is transparent or translucent and generally colorless. Examples thereof include natural resins, polymers and copolymers; synthetic resins, polymers and copolymers; and film-forming media such as gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal), poly(vinyl butyral)), poly(esters), poly(urethanes), phenoxy resin, poly(vinylidene chlorides), poly(epoxides), poly(carbonates), poly(vinyl acetates), poly(olefins), cellulose esters and poly(amides). The binder may also be coated and formed from water, an organic solvent or an emulsion.

In the present invention, the binder usable in combination with the organic-silver-salt-containing layer preferably has a glass transition temperature of from 10 to 80° C. (such binder may hereinafter be called a "high Tg binder"), more preferably from 15 to 70° C., still more preferably from 20 to 65° C.

In the present specification, the Tg is calculated by the following equation:

$$1/Tg=\Sigma(Xi/Tgi)$$

wherein assuming that the polymer is resultant of the copolymerization of n monomer components from i=1 to i=n, Xi is the weight fraction (ΣXi=1) of the i-th monomer and Tgi is the glass transition temperature (absolute temperature) of a homopolymer of the i-th monomer, provided that Σ is the sum of i=1 to i=n.

Incidentally, for the glass transition temperature (Tgi) of a homopolymer of each monomer, the values described in J. Brandrup and E. H. Immergut, *Polymer Handbook,* 3rd ed., Wiley-Interscience (1989) are employed.

As the binder, at least two polymers may be used in combination. A polymer having a glass transition temperature of 20° C. or more and another polymer having a glass transition temperature less than 20° C. may be used in combination. When two or more polymers different in Tg are blended, the weight average Tg thereof is preferably within the above-described range.

In the present invention, it is preferred to form the film of an organic-silver-salt-containing layer by coating and drying a coating solution containing water as 30% by mass or more of a solvent.

In the present invention, the performance is enhanced when the organic-silver-salt-containing layer is formed by coating and drying a coating solution with 30% by mass or more of the solvent being water, furthermore when the binder of the organic-silver-salt-containing layer is soluble or dispersible in an aqueous solvent (water solvent), particularly when the binder is composed of a polymer latex having an equilibrium moisture content at 25° C. and 60% RH of 2% by mass or less. In a most preferred form, the binder is prepared to have an ion conductivity of 2.5 mS/cm or less. For preparing such a binder, usable is a method of synthesizing a polymer and then purifying it using a membrane having a separating function.

The term "an aqueous solvent" in which the above-described polymer is soluble or dispersible means water or a mixture of water and 70% by mass or less of a water-miscible organic solvent.

Examples of the water-miscible organic solvent include alcohol solvents such as methyl alcohol, ethyl alcohol and propyl alcohol, cellosolve solvents such as methyl cellosolve, ethyl cellosolve and butyl cellosolve, ethyl acetate, and dimethylformamide.

The term "aqueous solvent" is used even for a system where the polymer is not thermodynamically dissolved but is present in the so-called dispersed state.

The term "equilibrium moisture content at 25° C. and 60% RH" can be expressed as follows using the weight W1 of a polymer in the humidity equilibration in an atmosphere of 25° C. and 60% RH and the weight W0 of a polymer in the bone dry state at 25° C.:

$$\text{Equilibrium moisture content at 25° C. and 60\% } RH=\{(W1-W0)/W0\}\times 100 \text{ (\% by mass)}$$

With respect to the definition and the measuring method of moisture content, for example, *Kobunshi Kogaku Koza* 14, *Kobunshi Zairyo Shiken Hou* (*Lecture* 14 *of Polymer Engineering, Polymer Material Testing Method*), compiled by Kobunshi Gakkai, Chijin Shokan, may be referred to.

In the present invention, the equilibrium moisture content at 25° C. and 60% RH of the binder polymer is preferably 2% by mass or less, more preferably from 0.01 to 1.5% by mass, still more preferably from 0.02 to 1% by mass.

In the present invention, a polymer dispersible in an aqueous solvent is particularly preferred. Examples of the dispersed state include a case where fine grains of a water-insoluble hydrophobic polymer are dispersed in the form of latex, and a case where polymer molecules are dispersed in the molecular state or by forming micelles. Either case is preferred. The former one is more preferred.

The average particle size of the dispersed particles is from 1 to 50,000 nm, preferably from 5 to 1000 nm, more preferably from 10 to 500 nm, still more preferably from 50 to 200 nm. The particle size distribution of the dispersed particles is not particularly limited and the dispersed particles may have either a wide particle size distribution or a monodisperse particle size distribution. Use of a mixture of at least two dispersed particles having a monodisperse particle size distribution is preferred for controlling the physical properties of the coating solution.

In the present invention, in a preferred embodiment of the polymer dispersible in an aqueous solvent, hydrophobic polymers such as acrylic polymers, poly(esters), rubbers (e.g., SBR resin), poly(urethanes), poly(vinyl chlorides), poly(vinyl acetates), poly(vinylidene chlorides) and poly (olefin)s, may be preferably used. These polymers may be linear, branched or crosslinked and also may be a homopolymer obtained by polymerizing a single monomer or a copolymer obtained by polymerizing two or more kinds of monomers. In the case of a copolymer, the copolymer may be a random copolymer or a block copolymer.

The molecular weight of this polymer is, in terms of the number average molecular weight, from 5,000 to 1,000,000, preferably from 10,000 to 200,000. If the molecular weight is too small, the resulting emulsion layer is insufficient in the mechanical strength, whereas if the molecular weight is excessively large, the film forming property is poor. The molecular weight outside the above-described range is therefore not preferred. Crosslinkable polymer latices are particularly preferred.

Specific examples of preferred polymer latices include, but not limited to, the below-described ones.

The polymer latex is expressed using the starting material monomers. The numerical value in the parentheses is the unit of % by mass and the molecular weight is a number average molecular weight. A polyfunctional monomer forms a crosslink structure so that the concept of molecular weight cannot be applied. In such a case, the term "crosslinkable" is therefore shown and the molecular weight is omitted. "Tg" means a glass transition temperature.

P-1: latex of -MMA(70)-EA(27)-MAA(3)- (molecular weight: 37,000, Tg 61° C.)

P-2: latex of -MMA(70)-2EHA(20)-St(5)-AA(5)- (molecular weight: 40,000, Tg 59° C.)

P-3: latex of -St(50)-Bu(47)-MAA(3)- (crosslinkable, Tg −17° C.)

P-4: latex of -St(68)-Bu(29)-AA(3)- (crosslinkable, Tg 17° C.)

P-5: latex of -St(71)-Bu(26)-AA(3)- (crosslinkable, Tg: 24° C.)

P-6: latex of -St(70)-Bu(27)-IA(3)- (crosslinkable)

P-7: latex of -St(75)-Bu(24)-AA(1)- (crosslinkable, Tg 29° C.)

P-8: latex of -St(60)-Bu(35)-DVB(3)-MAA(2)- (crosslinkable)

P-9: latex of -St(70)-Bu(25)-DVB(2)-AA(3)- (crosslinkable)

P-10: latex of -VC(50)-MMA(20)-EA(20)-AN(5)-AA(5)- (molecular weight: 80,000)

P-11: latex of -VDC(85)-MMA(5)-EA(5)-MAA(5)- (molecular weight: 67,000)

P-12: latex of -Et(90)-MAA(10)- (molecular weight: 12,000)

P-13: latex of -St(70)-2EHA(27)-AA(3) (molecular weight: 130,000, Tg 43° C.)

P-14: latex of -MMA(63)-EA(35)-AA(2) (molecular weight: 33,000, Tg 47° C.)

P-15: latex of -St(70.5)-Bu(26.5)-AA(3)- (crosslinkable, Tg: 23° C.)

P-16: latex of -St(69.5)-Bu(27.5)-AA(3)- (crosslinkable, Tg: 20.5° C.)

The abbreviations of the above-described structures indicate the following monomers: MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

These polymer latexes are commercially available and the following polymers may be used. Examples of the acrylic polymer include "Sebian A-4635, 4718 and 4601" (each, trade name; product of Daicel Chemical Industries, Ltd.) and "Nipol Lx811, 814, 821, 820 and 857" (each, trade name; product of Nippon Zeon K.K.); those of poly(esters) "FINETEX ES650, 611, 675 and 850" (each, trade name; product of Dai-Nippon Ink & Chemicals, Inc.), and "WD-size" and "WMS" (each, trade name; product of Eastman Chemical Products, Inc.); those of poly(urethanes) include "HYDRAN AP10, 20, 30 and 40" (each, trade name; product of Dai-Nippon Ink & Chemicals, Inc.); those of rubbers include "LACSTAR 7310K, 3307B, 4700H and 7132C" (each, trade name; product of Dai-Nippon Ink & Chemicals, Inc.), "Nipol Lx416, 410, 438C and 2507" (each, trade name; product of Nippon Zeon K.K.); those of poly(vinyl chlorides) include "G351 and G576" (each, trade name; product of Nippon Zeon K.K.); those of poly(vinylidene chlorides) include "L502 and L513" (each, trade name; product of Asahi Chemical Industry Co., Ltd.); and those of poly (olefins) include "Chemipearl S120 and SA100" (each, trade name; product of Mitsui Petrochemical Industries, Ltd.).

These polymer latices may be used singly or, if desired, two or more thereof may be blended.

The polymer latex for use in the present invention is particularly preferably a latex of styrene-butadiene copolymer. In the styrene-butadiene copolymer, a weight ratio of the styrene monomer unit to the butadiene monomer unit is preferably from 40:60 to 95:5. Furthermore, the styrene monomer unit and the butadiene monomer unit preferably account for 60 to 99% by mass of the copolymer. The polymer latex for use in the invention preferably contains acrylic acid or methacrylic acid in an amount of 1 to 6% by mass, more preferably 2 to 5% by mass, relative to the sum of styrene and butadiene. The polymer latex for use in the invention preferably contains acrylic acid.

Examples of the styrene-butadiene copolymer latex which is preferably used in the present invention include the above-described latices P-3 to P-8, P-14 and P-15 and commercially available products "LACSTAR-3307B", "7132c" and "Nipol Lx416".

Such a styrene-butadiene copolymer latex has preferably Tg of from 10° C. to 30° C., more preferably from 17° C. to 25° C.

<Synthesizing Method of Latex>

A high-Tg fine polymer dispersion preferably usable in the present invention is available by the ordinary polymerization reaction such as emulsion polymerization, dispersion polymerization or suspension polymerization. However, in most cases, coating of photographic photosensitive materials is performed by using water as a medium, and non-water-soluble substances such as the above-mentioned polymers are used in the form of aqueous dispersion. Therefore, in view of preparation of a coating solution, emulsion polymerization or dispersion polymerization is preferred, with synthesis by emulsion polymerization being particularly preferred.

When the above-described latex is employed, its fine grain has usually a grain size of 300 nm or less, preferably 200 nm, especially 150 nm or less.

Emulsion polymerization can be performed, for example, by using water or a mixed solvent composed of water and a water-miscible organic solvent (such as methanol, ethanol or acetone) as a dispersion medium, and polymerizing 5 to 40 wt. %, relative to the dispersion medium, of a monomer mixture under stirring at about 30 to 100° C., preferably at 60 to 90° C. for 3 to 8 hours in the presence of 0.05 to 5 wt. % of a polymerization initiator and 0.1 to 20 wt. % of an emulsifier, each relative to the monomer.

Polymerization conditions including dispersion medium, concentrations of monomers, amount of initiator, amount of emulsifier, reaction temperature, time, and addition methods of monomers are determined as desired in consideration of the nature of the monomers to be used, target grain size and so on.

Examples of the initiator preferably employed upon emulsion polymerization include inorganic peroxides such as potassium persulfate, sodium persulfate and ammonium persulfate; azonitrile compounds such as the sodium salt of azobiscyanovaleric acid; azoamidine compounds such as 2,2'-azobis(2-amidinopropane) dihydrochloride; cyclic azoamidine compounds such as 2,2'-azobis[2-(5-methyl-2-imidazolin-2-yl)propane] hydrochloride; and azoamide compounds such as 2,2'-azobis{2-methyl-N-[1,1'-bis(hydroxymethyl)-2-hydro-xyethyl]propionamide}. Of these compounds, potassium persulfate, sodium persulfate and ammonium persulfate are particularly preferred.

As the emulsifier, although any of anionic surfactants, nonionic surfactants, cationic surfactants and amphoteric surfactants can be used, anionic surfactants are preferred.

The high-Tg latex can be readily synthesized by usual procedure of emulsion polymerization. General procedures of emulsion polymerization are detailed in the following literature: "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); and Soichi Muroi, "Gosei Latex no Kagaku (Chemistry of Synthetic Latex)", Kobunshi Kanko Kai (1970).

The synthesis of the high-Tg latex will next be described by specific synthesis examples.

SYNTHESIS EXAMPLE 1

In an autoclave made of glass ("TEM-V1000", trade name; product of Taiatsu Glass Kogyo Co., Ltd.), 90 g of styrene, 3 g of acrylic acid, 160 g of distilled water and 2 g of surfactant ("Sandet BL", trade name; product of SANYO CHEMICAL INDUSTRIES, LTD.) were charged and stirred for 1 hour under a nitrogen gas stream. After hermetic sealing of the reaction vessel, 7 g of butadiene was added, followed by heating to 60° C. To the reaction mixture was added 10 g of an aqueous solution of potassium persulfate (5%). The resulting mixture was reacted by stirring for 10 hours. After completion of the reaction, the temperature was lowered to room temperature, and the reaction mixture was added with 60 g of distilled water. The mixture was stirred for 30 minutes to obtain 327 g of a latex in the form of a milky white liquid.

The dispersion thus obtained was a fine latex solution having an average grain size of 76 nm and containing 30.2% by mass of nonvolatile matter. The grain size was determined by a dynamic light scattering particle size analyzer "N4" (trade name; product of Beckman Coulter).

SYNTHESIS EXAMPLE 2

In a 500-ml three-neck flask equipped with a condenser and a stirrer, a solution obtained by dissolving, as a surfactant, 2 g of sodium dodecyl sulfate in 250 ml of distilled water, and then a mixture of 80 g of styrene, 15 g of 2-ethylhexyl acrylate and 5 g of acrylic acid were charged. The mixture was stirred at a rate of 200 rpm under a nitrogen gas stream. The reaction mixture was heated to 75° C. A solution obtained by dissolving 0.2 g of potassium persulfate in 10 ml of distilled water was then added to the reaction mixture and polymerization was conducted for 2 hours. The polymerization was continued for further two hours by adding a solution obtained by dissolving 0.2 g of potassium persulfate in 10 ml of distilled water.

The reaction mixture was cooled down to room temperature, followed by dialysis against a cellulose membrane having a molecular cutoff of 10000. After removal of excessive surfactant and inorganic salts, the residue was concentrated under reduced pressure. Insoluble matters were then filtered off, whereby 380 g of a finely emulsified opaque dispersion was obtained.

The resulting dispersion was a fine latex solution having an average grain size of 66 nm and containing 26.3 wt. % of nonvolatile matter.

Another high Tg latex usable in the present invention can easily be synthesized by the similar method.

The high-Tg latex can be used in an amount ranging from 1 g to 20 g, more preferably 1 g to 15 g, per 1 $m^2$ of the photosensitive material. A mixture of two or more of these high-Tg latices, or a mixture of the high-Tg latex with a latex not embraced in the present invention or with a polymer binder is also usable.

The organic-silver-salt-containing layer of the photosensitive material of the present invention may contain, if desired, a hydrophilic polymer such as gelatin, polyvinyl alcohol, methyl cellulose or hydroxypropyl cellulose. The amount of the hydrophilic polymer is preferably 30% by mass or less, more preferably 20% by mass or less, based on the entire binder.

In the present invention, the organic-silver-salt-containing layer (namely, image forming layer) is preferably formed using a polymer latex and the amount of the binder in the organic-silver-salt-containing layer is preferably, in terms of a weight ratio of the entire binder/organic silver salt, from 1/10 to 10/1, more preferably from 1/3 to 5/1, still more preferably from 1/1 to 3/1.

Such an organic-silver-salt-containing layer usually serves also as a photosensitive layer (emulsion layer) containing a photosensitive silver halide which is a photosensitive silver salt. In this case, a weight ratio of the entire binder/silver halide is from 400 to 5, preferably from 200 to 10.

In the present invention, the total binder amount of the image forming layer is preferably from 0.2 to 30 g/$m^2$, more preferably from 1 to 15 g/$m^2$, still more preferably from 2 to 10 g/$m^2$. The image forming layer for use in the present invention may contain a crosslinking agent for forming a crosslink structure or a surfactant for improving the coatability.

(Preferable Solvent for a Coating Solution)

In the present invention, the solvent (for the sake of simplicity, the solvent and the dispersion medium are collectively called a solvent here) used in the coating solution for the organic-silver-salt-containing layer of the photosensitive material is preferably an aqueous solvent containing at least 30% by mass of water.

As a component other than water, an optional water-miscible organic solvent may be used, such as methyl alcohol, ethyl alcohol, isopropyl alcohol, methyl cellosolve, ethyl cellosolve, dimethylformamide and ethyl acetate. The solvent of the coating solution preferably has a water content of 50% by mass or more, more preferably 70% by mass or more.

Examples of preferred solvent compositions include, in addition to water, water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (the numerals are % by mass).

The antifoggant usable in the invention will next be described.

Examples of the antifoggant, stabilizer and stabilizer precursor usable in the present invention include those described in Japanese Patent Laid-Open No. 62899/1998 (paragraph No. 0070) and European Patent Laid-Open No. 0803764A1 (page 20, line 57 to page 21, line 7), and compounds described in Japanese Patent Laid-Open No. 281637/1997, Japanese Patent Laid-Open No. 329864/1997, U.S. Pat. Nos. 6,083,681 and 6,083,681, and European Patent 1048975.

The antifoggant preferably used in the present invention is an organic halide and examples thereof include those disclosed in the patents described in Japanese Patent Laid-Open No. 65021/1999 (paragraph Nos. 0111 to 0112). In particular, preferred are organic halogen compounds represented by formula (P) of Japanese Patent Laid-Open No. 284399/2000, organic polyhalogen compounds represented by formula (II) of Japanese Patent Laid-Open No. 339934/1998, and organic polyhalogen compounds described in Japanese Patent Laid-Open Nos. 31644/2001 and 33911/2001.

The organic polyhalogen compound preferably used in the present invention will next be described below specifically. The polyhalogen compound preferred in the present invention is a compound represented by the following formula (H):

$$Q\text{-}(Y)_n\text{—}C(Z_1)(Z_2)X \qquad \text{Formula (H)}$$

wherein Q represents an alkyl group, an aryl group or a heterocyclic group, Y represents a divalent linking group, n represents 0 or 1, $Z_1$ and $Z_2$ each represents a halogen atom and X represents a hydrogen atom or an electron-withdrawing group.

In formula (H), Q preferably represents a phenyl group substituted by an electron-withdrawing group having a Hammett substituent constant up of a positive value. The Hammett substituent constant is described, for example, in *Journal of Medicinal Chemistry,* 16(11), 1207–1216(1973).

Examples of this electron-withdrawing group include halogen atoms (e.g., fluorine (σp: 0.06), chlorine (up: 0.23), bromine (σp: 0.23), iodine (σp: 0.18)), trihalomethyl groups (e.g., tribromomethyl (σp: 0.29), trichloromethyl (σp: 0.33), trifluoromethyl (σp: 0.54)), a cyano group (σp: 0.66), a nitro group (σp: 0.78), aliphatic-aryl or heterocyclic sulfonyl groups (e.g., methanesulfonyl (σp: 0.72)), aliphatic-aryl or heterocyclic acyl groups (e.g., acetyl (σp: 0.50), benzoyl (σp: 0.43)), alkynyl groups (e.g., C≡CH (σp: 0.23)), aliphatic-aryl or heterocyclic oxycarbonyl groups (e.g., methoxycarbonyl (σp: 0.45), phenoxycarbonyl (σp: 0.44)), a carbamoyl group (σp: 0.36), a sulfamoyl group (σp: 0.57), a sulfoxide group, a heterocyclic group and a phosphoryl group. The σp value is preferably from 0.2 to 2.0, more preferably from 0.4 to 1.0.

Preferred examples of the electron-withdrawing group include a carbamoyl group, an alkoxycarbonyl group, an alkylsulfonyl group and an alkylphosphoryl group. Of these, a carbamoyl group is most preferred.

X is preferably an electron-withdrawing group, more preferably a halogen atom, an aliphatic-aryl or heterocyclic sulfonyl group, an aliphatic-aryl or heterocyclic acyl group, an aliphatic-aryl or heterocyclic oxycarbonyl group, a carbamoyl group or a sulfamoyl group, especially a halogen atom. Among halogen atoms, chlorine, bromine and iodine are preferred, of which chlorine and bromine are more preferred, with bromine being particularly preferred.

Y preferably represents —C(═O)—, —SO— or —$SO_2$—, more preferably —C(═O)— or —$SO_2$—, especially —$SO_2$—. The letter n represents 0 or 1, preferably 1.

Specific examples of the compound represented by formula (H) for use in the present invention are set forth below.

(III-1)

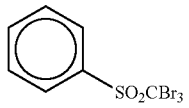

(III-2)

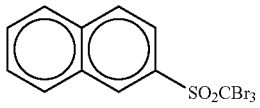

(III-3)

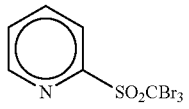

(III-4)

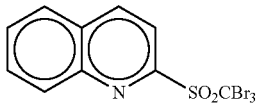

(III-5)

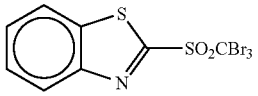

(III-6)

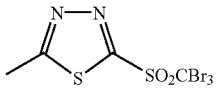

(III-7)

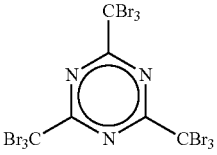

(III-8)

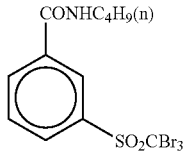

-continued (III-9)

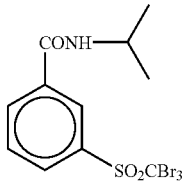

(III-10)

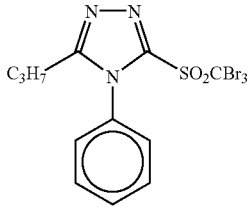

(III-11)

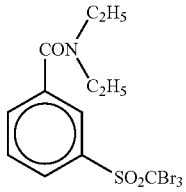

(III-12)

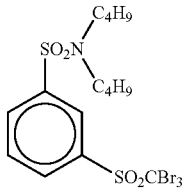

(III-13)

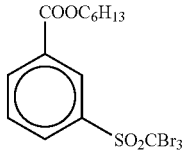

(III-14)

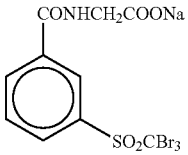

(III-15)

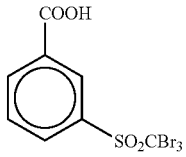

(III-16)

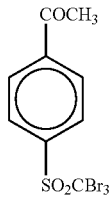

-continued (III-17)

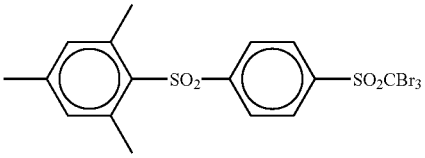

(III-18)

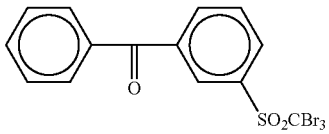

(III-19)

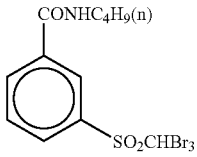

(III-20)

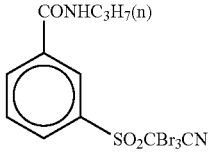

(III-21)

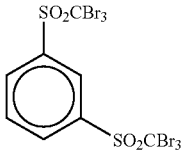

(III-22)

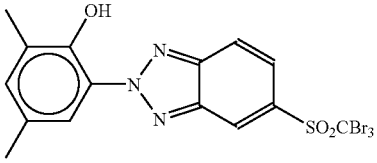

(III-23)

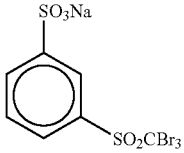

(III-24)

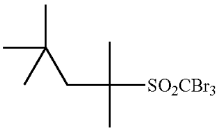

The compound represented by formula (H) is preferably used in an amount of from $1\times10^{-4}$ to 0.5 mol, more preferably from $10^{-3}$ to 0.1 mol, still more preferably from $5\times10^{-3}$ to 0.05 mol, per mol of the non-photosensitive organic silver salt in the image forming layer.

In the present invention, for incorporating the antifoggant in the photosensitive material, the above-described methods employed for incorporation of a reducing agent may be used. The organic polyhalogen compound is also preferably added in the form of a solid fine particle dispersion.

Other examples of the antifoggant include mercury(II) salts described in Japanese Patent Laid-Open No. 65021/1999 (paragraph No. 0113), benzoic acids described in the same patent publication (paragraph No. 0114), salicylic acid derivatives described in Japanese Patent Laid-Open No. 206642/2000, formalin scavenger compounds represented by formula (S) of Japanese Patent Laid-Open No. 221634/2000, triazine compounds according to claim 9 of Japanese Patent Laid-Open No. 352624/1999, compounds represented by the formula (III) of Japanese Patent Laid-Open No. 11791/1994, and 4-hydroxy-6-methyl-1,3,3a,7-tetrazaindene.

For the purpose of preventing fogging, the heat-developable photosensitive material of the present invention may contain an azolium salt. Examples of the azolium salt include the compounds represented by formula (XI) of Japanese Patent Laid-Open No. 193447/1984, the compounds described in Japanese Patent Publication No. 12581/1980, and the compounds represented by formula (II) of Japanese Patent Laid-Open No. 153039/1985. The azolium salt may be added to any site of the photosensitive material but is preferably added to a layer on the surface having a photosensitive layer, more preferably to the organic-silver-salt-containing layer.

The timing of adding azolium salt may be any step during the preparation of the coating solution. In the case of adding the azolium salt to the organic-silver-salt-containing layer, the addition may be made in any step between the preparation of the organic silver salt and the preparation of the coating solution, however, the addition is preferably made between after the preparation of the organic silver salt and immediately before the coating. The azolium salt may be added in any form such as powder, solution or fine grain dispersion. It may be added as a mixed solution with other additives such as sensitizing dye, reducing agent and toning agent.

In the present invention, the azolium salt may be added in any amount but the amount is preferably from $1\times10^{-6}$ to 2 mol, more preferably from $1\times10^{-3}$ to 0.5 mol, per mol of silver.

In the present invention, a mercapto compound, a disulfide compound or a thione compound may be incorporated so as to control development by suppression or promotion, enhance the spectral sensitization efficiency or improve the shelf life before or after the development. Examples of these compounds include the compounds described in Japanese Patent Laid-Open No. 62899/1998 (paragraph Nos. 0067 to 0069), the compounds represented by formula (I) of Japanese Patent Laid-Open No. 186572/1998 (and specific examples thereof described in paragraph Nos. 0033 to 0052) and the compounds described in European Patent Laid-Open No. 0803764A1 (page 20, lines 36 to 56). Of these, mercapto-substituted heteroaromatic compounds described in Japanese Patent Laid-Open Nos. 297367/1998, 304875/1998 and 100358/2001 are preferred.

A color toning agent is preferably added to the heat-developable photosensitive material of the present invention. Examples of the color toning agent include those described in Japanese Patent Laid-Open No. 62899/1998 (paragraph Nos. 0054 to 0055), European Patent Laid-Open NO. 0803764A1 (page 21, lines 23 to 48), Japanese Patent Laid-Open No. 356317/2000 and Japanese Patent Application No. 187298/2000. Particularly preferred are phthalazinones (phthalazinone, phthalazinone derivatives, and metal salts of phthalazinone, e.g., 4-(1-naphthyl)phthalazinone, 6-chlorophthalazinone, 5,7-dimethoxyphthalazinone, 2,3-dihydro-1,4-phthalazinedione); combinations of a phthalazinone and a phthalic acid (e.g., phthalic acid, 4-methylphthalic acid, 4-nitrophthalic acid, diammonium phthalate, sodium phthalate, potassium phthalate, tetrachlorophthalic anhydride); phthalazines (phthalazine, phthalazine derivatives, and metal salts of phthalazine, e.g., 4-(1-naphthyl)phthalazine, 6-isopropylphthalazine, 6-tert-butylphthalazine, 6-chlorophthalazine, 5,7-dimethoxyphthalazine, 2,3-dihydrophthalazine); and combinations of a phthalazine and a phthalic acid, with the combinations of a phthalazine and a phthalic acid being more preferred. Of these, a combination of 6-isopropylphthalazine and phthalic acid or 4-methylphthalic acid is especially preferred.

The plasticizer and lubricant which can be used in the photosensitive layer in the present invention are described in Japanese Patent Laid-Open No. 65021/1999 (paragraph No. 0117); the ultrahigh contrast-providing agent for the formation of an ultrahigh contrast image and addition method or addition amount of the agent, each usable in the present invention, are described in Japanese Patent Laid-Open No. 65021/1999 supra (paragraph No. 0118), Japanese Patent Laid-Open No. 223898/1999 (paragraph Nos. 0136 to 0193), Japanese Patent Laid-Open No. 2884399/2000 (compounds represented by formula (H), formulas (1) to (3) and formulas (A) and (B)), and Japanese Patent Application No. 91652/1999 (compounds represented by formulas (III) to (V), specific compounds: Chem. 21 to Chem. 24); and the contrast-promoting agent usable in the present invention is described in Japanese Patent Laid-Open No. 65021/1999 (paragraph No. 0102) and Japanese Patent Laid-Open No. 11-223898 (paragraph Nos. 0194 to 0195).

When a formic acid or a formate is used as a strong foggant, it is preferably contained in the side having an image forming layer containing a photosensitive silver halide in an amount of 5 mmol or less, more preferably 1 mmol or less, per mol of silver.

In the case where the ultrahigh contrast-providing agent is used in the heat-developable photosensitive material of the present invention, an acid resulting from the hydration of diphosphorus pentoxide, or a salt thereof is preferably used in combination.

Examples of the acid resulting from the hydration of diphosphorus pentoxide, and salts thereof include metaphosphoric acid (and salts thereof), pyrophosphoric acid (and salts thereof), orthophosphoric acid (and salts thereof), triphosphoric acid (and salts thereof), tetraphosphoric acid (and salts thereof), and hexametaphosphoric acid (and salts thereof).

Among these, particularly preferred are orthophosphoric acid (and salts thereof) and hexametaphosphoric acid (and salts thereof).

Specific examples of these salts include sodium orthophosphate, sodium dihydrogen orthophosphate, sodium hexametaphosphate and ammonium hexametaphosphate.

The amount (coated amount per $m^2$ of the photosensitive material) of the acid resulting from the hydration of disphosphorus pentoxide, or a salt thereof may be a desired amount determined in accordance with the properties such as sensitivity and fog, but is preferably from 0.1 to 500 $mg/m^2$, more preferably 0.5 to 100 $mg/m^2$.

The heat-developable photosensitive material of the present invention may have a surface protective layer formed thereon in order to prevent the adhesion of the image forming layer. The surface protective layer may be a single layer or composed of plural layers. A description on the surface protective layer can be found in Japanese Patent Laid-Open No. 11-65021 (paragraph Nos. 0119 to 0120) and Japanese Patent Application No. 2000-171936.

In the present invention, the binder for the surface protective layer is preferably gelatin but polyvinyl alcohol (PVA) may also be preferably used or may be preferably used in combination with gelatin. Examples of the gelatin usable here include inert gelatin (e.g., "Nitta gelatin 750", trade name) and phthalated gelatin (e.g., "Nitta gelatin 801", trade name).

Examples of PVA include those described in Japanese Patent Laid-Open No. 171936/2000 (paragraph Nos. 0009 to 0020) and preferred examples thereof include completely saponified product "PVA-105", partially saponified product "PVA-205" and "PVA-335" and modified polyvinyl alcohol "MP-203" (each, trade name, product of Kuraray Co., Ltd).

The coated amount (per $m^2$ of the support) of polyvinyl alcohol of the protective layer (per one layer) is preferably from 0.3 to 4.0 $g/m^2$, more preferably from 0.3 to 2.0 $g/m^2$.

Particularly when the heat-developable photosensitive material of the present invention is used for printing where the dimensional change becomes a problem, a polymer latex is preferably used for the surface protective layer or the back layer.

A description on such a polymer latex can be found in Taira Okuda and Hiroshi Inagaki (compilers), *Gosei Jushi Emulsion* (*Synthetic Resin Emulsion*), Kobunshi Kankokai (1978), Takaaki Sugimura, Yasuo Kataoka, Soichi Suzuki and Keishi Kasahara (compilers), *Gosei Latex no Oyo* (*Application of Synthetic Latex*), Kobunshi Kankokai (1993), and Soichi Muroi, *Gosei Latex no Kagaku* (*Chemistry of Synthetic Latex*), Kobunshi Kankokai (1970). Specific examples of the polymer latex include a latex of methyl methacrylate (33.5% by mass)/ethyl acrylate (50% by mass)/methacrylic acid (16.5% by mass) copolymer, a latex of methyl methacrylate (47.5% by mass)/butadiene (47.5% by mass)/itaconic acid (5% by mass) copolymer, a latex of ethyl acrylate (50% by mass)/methacrylic acid (50% by mass) copolymer, a latex of methyl methacrylate (58.9% by mass)/2-ethylhexyl acrylate (25.4% by mass)/styrene (8.6% by mass)/2-hydroxyethyl methacrylate (5.1% by mass)/acrylic acid (2.0% by mass) copolymer and a latex of methyl methacrylate (64.0% by mass)/styrene (9.0% by mass)/butyl acrylate (20.0% by mass)/2-hydroxyethyl methacrylate (5.0% by mass)/acrylic acid (2.0% by mass) copolymer.

For the binder of the surface protective layer, a combination of polymer latices described in Japanese Patent Application No. 6872/1999, and the techniques described in Japanese Patent Application Nos. 143058/1999 (paragraph Nos. 0021 to 0025), 6872/1999 (paragraph Nos. 0027 to 0028) and 199626/1998 (paragraph Nos. 0023 to 0041) may also be applied.

The percentage of the polymer latex in the surface protective layer is preferably from 10 to 90% by mass, more preferably from 20 to 80% by mass, based on the entire binder.

The coated amount (per $m^2$ of the support) of the entire binder (including water-soluble polymer and latex polymer) for the surface protective layer (per one layer) is preferably from 0.3 to 5.0 $g/m^2$, more preferably from 0.3 to 2.0 $g/m^2$.

In the present invention, the temperature upon preparation of a coating solution for the image forming layer is preferably from 30 to 65° C., more preferably from 35 but less than 60° C., still more preferably from 35 to 55° C. Furthermore, the coating solution for the image forming layer immediately after the addition of the polymer latex is preferably kept at a temperature of 30 to 65° C.

In the present invention, the image forming layer is composed of one or more layer(s) on the support. In the case where the image forming layer is composed of a single layer, the layer comprises an organic silver salt, a photosensitive silver halide, a reducing agent and a binder and if desired, additionally contains desired materials such as a color toning agent, a coating aid and other adjuvants. In the case where the image forming layer is composed of two or more layers, a first image forming layer (usually a layer adjacent to the support) contains an organic silver salt and a photosensitive silver halide, and a second image forming layer or these two layers contain some other components.

In the structure of a multi-color photosensitive heat-developable photographic material, a combination of these two layers may be provided for each color or as described in U.S. Pat. No. 4,708,928, all the components may be contained in a single layer. In the case of a multi-dye multicolor photosensitive heat-developable photographic material, respective emulsion layers are held separated each other by using a functional or nonfunctional barrier layer, as described in U.S. Pat. No. 4,460,681.

In the present invention, the photosensitive layer may contain various dyes or pigments (for example, C.I. Pigment Blue 60, C.I. Pigment Blue 64, C.I. Pigment Blue 15:6) from the standpoint of improving the tone, inhibiting the generation of interference fringes on laser exposure or preventing the irradiation. These are described in detail in WO98/36322, Japanese Patent Laid-Open No. 268465/1998 and Japanese Patent Laid-Open No. 338098/1999.

In the heat-developable photosensitive material of the present invention, an antihalation layer can be provided in the side farther from a light source with respect to the photosensitive layer.

The heat-developable photosensitive material generally has a non-photosensitive layer in addition to the photosensitive layer. The non-photosensitive layer can be classified by its position, into (1) a protective layer provided on a photosensitive layer (in the side farther from the support), (2) an interlayer provided between a plurality of photosensitive layers or between a photosensitive layer and a protective layer, (3) an undercoat layer provided between a photosensitive layer and a support, and (4) a back layer provided on the side opposite the photosensitive layer. In the photosensitive material, a filter layer is provided as the layer (1) or (2) and an antihalation layer is provided as the (3) or (4).

A description on the antihalation layer can be found in Japanese Patent Laid-Open No. 65021/1999 (paragraph Nos. 0123 to 0124), and Japanese Patent Laid-Open Nos. 223898/1999, 230531/1997, 36695/1998, 104779/1998, 231457/1999, 352625/1999 and 352626/1999.

The antihalation layer contains an antihalation dye having absorption in the exposure wavelength. In the present invention, the exposure laser has a peak wavelength at 350 nm to 450 nm so that a dye capable of absorbing this wavelength is preferably used for the antihalation layer.

When the halation is prevented using a dye having absorption in the visible dye, it is preferred to allow substantially no color of the dye to remain after the formation of an image. For this purpose, means capable of decolorizing under the action of heat at the heat development is preferably used. In particular, the non-photosensitive layer is preferably rendered to function as an antihalation layer by adding thereto a thermally decolorizable dye and a base precursor. Japanese Patent Laid-Open No. 231457/1999 describes these techniques.

The amount of the decolorizable dye is determined according to the using purpose of the dye. In general, the decolorizable dye is used in an amount of giving an optical density (absorbance) in excess of 0.1 when measured at the objective wavelength. The optical density is preferably from 0.15 to 2, more preferably 0.2 to 1. For attaining such an optical density, the amount of the dye is generally from about 0.001 to 1 g/m$^2$.

By such decolorization of a dye, the optical density after heat development can be reduced to 0.1 or less. Two or more decolorizable dyes may be used in combination in the thermally decolorizable recording material or heat-developable photosensitive material. Also, two or more base precursors may be used in combination.

In the thermal decolorization using these decolorizable dye and base precursor, a substance (e.g., diphenylsulfone, 4-chlorophenyl(phenyl)sulfone) capable of lowering the melting point by 3° C. or more when mixed with the base precursor, as described in Japanese Patent Laid-Open No. 352626/1999, or 2-naphthylbenzoate is preferably used in combination in view of the thermal decolorizability and the like.

In the present invention, a coloring agent having an absorption maximum at 300 to 450 nm can be added for the purpose of improving silver tone or a time-dependent change of image. Examples of such a coloring agent include those described in Japanese Patent Laid-Open Nos. 210458/1987, 104046/1988, 103235/1988, 208846/1988, 306436/1988, 314535/1988, 61745/1989 and 100363/2001.

Such a coloring agent is usually added in an amount ranging from 0.1 mg/m$^2$ to 1 g/m$^2$ and the layer to which the coloring agent is added is preferably a back layer provided on the side opposite to the photosensitive layer.

The heat-developable photosensitive material of the present invention is preferably a so-called one-side photosensitive material having at least a photosensitive layer containing a silver halide emulsion on one side of the support and a back layer on the other side.

In the present invention, a matting agent is preferably added for improving the carrying property. Examples of the matting agent include those described in Japanese Patent Laid-Open No. 65021/1999 (paragraph Nos. 0126 to 0127). The amount of the matting agent is, in terms of the coated amount per m$^2$ of the photosensitive material, preferably from 1 to 400 mg/m$^2$, more preferably from 5 to 300 mg/m$^2$.

The matting agent may have either finite or amorphous, but is preferably finite and spherical. The matting agent has an average particle size of preferably from 0.5 to 10 μm, more preferably from 1.0 to 8.0 μm, still more preferably from 2.0 to 6.0 μm. The coefficient of variation of size distribution is preferably 50% or less, more preferably 40% or less, still more preferably 30% or less. The term "coefficient of variation" as used herein means a value expressed by (standard deviation of particle size)/(average of particle size)×100. Use of at least two matting agents exhibiting a small coefficient of variation and different each other by at least 3 as an average particle size ratio is preferred.

The matting degree on the emulsion surface may be any value insofar as a stardust failure does not occur, but is preferably, in terms of the Beck smoothness, from 30 to 2,000 seconds, more preferably from 40 to 1,500 seconds. The Beck smoothness can be easily determined according to Japanese Industrial Standard (JIS) P8119, "Test Method for Smoothness of Paper and Paperboard by Beck Tester" and TAPPI Standard Method T479.

As for the matting degree of the back layer for use in the present invention, the Beck smoothness is preferably from 10 to 1,200 seconds, more preferably from 20 to 800 seconds, still more preferably from 40 to 500 seconds.

In the present invention, the matting agent is preferably incorporated into the outermost surface layer, a layer acting as the outermost surface layer, or a layer close to the outer surface layer, or preferably incorporated into a layer acting as a protective layer.

As for the back layer which can be applied to the present invention, Japanese Patent Laid-Open No. 65021/1999 (paragraph Nos. 0128 to 0130) describes this.

In the present invention, the pH on the layer surface of the heat-developable photosensitive layer before heat development is preferably 7.0 or less, more preferably 6.6 or less. The lower limit thereof is not particularly limited but is about 3. The most preferred pH range is from 4 to 6.2.

Use of a nonvolatile acid such as organic acid (e.g., phthalic acid derivative) or sulfuric acid or a volatile base such as ammonia for adjusting the pH on the layer surface is preferred from the standpoint of reducing the pH on the layer surface. In particular, since ammonia is readily volatilized and can be removed before the coating step or the heat development, it is preferred for achieving a low layer surface pH.

Furthermore, a combined use of ammonia with a nonvolatile base such as sodium hydroxide, potassium hydroxide or lithium hydroxide is preferred. The method of measuring the pH on the layer surface is described in Japanese Patent Application No. 87297/1999 (paragraph No. 0123).

In the present invention, a hardening agent may be used for each of the layers such as photosensitive layer, protective layer and back layer. As the hardening agent, in addition to those described in T. H. James, *The Theory of the Photographic Process Fourth Edition*, pp. 77–87, Macmillan Publishing Co., Inc. (1977), chrome alum, 2,4-dichloro-6-hydroxy-s-triazine sodium salt, N,N-ethylene-bis(vinylsulfonacetamide) and N,N-propylenebis(vinylsulfonacetamide), polyvalent metal ion described in *ibid.*, page 78, polyisocyanates described in U.S. Pat. No. 4,281,060 and Japanese Patent Laid-Open No. 208193/1994, epoxy compounds described in U.S. Pat. No. 4,791,042, and vinyl sulfone-base compounds described in Japanese Patent Laid-Open No. 89048/1987 are preferably used.

The hardening agent is added as a solution. This solution is added to the coating solution for the protective layer from 180 minutes to immediately before the coating, preferably from 60 minutes to 10 seconds before the coating. No particular limitation is imposed on the mixing method and conditions insofar as the effect of the present invention is satisfactorily brought out.

Specific examples of the mixing method include a method of mixing the solutions in a tank designed to give a desired average residence time which is calculated from the addition flow rate and the liquid transfer amount to the coater, and a method using a static mixer as described in N. Harnby, M. F. Edwards and A. W. Nienow (translated by Koji Takahashi), *Ekitai Kongo Gijutsu* (*Liquid Mixing Technique*), Chap. 8, Nikkan Kogyo Shinbun Sha (1989).

The surfactant which can be applied to the present invention is described in Japanese Patent Laid-Open No. 65021/1999 (paragraph No. 0132), the solvent is described in paragraph No. 0133 of the same, the support is described in paragraph No. 0134 of the same, the antistatic or conducting layer is described in paragraph No. 0135 of the same, the method for obtaining a color image is described in paragraph No. 0136 of the same, and the slipping agent is described in Japanese Patent Laid-Open No. 84573/1999 (paragraph Nos. 0061 to 0064) and Japanese Patent Application No. 106881/1999 (paragraph Nos. 0049 to 0062).

In the present invention, the photosensitive material preferably has a conductive layer containing a metal oxide. As the conductive material for the conductive layer, metal oxides having increased conductivity by introducing therein oxygen defects or different metal atoms are preferred.

Preferred examples of the metal oxide include ZnO, $TiO_2$ and $SnO_2$. Addition of Al or In to $ZnO_2$, addition of Sb, Nb, P or halogen element to $SnO_2$ and Nb or Ta to $TiO_2$ is preferred. In particular, $SnO_2$ added with Sb is preferred.

The amount of the different metal atom to be introduced in the metal oxide is preferably from 0.01 to 30 mol %, more preferably from 0.1 to 10 mol %. Although the metal oxide may be in any one of spherical, needle-like and plate-like forms, needle-like particles having a long axis/short axis ratio of 2.0 or greater, preferably 3.0 to 50 are preferred for imparting conductivity to the conductive material.

The metal oxide is used in an amount of from 1 $mg/m^2$ to 1000 $mg/m^2$, more preferably from 10 $mg/m^2$ to 500 $mg/m^2$, still more preferably from 20 $mg/m^2$ to 200 $mg/m^2$. Although the conductive layer of the present invention may be disposed either on the emulsion surface side or back surface side, disposal between a support and back layer is preferred. The specific examples of the conductive layer of the present invention are described in Japanese Patent Laid-Open No. 295146/1995 or 223901/1999.

In the present invention, use of a fluorine surfactant is preferred. Specific examples of the fluorine surfactant include compounds described in Japanese Patent Laid-Open Nos. 197985/1998, 19680/2000, and 214554/2000. High-molecular fluorine surfactants as described in Japanese Patent Laid-Open No. 281636/1997 are also preferred. In the present invention, use of fluorine surfactants as described in Japanese Patent Application No. 206560/2000 is especially preferred.

The transparent support is preferably polyester, particularly polyethylene terephthalate, subjected to a heat treatment in the temperature range of 130 to 185° C. so as to relax the remaining internal distortion in the film during the biaxial stretching, thereby eliminating occurrence of thermal shrinkage distortion during the heat development. In the case of a heat-developable photosensitive material for medical uses, the transparent support may be colored with a bluish dye (for example, Dye-1 described in Example of Japanese Patent Laid-Open No. 240877/1996) or may be colorless.

For the support, a technique for undercoating a water-soluble polyester as described in Japanese Patent Laid-Open No. 84574/1999, a styrene-butadiene copolymer as described in Japanese Patent Laid-Open No. 186565/1998, or a vinylidene chloride copolymer as described in Japanese Patent Laid-Open No. 39684/2000 and Japanese Patent Application No. 106881/1999 (paragraph Nos. 0063 to 0080) is preferably applied.

As for the antistatic layer or undercoat, the techniques as described in Japanese Patent Laid-Open Nos. 143430/1981, 143431/1981, 62646/1983, 120519/1981, and 84573/1999 (paragraph Nos. 0040 to 0051), U.S. Pat. No. 5,575,957 and Japanese Patent Laid-Open No. 223898/1999 (paragraph Nos. 0078 to 0084) can be applied.

The heat-developable photosensitive material is preferably a mono-sheet type (a type where an image can be formed on the heat-developable photosensitive material without using another sheet such as image-receiving material).

The heat-developable photosensitive material may further contain an antioxidant, a stabilizer, a plasticizer, an ultraviolet absorber and a coating aid. These various additives are added to either a photosensitive layer or a non-photosensitive layer. As for these additives, usable as reference are WO98/36322, European Patent No. 803764A1, Japanese Patent Laid-Open No. 186567/1998 and Japanese Patent Laid-Open No. 18568/1998.

The the heat-developable photosensitive material of the present invention may be coated in any manner. Various coating operations including extrusion coating, slide coating, curtain coating, dip coating, knife coating, flow coating, and extrusion coating using a hopper of the type as described in U.S. Pat. No. 2,681,294 may be used. The extrusion coating or slide coating as described in Stephen F. Kistler and Petert M. Schweizer, *LIQUID FILM COATING*, pp. 399–536, CHAPMAN & HALL (1977) is preferred, with the slide coating being more preferred. An example of the shape of the slide coater used in the slide coating is shown in FIG. 11b.1 of *ibid.*, page 427. If desired, two or more layers may be simultaneously coated using a method described in *ibid.*, pp. 399–536, U.S. Pat. No. 2,761,791 and British Patent No. 837,095.

The coating solution for the organic-silver-salt-containing layer used in the present invention is preferably a so-called thixotropy fluid. As for this technique, usable as reference is Japanese Patent Laid-Open No. 52509/1999.

The coating solution for the organic-silver-salt-containing layer used in the present invention preferably has a viscosity at a shear rate of $0.1S^{-1}$, of 400 to 100,000 mPa·s, more preferably from 500 to 20,000 mPa·s. At a shear rate of 1,000 $S^{-1}$, the viscosity is preferably from 1 to 200 mPa·s, more preferably from 5 to 80 mPa·s.

Examples of the technique which can be used in the heat-developable photosensitive material of the present invention include those described in European Patent Nos. 803764A1 and 883022A1, WO98/36322, Japanese Patent Laid-Open Nos. 62648/1981, 62644/1983, 43766/1997, 281637/1997, 297367/1997, 304869/1997, 311405/1997, 329865/1997, 10669/1998, 62899/1998, 69023/1998, 186568/1998, 90823/1998, 171063/1998, 186565/1998, 186567/1998, 186569/1998 to 186572/1998, 197974/1998, 197982/1998, 197983/1998, 197985/1998 to 197987/1998, 207001/1998, 207004/1998, 221807/1998, 282601/1998, 288823/1998, 288824/1998, 307365/1998, 312038/1998, 339934/1998, 7100/1999, 15105/1999, 24200/1999, 24201/1999, 30832/1999, 84574/1999, 65021/1999, 109547/1999, 125880/1999, 129629/1999, 133536/1999 to 133539/1999, 133542/1999, 133543/1999, 223898/1999, 352627/1999, 305377/1999, 305378/1999, 305384/1999, 305380/1999, 316435/1999, 327076/1999, 338096/1999, 338098/1999, 338099/1999 and 343420/1999, and Japanese Patent Application Nos. 187298/2000, 10229/2000, 47345/2000, 206642/2000, 98530/2000, 98531/2000, 112059/2000, 112060/2000, 112104/2000, 112064/2000 and 171936/2000.

The photosensitive material of the present invention is preferably wrapped with a packaging material having a low oxygen permeability and/or water permeability in order to suppress variations in photographic performance upon storage or straighten the curl or curing habit.

The oxygen permeability at 25° C. is preferably 50 ml/atm·$m^2$·day or less, more preferably 10 ml/atm·$m^2$·day or less, still more preferably 1.0 ml/atm·$m^2$·day or less. The water permeability is preferably 10 g/atm·$m^2$·day or less, more preferably 5 g/atm·$m^2$·day or less, still more preferably 1 g/atm·$m^2$·day or less.

Specific examples of the packaging material low in a low oxygen permeability and/or water permeability include those described in Japanese Patent Laid-Open Nos. 254793/1996 and 206653/2000.

The heat-developable photosensitive material of the present invention may be developed by any method but usually, the development is performed by raising the temperature of an imagewise exposed heat-developable photosensitive material. The development temperature is preferably from 80 to 250° C., more preferably from 100 to 140° C., still more preferably from 110 to 130° C.

In the present invention, when the development temperature is 110° C. or more, the heat-developable photosensitive material of the present invention having a rich silver iodide has an excellent progressing property of development, while the conventional heat-developable photosensitive material having a rich silver iodide has an deteriorated progressing property of development, compared with one having a rich silver bromide.

The development time is preferably from 1 to 60 seconds, more preferably from 3 to 30 seconds, still more preferably from 5 to 25 seconds, especially from 7 to 15 seconds.

As a heat development system, either a drum heater or a plate heater may be used, but the latter is preferred. As heat development system using the plate heater, that described in the method of Japanese Patent Laid-Open No. 1335721/1999 is preferred. This is a heat developing apparatus of obtaining a visible image by bringing a heat-developable photosensitive material having formed thereon a latent image into contact with heating means in the heat-developing section. It has a plate heater for heating and is characterized by that a plurality of press rollers are disposed to face each other along one surface of the plate heater, and the heat-developable photosensitive material is caused to pass between the press rollers and the plate heater, thereby performing the heat development. The plate heater is preferably divided into 2 to 6 stages and the temperature at the leading end is preferably lowered by approximately from 1 to 10° C.

For example, four plate heaters capable of controlling temperature individually are used and they are controlled to be 112° C., 119° C., 121° C. and 120° C., respectively. Such a method is described also in Japanese Patent Laid-Open No. 30032/1979, where the water content or organic solvent contained in the heat-developable photosensitive material can be excluded out of the system and the heat-developable photosensitive material can be prevented from a change in the shape of the support which is otherwise caused by abrupt heating of the heat-developable photosensitive layer.

The photosensitive material of the present invention exhibits its characteristics when exposed to a light having a high illuminance of 1 mW/$mm^2$ or greater for a short period. When exposed to light of such high illuminance, the heat-developable material of the present application containing an iodide-rich silver halide emulsion and a non-photosensitive organic silver salt is able to gain sufficient sensitivity. In other words, compared with exposure to light of low illuminance, exposure to light of high illuminance according to this application makes it possible to impart the material with high sensitivity.

The illuminance is preferably of from 2 mW/$mm^2$ to 50 W/$mm^2$, more preferably from 10 mW/$mm^2$ to 50 W/$mm^2$.

For the heat-developable photosensitive material of the present invention, any light source may be used insofar as it has such high illuminance. A laser ray is however preferred for attaining the object of the present invention.

The laser for use in the present invention is preferably a gas laser (e.g., $Ar^+$, He—Ne), a YAG laser, a dye laser or a semiconductor laser. Also, a laser combined with a second harmonic generating device may be used. A semiconductor laser capable of emitting light from blue to violet is more preferred. Examples of the high-output semiconductor laser emitting light of blue to violet include a semiconductor laser "NLHV3000E" (trade name; product of NICHIA CORPORATION).

Laser light of 35 mW in output and 405 nm in wavelength is disclosed. By the use of such laser light, it is possible to obtain light of high illuminance at 390 nm to 430 nm, which is a particularly preferred wavelength for the present invention.

For the photosensitive material of the present invention, laser light is preferred as a light source for exposure. Although the silver-iodide-rich emulsion is preferably employed in the present invention, a silver-iodide-rich emulsion had a problem in low sensitivity before. It has been found, however, that when the emulsion of the present invention is used, image can be recorded at less energy when writing is conducted using light of a high illuminance such as laser light.

Particularly in the case of an exposure amount permitting maximum density, the surface of the photosensitive material is preferably exposed to light under an illuminance of from 0.1 W/mm$^2$ to 100 W/mm$^2$, more preferably from 0.5 W/mm$^2$ to 50 W/mm$^2$, still more preferably from 1 W/mm$^2$ to 50 W/mm$^2$.

The laser for use in the present invention is preferably a gas laser (e.g., $Ar^+$, He—Ne), a YAG laser, a dye laser or a semiconductor laser. Also, a semiconductor laser combined with a second harmonic generating device may be used. A gas or semiconductor laser capable of emitting light from red to infrared is preferred. A wavelength of a laser light is preferably from 600 nm to 900 nm, especially from 620 nm to 850 nm.

The laser light of longitudinal multimode oscillation by the high frequency superposing method or the like is preferably employed.

Examples of the medical-use laser imager equipped with an exposure section and a heat-development section include Fuji Medical Dry Laser Imager "FM-DP L" (trade name).

The MF-DP L is described in *Fuji Medical Review*, No. 8, pp. 39–55 and it is needless to say that the technique described in this publication can be applied as a laser imager for the heat-developable photosensitive material of the present invention. Furthermore, the heat-developable photosensitive material of the present invention can also be used as that for a laser imager in the "AD network" which is proposed as a network system adaptable for the DICOM standard from Fuji Medical System.

The heat-developable photosensitive material of the present invention is suited for the formation of a black-and-white image by the silver image and is preferably used as a heat-developable photosensitive material for medical diagnosis, industrial photography, printing or COM.

EXAMPLES

The present invention will hereinafter be described in detail by Examples. It should however be borne in mind that the present invention is not limited to or by them.

Example 1

(Preparation of PET Support)

PET having an intrinsic viscosity IV of 0.66 (as measured at 25° C. in phenol/tetrachloroethane=6/4 (by weight)) was obtained in a conventional manner using terephthalic acid and ethylene glycol. The resulting PET was pelletized. The pellets thus obtained were dried at 130° C. for 4 hours. After melting at 300° C., 0.04 wt. % of Dye BB having the below-described structure was incorporated. The mixture was then extruded from a T-die, followed by quenching, whereby an unstretched film having a thickness great enough to give a thickness of 175 μm after the heat setting.

Dye BB

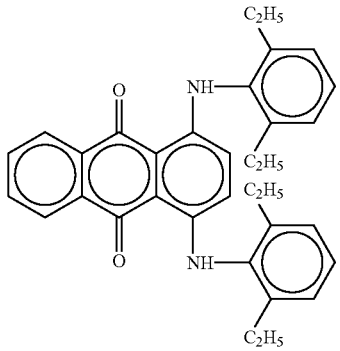

This film was stretched to 3.3 times in the machine direction using rolls different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was released, both edges of the film were knurled, and the film was taken up at 4 kg/cm$^2$ to obtain a roll having a thickness of 175 μm.

(Surface Corona Treatment)

Both surfaces of the support was treated at room temperature at 20 m/min using a solid state corona treating machine "Model 6 KVA" (trade name; product of Pillar Technologies). The current and voltage indicated by the machine revealed that the support underwent the treatment of 0.375 kV·A·min/m$^2$ at that time. The treatment frequency here was 9.6 kHz and the gap clearance between the electrode and the dielectric roll was 1.6 mm.

(Preparation of Undercoated Support)

(1) Preparation of Coating Solution for Undercoat Layer

| | |
|---|---|
| Formulation (1) (for undercoat layer in the photosensitive layer side): | |
| "PESRESIN A-520" (trade name; 30% by mass solution) product of Takamatsu Yushi K. K. | 59 g |
| Polyethylene glycol mononononylphenyl ether (average ethylene oxide number: 8.5), 10% by mass solution | 5.4 g |
| "MP-1000" (fine polymer particles, average particle size: 0.4 μm) produced by Soken Kagaku K. K. | 0.91 g |
| Distilled water | 935 ml |
| Formulation (2) (for first layer on the back surface): | |
| Styrene/butadiene copolymer latex (solid content: 40% by mass, a styrene/butadiene weight ratio: 68:32) | 158 g |
| 2,4-Dichloro-6-hydroxy-S-triazine sodium salt, 8% by mass aqueous solution | 20 g |
| 1% By mass aqueous solution of sodium lauryl benzene sulfonate | 10 ml |
| Distilled water | 854 ml |

-continued

| Formulation (3) (for second layer on the back surface): | |
|---|---|
| $SnO_2$/SbO (9/1 by mass, average particle size: 0.038 μm, 17% by mass dispersion) | 84 g |
| Gelatin (10% by mass aqueous solution) | 89.2 g |
| "METROSE TC-5" (trade name; 2% by mass aqueous solution) product of Shin-Etsu Chemical Co., Ltd. | 8.6 g |
| "MP-1000" (trade name) product of Soken Kagaku K. K. | 0.01 g |
| 1% By mass aqueous solution of sodium dodecyl benzene sulfonate | 10 ml |
| NaOH (1% by mass) | 6 ml |
| "PROXEL" (trade name; product of ICI) | 1 ml |
| Distilled water | 805 ml |

(Preparation of Undercoated Support)

Both surfaces of the 175 μm-thick biaxially stretched polyethylene terephthalate support obtained above each was subjected to the above-described corona discharge treatment and on one surface (photosensitive layer surface), the undercoat coating solution of formulation (1) was applied by a wire bar to have a wet coated amount of 6.6 ml/$m^2$ (per one surface) and dried at 180° C. for 5 minutes. Thereafter, on the opposite side thereof (back surface), the undercoat coating solution of formulation (2) was applied by a wire bar to have a wet coated amount of 5.7 ml/$m^2$ and dried at 180° C. for 5 minutes. Furthermore, on the opposite side (back surface), the undercoat coating solution of formulation (3) was applied by a wire bar to have a wet coated amount of 7.7 ml/$m^2$ and dried at 180° C. for 6 minutes, thereby obtaining an undercoated support.

(Preparation of Coating Solution for Back Surface)

(Preparation of Coating Solution for Antihalation Layer)

Gelatin (17 g), 9.6 g of polyacrylamide, 1.5 g of monodisperse polymethyl methacrylate fine particles (average particle size: 8 μm, standard deviation of particle size: 0.4), 0.03 g of benzisothiazolinone, 2.2 g of sodium polyethylenesulfonate, 0.1 g of Blue Dye Compound-1, 0.1 g of Yellow Dye Compound-1 and 844 ml of water were mixed to prepare a coating solution for the antihalation layer.

(Preparation of Coating Solution for Protective Layer on Back Surface)

In a container kept at 40° C., 50 g of gelatin, 0.2 g of sodium polystyrenesulfonate, 2.4 g of N,N-ethylenebis-(vinylsulfonacetamide), 1 g of sodium tert-octylphenoxyethoxyethanesulfonate, 30 mg of benzisothazolinone, 37 mg of a fluorine surfactant (F-1: N-perfluorooctylsulfonyl-N-propylalanine potassium salt), 150 m g of a fluorine surfactant (F-2: polyethylene glycol mono(N-perfluorooctylsulfonyl-N-propyl-2-aminoethyl ether [ethylene oxide average polymerization degree: 15]), 64 mg of a fluorine surfactant (F-3), 32 mg of a fluorine surfactant (F-4), 10 mg of a fluorine surfactant (F-7), 5 mg of a fluorine surfactant (F-4), 8.8 g of an acrylic acid/ethyl acrylate copolymer (copolymerization weight ratio: 5/95), 0.6 g of "Aerosol OT" (trade name; product of American Cyanamide) and 1.8 g as liquid paraffin of liquid paraffin emulsified product and 950 ml of water were mixed to prepare a coating solution for the protective layer on the back surface.

(Preparation of Silver Halide Emulsion)

<Preparation of Silver Halide Emulsion 1>

A solution was obtained by adding 4.3 ml of a 1% by mass potassium bromide solution, 3.5 ml of 0.5 mol/L sulfuric acid and 36.7 g of phthalated gelatin to 1,420 ml of distilled water. While stirring the solution in a stainless steel-made reaction pot and thereby keeping the liquid temperature at 45° C., the entire amount of Solution A obtained by distilling 22.22 g of silver nitrate with distilled water to 195.6 ml and the entire amount of Solution B obtained by diluting 21.8 g of potassium iodide with distilled water to 218 ml were added to the reaction pot at a constant flow rate over 9 minutes. To the resulting mixture were successively added 10 ml of a 3.5% by mass aqueous hydrogen peroxide solution and 10.8 ml of a 10% by mass aqueous solution of benzimidazole.

Thereafter, the entire amount of Solution C prepared by adding distilled water to 51.86 g of silver nitrate to distill it to 317.5 ml and the entire amount of Solution D obtained by adding distilled water to 60 g of potassium iodide to distill it to 600 ml were added. Solution C was added at a constant flow rate over 120 minutes while Solution D was added by the controlled double jet method while maintaining pAg at 8.1. Ten minutes after the initiation of the addition of Solution C and Solution D, the entire amount of potassium hexachloroiridate(III) was added to give a concentration of $1\times10^{-4}$ mol per mol of silver. Five seconds after completion of the addition of Solution C, the entire amount of an aqueous potassium hexacyanoferrate(II) solution was added in an amount of $3\times10^{-4}$ mol per mol of silver. Then, the pH was adjusted to 3.8 with 0.5 mol/L sulfuric acid and after stirring was stopped, the solution was subjected to precipitation/desalting/water washing steps. Furthermore, the pH was adjusted to 5.9 with 1 mol/L sodium hydroxide, whereby a silver halide dispersion adjusted to pAg of 8.0 was prepared.

While stirring the silver halide dispersion obtained above and keeping at 38° C., 5 ml of a 0.34% by mass methanol solution of 1,2-benzisothiazolin-3-one was added. The resulting mixture was heated to 47° C. Twenty minutes after heating, a methanol solution of sodium benzenethiosulfonate was added in an amount of $7.6\times10^{-5}$ per mol of silver After 5 minutes, a methanol solution of Tellurium sensitizer C was added in an amount of $2.9\times10^{-4}$ mol per mol of silver, followed by ripening for 91 minutes.

Then, 1.3 ml of a 0.8% by mass methanol solution of N,N'-dihydroxy-N"-diethylmelamine was added and after 4 minutes, a methanol solution of 5-methyl-2-mercaptobenzimidazole and a methanol solution of 1-phenyl-2-heptyl-5-mercapto-1,3,4-triazole were added in amounts of $4.8\times10^{-3}$ mol and $5.4\times10^{-3}$ mol, respectively, per mol of silver to prepare Silver Halide Emulsion 1.

The grains in the resulting silver halide emulsion were pure silver iodide grains having an average sphere-equivalent diameter of 0.040 μm and a sphere-equivalent coefficient of variation of 18%. The grain size was determined as an average of 1,000 grains using an electron microscope.

<Preparation of Mixed Emulsion A for Coating Solution>

Silver Halide Emulsion 1 was dissolved, followed by the addition thereto of benzothiazolium iodide, as a 1% by mass aqueous solution, in an amount of $7\times10^{-3}$ mol per mol of silver. Furthermore, water was added to make a silver halide content of 38.2 g as silver per kg of the mixed emulsion for the coating solution.

<Preparation of Fatty Acid Silver Salt Dispersion>

Behenic acid ("Edenor C22–85R", trade name; product of Henkel Corp., 87.6 Kg), 423 L of distilled water, 49.2 L of a 5 mol/L aqueous NaOH solution and 120 L of t-butyl alcohol were mixed. The mixture was reacted by stirring at 75° C. for 1 hour to prepare a sodium behenate solution.

Separately, 206.2 L of an aqueous solution (pH 4.0) of 40.4 Kg of silver nitrate was prepared and maintained at 10° C. A reaction vessel containing 635 L of distilled water and 30 L of t-butyl alcohol were maintained at 30° C., and added with the entire amounts of the sodium behenate solution and the aqueous silver nitrate solution at constant flow rates over 93 minutes and 15 seconds, and 90 minutes, respectively.

In this process, only the aqueous silver nitrate solution was added in a first 11-minute period after the initiation of the addition of the aqueous silver nitrate solution, then addition of the sodium behenate solution was started, and only the sodium behenate solution was added for a 14-minute-and-15-second period after completion of the addition of the aqueous silver nitrate solution. During this procedure, the internal temperature of the reaction vessel was kept at 30° C., and the outside temperature was controlled so that the temperature of the mixture should be fixed.

A piping in a feeding system of the sodium behenate solution was kept warm by circulating hot water in an outer portion of the double pipe, whereby the outlet liquid temperature at the end of the feed nozzle was adjusted to 75° C. A piping in a feeding system of the aqueous silver nitrate solution, on the other hand, was kept warm by circulating cold water in an outer portion of the double pipe. Points of addition of the sodium behenate solution and aqueous silver nitrate solution were symmetrically arranged centered around a stirring axis, the heights of which being adjusted so as to avoid contact to the reaction solution.

After completion of the addition of the sodium behenate solution, the mixture was left at that temperature for 20 minutes with stirring. The reaction mixture was then heated to 35° C. over 30 minutes, followed by ripening for 210 minutes. Rightly after completion of the ripening, the solid content was filtered out by centrifugal filtration, and washed with water until the conductivity of the filtrate became 30 μS/cm. In this manner, a fatty acid silver salt was obtained. The solid content obtained as described above was not dried but stored as a wet cake.

The shape of the thus-obtained silver behenate grains was analyzed by electron microphotography. The grains were scaly crystals having the following average size: a=0.14 μm, b=0.4 μm and c=0.6 μm, an average aspect ratio of 5.2, average sphere-equivalent diameter of 0.52 μm and an average sphere-equivalent coefficient of variation of 15% (a, b and c comply with the definition in this specification).

To the wet cake corresponding to 260 Kg of dry solid content, 19.3 Kg of polyvinyl alcohol ("PVA-217", trade name) and water were added to make the total amount of 1000 Kg. The resulting mixture was made into a slurry by a dissolver blade, followed by preliminary dispersion by a pipeline mixer ("Model PM-10", trade name; product of Mizuho Kogyo).

Then, the preliminarily dispersed stock solution was treated three times in a dispersing machine ("Microfluidizer M-610", trade name; product of Microfluidex International Corporation, equpped with Z interaction chamber) under a pressure controlled to 1,260 kg/cm$^2$, whereby a silver behenate dispersion was obtained. During the dispersion, cooling operation was effected using coiled heat exchangers attached to the inlet side and outlet side of the interaction chamber, and the temperature of the coolant was controlled to keep the dispersion temperature at 18° C.

(Preparation of Reducing Agent Dispersion)

<Preparation of Reducing Agent-2 Dispersion>

To 10 kg of Reducing Agent-2 (6,6'-di-t-butyl-4,4'-dimethyl-2,2'-butylidenediphenol) and 16 Kg of a 10% by mass aqueous solution of modified polyvinyl alcohol ("Poval MP203", trade name; product of Kuraray Co., Ltd.), 10 Kg of water was added and thoroughly mixed to form a slurry.

This slurry was sent by a diaphragm pump and dispersed in a horizontal sand mill ("UVM-2", trade name; manufactured by AIMEX K.K.) filled with zirconia beads having an average diameter of 0.5 mm for 3 hours and 30 minutes. Thereafter, 0.2 g of benzisothiazolinone sodium salt and water were added to adjust the reducing agent concentration to 25% by mass, thereby obtaining Reducing Agent-2 Dispersion.

The reducing agent particles contained in the thus-obtained Reducing Agent-2 Dispersion had a median diameter of 0.40 μm and a maximum particle size of 1.5 μm or less. The resulting Reducing Agent-2 Dispersion was filtered through a polypropylene-made filter having a pore size of 3.0 μm to remove foreign matters such as dust and then housed.

<Preparation of Hydrogen Bond Forming Compound-1 Dispersion>

To 10 Kg of Hydrogen Bond Forming Compound-1 (tri(4-t-butylphenyl)phosphine oxide) and 16 Kg of a 10% by mass aqueous solution of modified polyvinyl alcohol ("Poval MP203", trade name; product of Kuraray Co., Ltd.), 10 Kg of water was added and thoroughly mixed to form a slurry.

The resulting slurry was sent by a diaphragm pump and dispersed in a horizontal sand mill ("UVM-2", trade name; manufactured by AIMEX K.K.) filled with zirconia beads having an average diameter of 0.5 mm for 3 hours and 30 minutes. Thereafter, 0.2 g of benzisothiazolinone sodium salt and water were added to adjust the hydrogen bond forming compound concentration to 25% by mass, thereby obtaining Hydrogen Bond Forming Compound-1 Dispersion.

The hydrogen bond forming compound particles contained in the thus-obtained hydrogen bond forming compound dispersion had a median diameter of 0.35 μm and a maximum particle size of 1.5 μm or less. The hydrogen bond forming compound dispersion was filtered through a polypropylene-made filter having a pore size of 3.0 μm to remove foreign matters such as dust and then housed.

<Preparation of Development Accelerator-1 Dispersion>

To 10 Kg of Development Accelerator-1 and 20 Kg of a 10% by mass aqueous solution of modified polyvinyl alcohol ("Poval MP203", trade name; product of Kuraray Co., Ltd.), 10 Kg of water was added. They were thoroughly mixed to form a slurry.

The resulting slurry was sent by a diaphragm pump and dispersed in a horizontal sand mill ("UVM-2", trade name; manufactured by AIMEX K.K.) filled with zirconia beads having an average diameter of 0.5 mm for 3 hours and 30 minutes. Thereafter, 0.2 g of benzisothiazolinone sodium salt and water were added to adjust the development accelerator concentration to 20% by mass, thereby obtaining Development Accelerator-1 Dispersion.

The development accelerator particles contained in the thus-obtained development accelerator dispersion had a median diameter of 0.48 μm and a maximum particle size of 1.4 μm or less. The resulting development accelerator dispersion was filtered through a polypropylene-made filter having a pore size of 3.0 μm to remove foreign matters such as dust and then housed.

In a similar manner to that employed for Development Accelerator-1, Development Accelerator-2, Development Accelerator 3 and Color-tone Adjuster-1 were dispersed and 20% by mass dispersions were obtained, respectively.

(Preparation of Polyhalogen Compounds)

<Preparation of Organic Polyhalogen Compound-1 Dispersion>

To 10 Kg of Organic Polyhalogen Compound-1 (tribromomethanesulfonylbenzene) and 10 Kg of a 20% by mass aqueous solution of modified polyvinyl alcohol ("Poval MP203", trade name; product of Kuraray Co., Ltd.), 0.4 Kg of a 20% by mass aqueous solution of sodium triisopropylnaphthalenesulfonate and 14 Kg of water were added. They were thoroughly mixed to form a slurry.

The resulting slurry was sent by a diaphragm pump and dispersed in a horizontal sand mill ("UVM-2", trade name; manufactured by AIMEX K.K.) filled with zirconia beads having an average diameter of 0.5 mm for 5 hours. Thereafter, 0.2 g of benzisothiazolinone sodium salt and water were added to adjust the organic polyhalogen compound concentration to 26% by mass, thereby obtaining Organic Polyhalogen Compound-1 Dispersion.

The organic polyhalogen compound particles contained in the thus-obtained Organic Polyhalogen Compound-1 Dispersion had a median diameter of 0.41 μm and a maximum particle size of 2.0 μm or less. The Organic Polyhalogen Compound Dispersion was filtered through a polypropylene-made filter having a pore size of 10.0 μm to remove foreign matters such as dust and then housed.

<Preparation of Organic Polyhalogen Compound-2 Dispersion>

To 10 Kg of Organic Polyhalogen Compound-2 (N-butyl-3-tribromomethanesulfonylbenzoamide) and 20 Kg of a 10% by mass aqueous solution of modified polyvinyl alcohol ("Poval MP203", trade name; product of Kuraray Co., Ltd.), 0.4 Kg of a 20% by mass aqueous solution of sodium triisopropylnaphthalenesulfonate was added. They were thoroughly mixed to form a slurry.

The resulting slurry was sent by a diaphragm pump and dispersed in a horizontal sand mill ("UVM-2", trade name; manufactured by AIMEX K.K.) filled with zirconia beads having an average diameter of 0.5 mm for 5 hours. Thereafter, 0.2 g of benzisothiazolinone sodium salt and water were added to adjust the organic polyhalogen compound concentration to 30% by mass. The dispersion was heated at 40° C. for 5 hours, whereby Organic Polyhalogen Compound-2 Dispersion was obtained.

The organic polyhalogen compound particles contained in the thus-obtained organic polyhalogen compound dispersion had a median diameter of 0.40 μm and a maximum particle size of 1.3 μm or less. The resulting organic polyhalogen compound dispersion was filtered through a polypropylene-made filter having a pore size of 3.0 μm to remove foreign matters such as dust and then housed.

<Preparation of Phthalazine Compound-1 Solution>

In 174.57 Kg of water was dissolved 8 Kg of modified polyvinyl alcohol "MP203" (trade name; product of Kuraray Co., Ltd.). To the resulting solution were added 3.15 Kg of a 20% by mass aqueous solution of sodium triisopropylnaphthalenesulfonate and 14.28 Kg of a 70% by mass aqueous solution of Phthalazine Compound-1 (6-isopropylphthalazine) to prepare a 5% by mass solution of Phthalazine Compound-1.

(Preparation of Mercapto Compound)

<Preparation of Aqueous Mercapto Compound-2 Solution>

In 980 g of water was dissolved 20 g of Mercapto Compound-2 (1-(3-methylureido)-5-mercaptotetrazole sodium salt) to prepare a 2.0% by mass aqueous solution.

<Preparation of SBR Latex Solution>

An SBR latex having a Tg of 22° C. was prepared in the below-described manner.

Using ammonium persulfate as a polymerization initiator and an anionic surfactant as an emulsifier, 70.5 mass of styrene, 27.0 mass of butadiene and 3.0 mass of acrylic acid were emulsion-polymerized, followed by aging at 80° C. for 8 hours. The resulting solution was then cooled to 40° C. and adjusted to pH 7.0 with aqueous ammonia.

"SANDET BL" (trade name; product of Sanyo Kasei K.K.) was added to the solution to give a concentration of 0.22%. The resulting mixture was adjusted to pH 8.3 with an aqueous 5% sodium hydroxide solution and then, pH 8.4 with aqueous ammonia.

At this time, $Na^+$ ion and $NH_4$+ion were used at a molar ratio of 1:2.3. To 1 Kg of this solution, 0.15 ml of a 7% aqueous solution of benzoisothiazolinone sodium salt was added to prepare an SBR latex solution.

(SBR Latex: latex of -St(70.0)-Bu(27.0)-AA(3.0)-): Tg: 22° C.

Average particle size: 0.1 μm, concentration: 43% by mass, equilibrium moisture content at 25° C. and 60% RH: 0.6% by mass, ion conductivity: 4.2 mS/cm (the ion conductivity was determined using a conductivity meter "CM-30S" (trade name; manufactured by Toa Denpa Kogyo K.K.) for measuring the latex stock solution (43% by mass) at 25° C.), pH: 8.4.

SBR latices having different Tg were prepared in the same manner by changing a styrene:butadiene ratio as needed.

<Preparation of Coating Solution-1 for Emulsion Layer (Photosensitive Layer)>

The fatty acid silver salt dispersion prepared above (1,000 g), 276 ml of water, 3.2 g of Organic Polyhalogen Compound-1 Dispersion, 8.7 g of Organic Polyhalogen Compound-2 Dispersion, 173 g of Phthalazine Compound-1 Solution, 1,082 g of SBR latex (Tg: 20° C.) solution, 155 g of Reducing Agent-2 Dispersion, 55 g of Hydrogen Bond Forming Compound-1 Dispersion, 1 g of Development Accelerator-1 Dispersion, 2 g of Development Accelerator-2 Dispersion, 3 g of Development Accelerator-3 Dispersion, 2 g of Color-tone Adjuster-1 Dispersion, and 6 ml of Aqueous Mercapto Compound-2 Solution were sequentially added. Immediately before the coating, 117 g of Silver Halide Mixed Emulsion A was added and thoroughly mixed. The resulting coating solution for emulsion layer was sent as it was to a coating die and coated.

As a result of measurement by a Brookfield viscometer manufactured by Tokyo Keiki Kogyo K.K., the coating solution for emulsion layer obtained above was found to have a viscosity of 40 [mPa·s] at 40° C. (No. 1 rotor, 60 rpm).

The viscosities of the coating solution measured at 25° C. using "RFS Field Spectrometer" (trade name; product of Rheometrics Far East K.K.) were found to be 530, 144, 96, 51 and 28 [mPa·s] at shear rates of 0.1, 1, 10, 100 and 1,000 [1/sec], respectively.

The amount of zirconium in the coating solution was 0.25 mg per g of silver.

<Preparation of Pigment-1 Dispersion>

To 250 g of water were added 64 g of C.I. Pigment Blue 60 and 6.4 g of "DEMOL N" (trade name; product of Kao Corporation). The resulting mixture was thoroughly mixed into a slurry. The resulting slurry and 800 g of zirconia beads having an average diameter of 0.5 mm were put together into a vessel and dispersed for 25 hours in a dispersing machine (1/4G sand grinder mill: manufactured by AIMEX K.K.), whereby Pigment-1 Dispersion was prepared.

The pigment particles contained in the resulting pigment dispersion had an average particle size of 0.21 μm.

<Preparation of Coating Solution for Interlayer on Emulsion Surface>

To 1000 g of polyvinyl alcohol "PVA-205" (trade name; product of Kuraray Co., Ltd.), 272 g of Pigment-1 Dispersion and 4200 ml of a 19% by mass solution of methyl methacrylate/styrene/butyl acrylate/hydroxyethyl methacrylate/acrylic acid copolymer (copolymerization weight ratio: 64/9/20/5/2) latex were added 27 ml of a 5% by mass aqueous solution of "Aerosol OT" (trade name; product of American Cyanamide), 135 ml of a 20% by mass aqueous solution of diammonium phthalate and water for making a total amount of 10000 g. The resulting mixture was adjusted to pH 7.5 with NaOH, whereby a coating solution for interlayer was prepared. The solution thus obtained was then transferred to a coating die to give a coverage of 9.1 ml/m$^2$.

The viscosity of the coating solution as measured at 40° C. by a Brookfield viscometer (No. 1 rotor, 60 rpm) was 58 [mPa·s].

<Preparation of Coating Solution for First Protective Layer on Emulsion Surface>

In water was dissolved 64 g of inert gelatin. To the resulting solution were added 80 g of a 27.5% by mass solution of methyl methacrylate/styrene/butyl acrylate/hydroxyethyl methacrylate/acrylic acid copolymer (copolymerization weight ratio: 64/9/20/5/2) latex, 23 ml of a 10% by mass methanol solution of phthalic acid, 23 ml of a 10% by mass aqueous solution of 4-methylphthalic acid, 28 ml of 0.5 mol/L sulfuric acid, 5 ml of a 5% by mass aqueous solution of Aerosol OT (produced by American Cyanamide), 0.5 g of phenoxyethanol, 0.1 g of benzisothiazolinone and water for making a total amount of 750 g to prepare a coating solution. Immediately before the coating, 26 ml of a 4% by mass chrome alum was mixed with the resulting solution in a static mixer. The resulting mixture was transferred to a coating die to give a coverage of 18.6 ml/m$^2$.

The viscosity of the coating solution measured by a Brookfield viscometer at 40° C. (No. 1 rotor, 60 rpm) was 20 [mPa·s].

<Preparation of Coating Solution for the Second Protective Layer on Emulsion Surface>

80 g of inert gelatin was dissolved in water. To the resulting solution were added 102 g of a 27.5% by mass solution of methyl methacrylate/styrene/butyl acrylate/hydroxyethyl methacrylate/acrylic acid copolymer (copolymerization weight ratio: 64/9/20/5/2) latex, 3.2 ml of a 5% by mass solution of fluorine-containing surfactant (F-1: N-perfluorooctylsulfonyl-N-propylalanine potassium salt), 32 ml of a 2% by mass aqueous solution of fluorine-containing surfactant (F-2: polyethylene glycol mono(N-perfluorooctylsulfonyl-N-propyl-2-aminoethyl ether [ethylene oxide average polymerization degree: 15]), 3 ml of a 5% solution of fluorine surfactant F-5, 10 ml of a 2% solution of fluorine surfactant F-6, 23 ml of a 5% by mass aqueous solution of "Aerosol OT" (trade name; product of American Cyanamide), 4 g of polymethyl methacrylate fine particles (average particle size: 0.7 μm), 21 g of polymethyl methacrylate fine particles (average particle size: 4.5 μm), 1.6 g of 4-methylphthalic acid, 4.8 g of phthalic acid, 44 ml of sulfuric acid having a concentration of 0.5 mol/L, 10 ml of benzoisothiazolinone and water for making a total amount of 650 g. Immediately before the coating, 445 ml of an aqueous solution containing 4% by mass of chrome alum and 0.67% by mass of phthalic acid was mixed in a static mixer and the resulting coating solution for surface protective layer was transferred to a coating die to give a coverage of 8.3 ml/m$^2$.

The viscosity of the coating solution as measured at 40° C. by a Brookfield viscometer (No. 1 rotor, 60 rpm) was 19 [mPa·s].

<Preparation of Heat-Developable Photosensitive Material-1>

On the back surface of the undercoated support prepared above, the coating solution for antihalation layer and the coating solution for back surface protective layer were simultaneously coated one after another such that the former solution had absorption of 0.3 at 405 nm and the latter solution had a gelatin coated amount of 1.7 g/m$^2$. Then, the coating was dried to form a back layer.

On the surface opposite to the back surface, an emulsion layer, an interlayer, a first protective layer and a second protective layer were simultaneously coated one after another in the order of mention from the undercoated surface by the slide bead coating method, whereby a heat-developable photosensitive material sample was prepared. At this time, the temperature of each of the emulsion layer and the interlayer was adjusted to 31° C., that of the first protective layer was to 36° C. and that of the second protective layer was to 37° C.

The coated amount (g/m$^2$) of each compound in respective emulsion layers is shown below.

| | |
|---|---|
| Silver behenate | 5.55 |
| Polyhalogen Compound-1 | 0.02 |
| Polyhalogen Compound-2 | 0.06 |
| Phthalazine Compound-1 | 0.19 |
| SBR Latex | 9.67 |
| Reducing Agent-2 | 0.81 |
| Hydrogen Bond Forming Compound-1 | 0.30 |
| Development Accelerator-1 | 0.004 |
| Development Accelerator-2 | 0.010 |
| Development Accelerator-3 | 0.015 |
| Color Tone Adjuster-1 | 0.010 |
| Mercapto Compound-2 | 0.002 |
| Silver Halide (as Ag) | 0.091 |

The coating and drying conditions were as follows.

The coating was performed at a speed of 160 m/min, the distance between the tip of coating die and the support was set at 0.10 to 0.30 mm and the pressure in the vacuum chamber was set lower by 196 to 882 Pa than the atmospheric pressure. The support was destaticized by ionized wind before the coating.

In the subsequent chilling zone, the coating solution was cooled by the air flow showing a dry bulb temperature of 10 to 20° C. The sample was then subjected to contact-free transportation and in a helical floating type dryer, was dried with drying air showing a dry bulb temperature of 23 to 45° C. and a wet bulb temperature of 15 to 21° C.

After drying, the humidity was adjusted to 40 to 60% RH at 25° C. and then, the layer surface was heated to 70 to 90° C. The heated layer surface was then cooled to 25° C.

The heat-developable photosensitive material thus prepared had a matting degree of, in terms of the Beck's smoothness, 550 seconds on the photosensitive layer surface and 130 seconds on the back surface. Furthermore, the pH on the layer surface on the photosensitive layer side was measured and found to be 6.0.

Chemical structures of the compounds used in Examples of the present invention are shown below.

Tellurium Sensitizer C

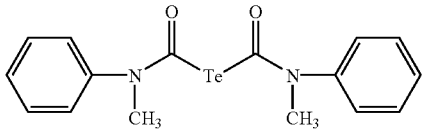

Blue Dye Compound-1

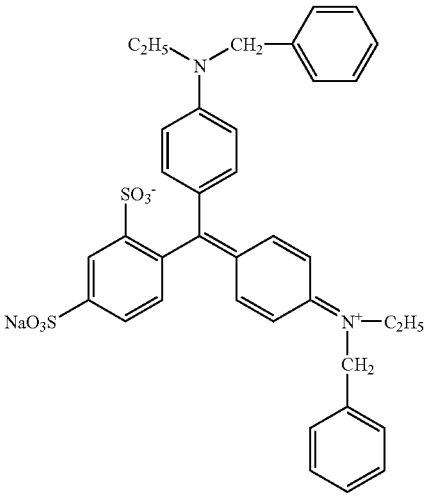

Yellow Dye Compound-1

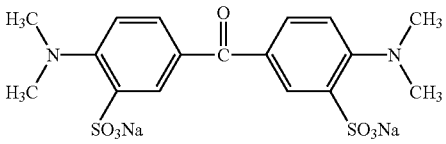

Reducing Agent-2

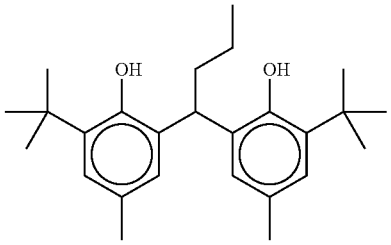

Hydrogen Bond Forming Compound-1

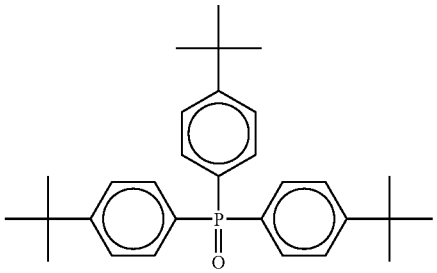

Polyhalogen Compound-1

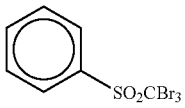

-continued

Polyhalogen Compound-2

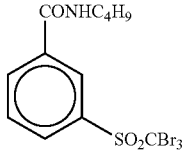

Mercapto Compound-1

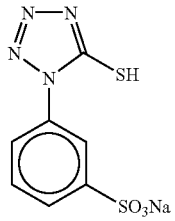

Mercapto Compound-2

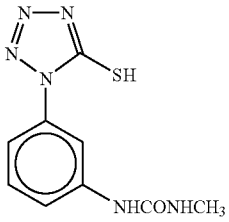

Phthalazine Compound-1

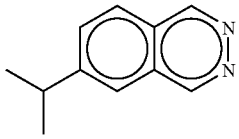

Development Accelerator-1

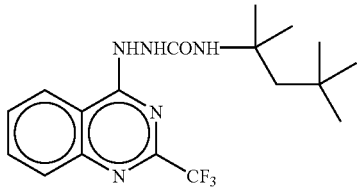

Development Accelerator-2

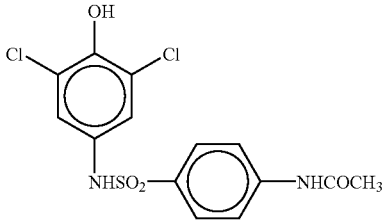

Development Accelerator-3

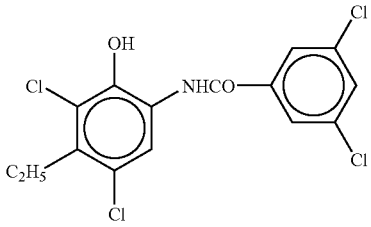

-continued

Color Tone Adjuster-1

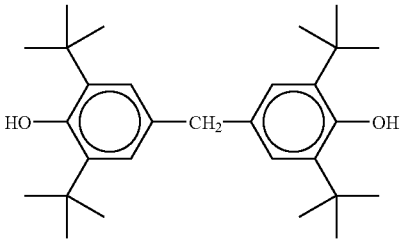

(F-1) $C_8F_{17}SO_2-N(C_3H_7(n))-CH_2COOK$ (F-2) $C_8F_{17}SO_2-N(C_3H_7(n))-CH_2CH_2O-(CH_2CH_2O)_n-H$ n = 15 (mean)

(F-3) $C_8F_{17}SO_2-N(C_3H_7(n))-(CH_2CH_2O)_4-CH_2CH_2CH_2CH_2SO_3Na$ (F-4) $C_8F_{17}SO_3K$ (F-5) $CF_3(CF_2)nCH_2CH_2SCH_2CH_2COOLi$ mixture of n = 5 to 11

(F-6) $CF_3(CF_2)nCH_2CH_2O(CH_2CH_2O)mH$ mixture of n = 5 to 11, m = 5 to 15

(F-7) $CF_3(CF_2)n\ CH_2CH_2SO_3Na$ mixture of n = 5 to 11

(F-8) $C_6F_{13}CH_2CH_2SO_3Li$ (Preparation for Evaluation of Photographic Performance)

The sample thus obtained was cut into 356×432 mm and was wrapped with the below-described packaging material at 25° C. and 50% RH. For two weeks, it was stored at room temperature.

(Packaging Material)

Polyethylene (50 μm) containing 10 μm of PET/12 μm of PE/9 μm of aluminum foil/15 μm of Ny/3% of carbon Oxygen permeability: 0 ml/atm·$m^2$·25° C.·day, water permeability: 0 g/atm·$m^2$·25° C.·day Example 2

In a similar manner to Example 1 except for the use of Silver Halide Emulsions 2, 3 and 6 which had been prepared by using a potassium bromide in place of a part of the potassium iodide and adjusting the amount to change the halogen composition and had a uniform halogen composition as described in Table 1, Photosensitive Materials 2, 3 and 6 were obtained.

The particle size of silver halide was adjusted to 0.040 μm in terms of average sphere-equivalent diameter by changing the temperature upon particle formation.

Example 3

<Preparation of Silver Halide Emulsion 4>

To 1421 ml of distilled water was added 3.1 ml of a 1% by mass of potassium bromide solution, followed by the addition of 3.5 ml of 0.5 mol/L sulfuric acid and 31.7 g of phthalated gelatin. While the resulting mixture was stirred in a stainless steel-made reaction pot, the liquid temperature was kept at 32° C. The entire amount of Solution A prepared by diluting 22.22 g of silver nitrate with distilled water to 95.4 ml and the entire amount of Solution B prepared by diluting 15.6 g of potassium iodide with distilled water to 97.4 ml were added to the reaction pot at a constant flow rate over 45 seconds.

Subsequently, 10 ml of a 3.5% by mass aqueous hydrogen peroxide solution was added and further, 10.8 ml of a 10% by mass aqueous solution of benzimidazole was added. Thereafter, the entire amount of Solution C prepared by diluting 30.64 g of silver nitrate with distilled water to 187.6 ml was added at a constant flow rate over 120 minutes, and the entire amount of Solution D prepared by diluting 21.5 g of potassium bromide with distilled water to 400 ml was added by the controlled double jet method while maintaining the pAg at 8.1.

Solution E prepared by adding 130 ml of distilled water to 22.2 g of silver nitrate and Solution F obtained by diluting 21.7 g of potassium iodide to 217 ml were added by the controlled double jet method while maintaining the pAg at 6.3. Ten minutes after the initiation of the addition of Solution C and Solution D, potassium hexachloroiridate(III) was added in an amount of $1\times10^{-4}$ mol per mol of silver. Also, 5 seconds after completion of the addition of Solution C, an aqueous potassium hexacyanoferrate(II) solution was added in an amount of $3\times10^{-4}$ mol per mol of silver.

The pH was then adjusted to 3.8 with 0.5 mol/L sulfuric acid and after stirring was stopped, the solution was subjected to precipitation/desalting/water washing steps. Furthermore, the pH was adjusted to 5.9 with 1 mol/L sodium hydroxide, whereby a silver halide dispersion showing a pAg of 8.0 was prepared.

While stirring the silver halide dispersion and thereby keeping at 38° C., 5 ml of a 0.34% by mass methanol solution of 1,2-benzisothiazolin-3-one was added. One minute later, the resulting mixture was heated to 47° C. Twenty minutes after heating, a methanol solution of sodium benzenethiosulfonate was added in an amount of $7.6\times10^{-5}$ per mole of silver. After 5 minutes, a methanol solution of Tellurium sensitizer B was added in an amount of $2.9\times10^{-4}$ mol per mol of silver, followed by ripening for 91 minutes.

Then, 1.3 ml of a 0.8% by mass methanol solution of N,N'-dihydroxy-N"-diethylmelamine was added and after 4 minutes, a methanol solution of 5-methyl-2-mercaptobenzimidazole and a methanol solution of 1-phenyl-2-heptyl-5-mercapto-1,3,4-triazole were added in an amount of $4.8\times10^{-3}$ mol and $5.4\times10^{-3}$ mol, respectively, per mol of silver to prepare Silver Halide Emulsion-4.

In the grains in the silver halide emulsion thus prepared, 30 mol % of a silver iodide layer was combined with 70 mol % of a silver bromide layer having an average sphere-equivalent diameter of 0.040 μm and a sphere-equivalent coefficient of variation of 20%.

A portion of the silver halide emulsion having a silver iodide crystal structure was found to have optical absorption due to direct transition.

Under similar conditions to Example 1, a heat-developable photosensitive material 4 was prepared using Silver Halide Emulsion 4.

<Preparation of Silver Halide Emulsion 5>

To 1421 ml of distilled water was added 3.1 ml of a 1% by mass of potassium bromide solution, followed by the addition of 3.5 ml of 0.5 mol/L sulfuric acid and 31.7 g of phthalated gelatin. While the resulting mixture was stirred in a stainless steel-made reaction pot, the liquid temperature was kept at 32° C. The entire amount of Solution A obtained by diluting 22.22 g of silver nitrate with distilled water to 95.4 ml and the entire amount of Solution B obtained by diluting 15.7 g of potassium bromide with distilled water to 97.4 ml were added to the reaction pot at a constant flow rate over 45 seconds. The reaction mixture was then added with 10 ml of a 3.5% by mass of an aqueous hydrogen peroxide solution and then 10.8 ml of a 10% by mass of aqueous benzimidazole solution.

The entire amount of Solution C obtained by diluting 51.86 g of silver nitrate with distilled water to 317.5 ml was added over 120 minutes at a fixed flow rate, while Solution D obtained by diluting 60 g of potassium iodide with distilled water to 600 ml was added by the controlled double jet method while keeping the pAg at 6.3.

Ten minutes after the initiation of addition of Solution C and Solution D, potassium hexachloroiridate(III) was added in an amount of $1\times10^{-4}$ mol per mol of silver. Also, 5 seconds after the completion of addition of Solution C, an aqueous potassium hexacyanoferrate(II) solution was added in an amount of $3\times10^{-4}$ mol per mol of silver.

The pH was then adjusted to 3.8 with 0.5 mol/L sulfuric acid. After stirring was stopped, the solution was subjected to precipitation/desalting/water washing steps. The pH was then adjusted to 5.9 with 1 mol/L sodium hydroxide, whereby a silver halide dispersion having pAg of 8.0 was prepared.

Under similar conditions to Example 3 concerning the other conditions, Silver Halide Emulsion 5 was prepared.

In the grains of the silver halide emulsion thus prepared, 70 mol % of a silver iodide layer were combined with 30 mol % of a silver bromide layer having an average sphere-equivalent diameter of 0.040 μm and a sphere-equivalent coefficient of variation of 10%. A portion of the silver halide emulsion having a silver iodide crystal structure was found to have optical absorption due to strong direct transition.

Example 4

The photosensitive materials obtained in Examples 1 to 3 were evaluated in the below-described manner.

(Exposure of Photosensitive Materials)

The photosensitive materials obtained in Examples 1 to 3 were exposed as described below.

At the exposure section of "Fuji Medical Dry Laser Imager FM-DPL", a semiconductor laser "NLHV3000E" (trade name; product of Nichia Corporation) was mounted as a semiconductor laser light source and the beam diameter was narrowed to about 100 μm.

Each photosensitive material was exposed to laser light for $10^{-6}$ seconds while setting or changing the illuminance of the laser light on the surface of the photosensitive material at 0 and from 1 mW/mm$^2$ to 1000 mW/mm$^2$. The light emitting wavelength of the laser light was 405 nm.

(Development of Photosensitive Materials)

Each photosensitive material thus exposed was heat-developed as follows.

Four sheets of a panel heater were set at 112° C.-115° C.-115° C.-115° C. at the heat development section of Fuji Medical Dry Laser Imager "FM-DPL" and heat development was conducted so that the total heat development time would be 14 seconds by accelerating the film feeding speed.

(Evaluation of Samples)

The density of the image thus obtained was measured by a densitometer and a characteristic curve of density relative to logarithm of exposure amount was drawn. Supposing that the optical density at the unexposed portion is fog, the reciprocal number of the exposure amount providing an optical density of 3.0 is sensitivity and sensitivity of Photosensitive Material 1 is 100, the sensitivity is expressed by a relative value. In addition, an average of the contrast between the optical densities of 1.5 and 3 is measured.

(Evaluation of Sharpness)

In a similar manner to that employed for exposure of a photosensitive material except that a rectangular wave pattern were exposed, heat development was effected. The sharpness was defined as the shade difference of the rectangular wave pattern of one spatial frequency/mm standardized by the shade difference of 0.01 spatial frequency/mm. The sharpness thus obtained was evaluated relative to the sharpness of Photosensitive material 1 designated as 100.

The results are shown in Table 1.

(Evaluation of Printout Property)

The photosensitive material after development was placed in a room of 25° C. of 60% RH and allowed to stand for 30 days under a fluorescent light of 100 lux. A difference between the fog density just after development and the fog density after leaving the material for 30 days under the above-described conditions was designated as printout property. The less increase in fog even the material was left to stand under such conditions, the better.

The results are shown in Table 1.

TABLE 1

| Test No. | Photo-sensitive material | Wavelength (nm) of laser used for exposure | Iodine content | Br content | Grain size of silver halide | Direct transition absorption resulting from silver iodide crystal structure | Sensitivity | Fog | Average contrast | Sharpness | Printout property | Remarks |
|---|---|---|---|---|---|---|---|---|---|---|---|---|
| 1 | 1 | 405 nm | 100 | 0 | 40 nm | Exist | 100 | 0.18 | 3.5 | 100 | 0.00 | Invention product |
| 2 | 2 | " | 3.5 | 96.5 | " | Not exist | 30 | 0.32 | 2.8 | 90 | 0.10 | Comparative Example |
| 3 | 3 | " | 30 | 70 | " | Not exist | 45 | 0.2 | 3 | 92 | 0.06 | Invention product |
| 4 | 4 | " | 30 | 70 | " | Exist | 70 | 0.2 | 3.2 | 97 | 0.03 | Invention product |
| 5 | 5 | " | 70 | 30 | " | Exist | 85 | 0.18 | 3.2 | 98 | 0.02 | Invention product |
| 6 | 6 | " | 95 | 5 | " | Exist | 105 | 0.18 | 3.5 | 100 | 0.01 | Invention product |

As is apparent from Table 1, it has been found that the photosensitive materials of the present invention feature high sensitivity, low fog and excellent printout property. Surprisingly, they have high sharpness in addition, presumably because absorption of silver halide shows a drastic attenuation at a wavelength of 440 nm or greater and defocusing due to fluorescence is lowered.

Example 5

The photosensitive materials of the present invention exhibit particularly high sensitivity and preferable characteristics when exposed at high illuminance for short time.

In a similar manner to Example 4 except that the photosensitive material was exposed to a tungsten light of 1 KW into which an interference filter of 405 nm was inserted. Since the illuminance was as weak as 0.001 mW/m$^2$ to 0.1 mW/m$^2$ by step wedge compared with the exposure in Example 4, exposure time was adjusted to give a necessary optical density. The sensitivity was indicated as a relative value to that of Photosensitive Material 2 set at 100.

The results are shown in Table 2.

TABLE 2

| Test No. | Photosensitive material | Exposure wavelength (nm) | Iodine content | Br content | Grain size of silver halide | Direct transition absorption resulting from silver iodide crystal structure | Sensitivity | Fog | Average contrast |
|---|---|---|---|---|---|---|---|---|---|
| 7 | 1 | 405 nm | 100 | 0 | 40 nm | Exist | 15 | 0.18 | 2.2 |
| 8 | 2 | " | 3.5 | 96.5 | " | Not exist | 100 | 0.32 | 3.2 |
| 9 | 3 | " | 30 | 70 | " | Not exist | 35 | 0.2 | 2.8 |
| 10 | 4 | " | 30 | 70 | " | Exist | 30 | 0.2 | 3.2 |
| 11 | 5 | " | 70 | 30 | " | Exist | 20 | 0.18 | 2.5 |
| 12 | 6 | " | 95 | 5 | " | Exist | 20 | 0.18 | 2.5 |

As is apparent from comparison in Tables 1 and 2, it has been found that the photosensitive materials of the present invention exhibit desirable characteristics compared with the conventional Photosensitive material 2 when exposed to a light of high illuminance.

Example 6

In a similar manner to that employed for Photosensitive material 1 except that the temperature upon grain formation was changed, a pure silver iodide emulsion 7 having a grain size of 100 nm was prepared. In a similar manner to that employed for Photosensitive material 1 except that the coated amount of Emulsion 7 was changed, Photosensitive materials 7, 8 and 9 as shown in Table 3 were prepared.

As in Example 4, photographic performance was evaluated. Here, the maximum optical density of the sample after heat development is designated as Dmax. The results are shown in Table 3.

TABLE 3

| Test No. | Photo-sensitive material | Exposure condition | Iodine content | Br content | Grain size of silver halide | Coated amount of silver halide (in terms of Ag) | Direct transition absorption resulting from silver iodide crystal structure | Fog | Sensitivity | Dmax |
|---|---|---|---|---|---|---|---|---|---|---|
| 13 | 1 | Exposure to laser 405 nm | 100 | 0 | 40 nm | 0.091 mg/m$^2$ | Exist | 0.18 | 100 | 4.2 |
| 14 | 7 | Exposure to laser 405 nm | 100 | 0 | 100 nm | " | Exist | 0.18 | Lack of density prevented evaluation | 2 |
| 15 | " | Exposure to laser 405 nm | 100 | 0 | " | 0.18 mg/m$^2$ | Exist | 0.18 | 120 | 3.2 |
| 16 | " | Exposure to laser 405 nm | 100 | 0 | " | 0.36 mg/m$^2$ | Exist | 0.17 | 75 | 3.6 |

As is apparent from Table 3, it has been found that the silver iodide emulsion of the present invention cannot exhibit sufficient sensitivity when its grain size is as large as 100 nm. Absorption of a silver halide is usually proportionate to the cubic of an average grain size so that in principle, the greater the silver halide, the higher its sensitivity. This however does not always apply to the silver-iodide-rich emulsion of the present invention.

A decrease in the average grain size is preferred, because it increases the sensitivity in spite of a small grain size and at the same time, it heightens Dmax.

Example 7

In a similar manner to Example 1 except that the temperature upon grain formation was increased, a pure Silver Iodide Emulsion 8 having an average grain size of 70 nm and a variation coefficient of 8% was formed. Similarly, by changing the temperature, Silver Halide Emulsion 9 having an average particle size of 28 nm and a variation coefficient of 12% was prepared.

In a similar manner to that employed for Photosensitive material 1 except that Silver Halide Emulsion 1 was replaced with a 60:15:25 mixture of Silver Halide Emulsions 1, 8 and 9, Photosensitive material 8 was prepared.

The photosensitive materials thus obtained were evaluated as in Example 4, leading to a favorable result. The photosensitive materials were found to have an average contrast of 2.7

In a similar manner, Photosensitive Material 9 was prepared by mixing Silver Halide Emulsion 5 and Silver Halide Emulsion 8 at a ratio of 85:15. It was evaluated as in Example 4, leading to a favorable result.

As described above, silver halide emulsions of the present invention can be mixed at any ratio.

Example 8

In a similar manner to Example 4 except that the four sheets of the panel heater were all set at 112° C., Photosensitive materials 1, 4, 5, 6, 8 and 9 were evaluated.

As in Example 4, they showed favorable results.

Example 9

In a similar manner to that employed for Photosensitive materials 1, 3 to 6 in Example 1 and that employed for Photosensitive materials 8 and 9 in Example 6 except for the omission of Dye BB kneaded in PET, Photosensitive materials 10 to 16 were prepared. They were evaluated as in Example 4, leading to favorable results.

Example 10

In a similar manner to Example 4 except for the use of a laser light having a light emitting wavelength of 395 nm, evaluation was conducted. Evaluation of the photosensitive material of the present invention was as favorable as that in Example 4.

Example 11

The pAG on the layer surface of Photosensitive Material 1 obtained in Example 1 was measured in the following manner.

After 300 μl of distilled water was dropped on 1 $cm^2$ of the emulsion surface of the photosensitive material to break the layer surface and the material was allowed to stand for 30 minutes, the potential was measured using pAg electrode. From the potential thus obtained, pAg was calculated. The pAg on the layer surface was 4.3. Such a low pAg is important for exhibition of the effect of the heat-developable photosensitive material using a silver-iodide-rich emulsion of the present invention.

The present invention makes it possible to provide a heat-developable photosensitive material which exhibits high sensitivity and high image quality even if it is a iodide-rich silver halide photosensitive material; and an image forming method using it.

Example 12

(Preparation of PET Support)

PET having an intrinsic viscosity IV of 0.66 (measured in phenol/tetrachloroethane=6/4 (by weight) at 25° C.) was obtained in a conventional manner by using terephthalic acid and ethylene glycol. The PET was then pelletized, dried at 130° C. for 4 hours, melted at 300° C., extruded from a T-die and quenched to prepare an unstretched film having a thickness enough to give a thickness of 175 μm after heat fixation.

This film was stretched along the machine direction by 3.3 times using rolls different in the peripheral speed and then stretched along the cross direction by 4.5 times using a tenter. At this time, the temperatures were set at 110° C. and 130° C., respectively. After thermal fixation of the film at 240° C. for 20 seconds, it was relaxed along the cross direction by 4% at the same temperature. Then, the chuck of the tenter was released, the both edges of the film were knurled, and the film was rolled up at 4 $kg/cm^2$. Thus, a roll of a film having a thickness of 175 um was obtained.

(Surface Corona Treatment)

Both surfaces of the support were treated at room temperature at 20 m/min using a solid state corona treating machine "Model 6KVA" (trade name; product of Pillar Technologies). The current and voltage indicated by the machine revealed that the support underwent the treatment of 0.375 $kV \cdot A \cdot min/m^2$ at that time. The treatment frequency here was 9.6 kHz and the gap clearance between the electrode and the dielectric roll was 1.6 mm.

(Preparation of Support with Undercoat Layer)

(1) Preparation of Coating Solution for Undercoat Layer

| | |
|---|---|
| Formulation (1) (for undercoat layer on the photosensitive layer side): | |
| "PESRESIN A-515GB" (trade name; 30% by mass solution) product of Takamatsu Yushi K. K. | 59 g |
| Polyethylene glycol mononononylphenyl ether (average ethylene oxide number: 8.5), 10% by mass solution | 5.4 g |
| "MP-1000" (fine polymer particles, average particle size: 0.4 μm) produced by Soken Kagaku K. K. | 0.91 g |
| Distilled water | 935 ml |
| Formulation (2) (for first layer on the back surface): | |
| Styrene/butadiene copolymer latex (solid content: 40% by mass, a styrene/butadiene weight ratio: 68:32) | 158 g |

-continued

| | |
|---|---|
| 2,4-Dichloro-6-hydroxy-S-triazine sodium salt, 8% by mass aqueous solution | 20 g |
| 1% By mass aqueous solution of sodium lauryl benzene sulfonate | 10 ml |
| Distilled water | 854 ml |
| Formulation (3) (for second layer on the back surface): | |
| $SnO_2$/SbO (9/1 by mass, average particle size: 0.038 μm, 17% by mass dispersion) | 84 g |
| Gelatin (10% by mass aqueous solution) | 89.2 g |
| "METROSE TC-5" (trade name; 2% by mass aqueous solution) product of Shin-Etsu Chemical Co., Ltd. | 8.6 g |
| "MP-1000" (trade name) product of Soken Kagaku K. K. | 0.01 g |
| 1% By mass aqueous solution of sodium dodecyl benzene sulfonate | 10 ml |
| NaOH (1% by mass) | 6 ml |
| "PROXEL" (trade name; product of ICI) | 1 ml |
| Distilled water | 805 ml |

(Preparation of Support with Undercoat Layer)

Both surfaces of the 175 μm-thick biaxially stretched polyethylene terephthalate support obtained above were subjected to the above-described corona discharge treatment and on one surface (on the side of the photosensitive layer), the coating solution of formulation (1) for undercoat layer was applied by a wire bar to give a wet coated amount of 6.6 ml/m$^2$ (per one side) and dried at 180° C. for 5 minutes. Thereafter, on the opposite side (back surface), the coating solution of formulation (2) for undercoat layer was applied by a wire bar to give a wet coated amount of 5.7 ml/m$^2$ and dried at 180° C. for 5 minutes. Furthermore, on the opposite side (back surface), the coating solution of formulation (3) for undercoat layer was applied by a wire bar to give a wet coated amount of 7.7 ml/m$^2$ and dried at 180° C. for 6 minutes, thereby obtaining an undercoated support.

(Preparation of Coating Solution for Back Surface)

(Preparation of Solid Fine-Grain Dispersion (a) of Base Precursor)

Base Precursor Compound 11 (64 g), 28 g of diphenylsulfone and 10 g of surfactant "Demol N" (trade name; product of Kao Corporation) were mixed with 220 ml of distilled water. The resulting mixture was dispersed using beads in a sand mill (1/4 Gallon Sand Grinder Mill, product of AIMEX K.K.) to obtain Solid Fine-Grain Dispersion (a) of Base Precursor Compound, having an average particle size of 0.2 μm.

(Preparation of Solid Fine-Grain Dispersion of Dye)

Cyanine Dye Compound 13 (9.6 g) and 5.8 g of sodium p-dodecylbenzenesulfonate were mixed with 305 ml of distilled water and the mixed solution was dispersed using beads in a sand mill (1/4 gallon sand grinder mill, product of AIMEX K.K.) to obtain a solid fine-grain dispersion of the dye having an average particle size of 0.2 μm.

(Preparation of Coating Solution for Antihalation Layer)

Gelatin (17 g), 9.6 g of polyacrylamide, 70 g of Solid Fine Particle Dispersion (a) of Base Precursor obtained above, 56 g of the solid fine-grain dispersion of the dye obtained above, 1.5 g of monodisperse polymethyl methacrylate fine grains (average grain size: 8 μm, standard deviation of particle size: 0.4), 0.03 g of benzisothiazolinone, 2.2 g of sodium polyethylenesulfonate, 0.2 g of Blue Dye Compound 14, 3.9 g of Yellow Dye Compound 15 and 844 ml of water were mixed to prepare a coating Solution for antihalation layer.

(Preparation of Coating Solution for Protective Layer on Back Surface)

In a container kept at 40° C., 50 g of gelatin, 0.2 g of sodium polystyrene sulfonate, 2.4 g of N,N-ethylenebis (vinylsulfonacetamide), 1 g of sodium tert-octylphenoxyethoxyethanesulfonate, 30 mg of benzisothazolinone, 37 mg of a fluorine surfactant (F-1: N-perfluorooctylsulfonyl-N-propylalanine potassium salt), 0.15 g of a fluorine surfactant (F-2: polyethylene glycol mono(N-perfluorooctylsulfonyl-N-propyl-2-aminoethyl) ether [ethylene oxide average polymerization degree: 15]), 64 mg of fluorine surfactant (F-3), 32 mg of a fluorine surfactant (F-4), 8.8 g of an acrylic acid/ethyl acrylate copolymer (copolymerization weight ratio: 5/95), 0.6 g of "Aerosol OT" (trade name; product of American Cyanamide) and, as liquid paraffin, 1.8 of liquid paraffin emulsion and 950 ml of water were mixed to prepare a coating solution for the protective layer on the back surface.

(Preparation of Silver Halide Emulsion)

<Preparation of Silver Halide Emulsion 1>

While stirring the solution, which had been prepared by adding 4.3 ml of a 1% by mass potassium iodide solution, 3.5 ml of 0.5 mol/L sulfuric acid and 36.7 g of phthalated gelatin to 1,420 ml of distilled water, in a stainless steel-made reaction pot, the liquid temperature was kept at 42° C. To the reaction mixture, the entire amount of Solution A prepared by adding distilled water to 22.22 g of silver nitrate to dilute it to 195.6 ml and the entire amount of Solution B prepared by adding distilled water to 21.8 g of potassium iodide to 218 ml were added at a constant flow rate over 9 minutes. To the resulting mixture were added 10 ml of a 3.5% by mass aqueous hydrogen peroxide solution and then, 10.8 ml of a 10% by mass aqueous solution of benzimidazole.

Thereafter, the entire amount of Solution C prepared by adding distilled water to 51.86 g of silver nitrate to distill it to 317.5 ml and the entire amount of Solution D obtained by adding distilled water to 60 g of potassium iodide to distill it to 600 ml were added. Solution C was added at a constant flow rate over 120 minutes, while Solution D was added by the controlled double jet method, while maintaining pAg at 8.1. Ten minutes after the initiation of the addition of Solution C and Solution D, the entire amount of potassium hexachloroiridate(III) was added to give a concentration of $1\times10^{-4}$ mol per mol of silver.

Five seconds after completion of the addition of Solution C, the entire amount of an aqueous potassium hexacyanoferrate(II) solution was added in an amount of $3\times10^{-4}$ mol per mol of silver. Then, the pH was adjusted to 3.8 with 0.5 mol/L sulfuric acid and after stirring was stopped, the solution was subjected to precipitation/desalting/water washing steps. Furthermore, the pH was adjusted to 5.9 with 1 mol/L sodium hydroxide, whereby a silver halide dispersion adjusted to pAg of 8.0 was prepared.

While stirring the silver halide dispersion obtained above and keeping it at 38° C., 5 ml of a 0.34% by mass methanol solution of 1,2-benzisothiazolin-3-one was added and after 40 minutes, a methanol solution containing Spectral Sensitizing Dye A and Spectral Sensitizing Dye B at a molar ratio of 1:1 was added in a total amount of $1.2\times10^{-3}$ mol per mol of silver. After 1 minute, the mixture was heated to 47° C.

Twenty minutes after heating, a methanol solution of sodium benzenethiosulfonate was added in an amount of $7.6\times10^{-5}$ mol per mol of silver. After 5 minutes, a methanol solution of Tellurium Sensitizer B was added in an amount of $2.9\times10^{-4}$ mol per mol of silver and then, the solution was ripened for 91 minutes.

Furthermore, 1.3 ml of a 0.8% by mass methanol solution of N,N'-dihydroxy-N"-diethylmelamine was added and after 4 minutes, a methanol solution of 5-methyl-2-mercaptobenzimidazole and a methanol solution of 1-phenyl-2-heptyl-5-mercapto-1,3,4-triazole were added in an amount of $4.8\times10^{-3}$ mol and $5.4\times10^{-3}$ mol, respectively, per mol of silver to prepare Silver Halide Emulsion 1.

The grains in the silver halide emulsion thus prepared were pure silver iodide grains having an average sphere-equivalent diameter of 0.040 μm and an average sphere-equivalent coefficient of variation of 78%. The grain size and the like were determined as an average of 1,000 grains using an electron microscope.

<Preparation of Mixed Emulsion A for Coating Solution>

Silver halide emulsion 1 was dissolved, followed by the addition of a 1% by mass aqueous solution of benzothiazolium iodide in an amount of $7\times10^{-3}$ mol per mol of silver. Furthermore, water was added so as to adjust a silver halide content to 38.2 g in terms of silver per kg of the mixed emulsion for the coating solution.

<Preparation of Fatty Acid Silver Salt Dispersion>

Behenic acid (87.6 g, "Edenor C22–85R", trade name, product of Henkel Co.), 423 L of distilled water, 49.2 L of a 5 mol/L aqueous solution of NaOH, and 120 L of tert-butanol were mixed. The mixture was reacted by stirring at 75° C. for one hour, whereby a solution of sodium behenate was obtained. Separately, 206.2 L of an aqueous solution containing 40.4 kg of silver nitrate (pH 4.0) was prepared and kept at 10° C. A reaction vessel containing 635 L of distilled water and 30 L of tert-butanol was kept at 30° C. To it, the entire amount of the above-described sodium behenate solution and the entire amount of the aqueous silver nitrate solution were added at constant flow rates over the periods of 93 minutes and 15 seconds, and 90 minutes, respectively.

In this process, only the aqueous silver nitrate solution was added in a first 11-minute period after the initiation of the addition of the aqueous silver nitrate solution, then addition of the sodium behenate solution was started, and only the sodium behenate solution was added for a 14-minute-and-15-second period after completion of the addition of the aqueous silver nitrate solution.

During this procedure, the internal temperature of the reaction vessel was kept at 30° C., and the outside temperature was controlled so that the temperature of the mixture should be fixed. A piping in a feeding system of the sodium behenate solution was kept warm by circulating hot water in an outer portion of the double pipe, whereby the outlet liquid temperature at the end of the feed nozzle was adjusted to 75° C. A piping in a feeding system of the aqueous silver nitrate solution was kept warm by circulating cold water in an outer portion of the double pipe. Points of addition of the sodium behenate solution and aqueous silver nitrate solution were symmetrically arranged centered around a stirring axis, the heights of which being adjusted so as to avoid contact to the reaction solution.

After completion of the addition of the sodium behenate solution, the mixture was left at that temperature for 20 minutes with stirring. The reaction mixture was then heated to 35° C. over 30 minutes, followed by ripening for 210 minutes. Rightly after completion of the ripening, the solid content was filtered out by centrifugal filtration, and washed with water until the conductivity of the filtrate became 30 μS/cm. In this manner, a fatty acid silver salt was obtained. The solid content obtained as described above was not dried and stored as a wet cake.

The shape of the thus-obtained silver behenate grains was analyzed by electron microphotography. The grains were scaly crystals having the following average size: a=0.14 μm, b=0.4 μm and c=0.6 μm, an average aspect ratio of 5.2, average sphere-equivalent diameter of 0.52 μm and an average sphere-equivalent coefficient of variation of 15% (a, b and c comply with the definition in this specification).

To the wet cake corresponding to 260 Kg of the dry solid content was added 19.3 Kg of polyvinyl alcohol ("PVA-217", trade name) and water to make the total amount of 1000 Kg. The resulting mixture was made into a slurry by a dissolver blade, followed by preliminary dispersion by a pipeline mixer ("Model PM-10", trade name; product of Mizuho Kogyo).

Then, the preliminarily dispersed solution was dispersed three times in a dispersing machine ("Microfluidizer M-610", trade name; product of Microfluidex International Corporation, equipped with a Z interaction chamber) under a pressure controlled to 1,260 kg/cm$^2$ to obtain a silver behenate dispersion. During the dispersion, cooling operation was effected using coiled heat exchangers attached to the inlet side and outlet side of the interaction chamber, and the temperature of the coolant was controlled to keep the dispersion temperature at 18° C.

(Preparation of Reducing Agent Dispersion)

<Preparation of Reducing Agent Complex-3 Dispersion>

To 10 Kg of a reducing agent complex-3 (a 1:1 complex of 2,2'-methylenebis-(4-ethyl-6-tert-butylphenol) and triphenylphosphine oxide), 0.12 Kg of triphenylphosphine oxide and 16 Kg of a 10% by mass aqueous solution of modified polyvinyl alcohol ("Poval MP203", product of Kuraray Co., Ltd.), 7.2 Kg of water was added. The resulting mixture was mixed thoroughly into a slurry. The resulting slurry was sent by a diaphragm pump and dispersed in a horizontal sand mill ("UVM-2", trade name; product of AIMEX K.K.) filled with zirconia beads having an average diameter of 0.5 mm for 4 hours and 30 minutes. Thereafter, 0.2 g of benzisothiazolinone sodium salt and water were added to adjust the concentration of the reducing agent to 25% by mass, thereby obtaining Reducing Agent Complex-3 Dispersion.

The reducing agent complex grains contained in the thus-obtained Reducing Agent Complex-3 Dispersion had a median diameter of 0.46 μm and a maximum grain size of 1.6 μm or less. The reducing agent complex dispersion was filtered through a polypropylene-made filter having a pore size of 3.0 μm to remove foreign matters such as dust and then housed.

(Preparation of Polyhalogen Compound)

<Preparation of Organic Polyhalogen Compound-2 Dispersion>

To 10 Kg of Organic Polyhalogen Compound-2 (tribromomethanesulfonylbenzene), 10 Kg of a 20% by mass aqueous solution of modified polyvinyl alcohol ("Poval MP203", trade name; product of Kuraray Co., Ltd.), 0.4 Kg of a 20% by mass aqueous solution of sodium triisopropylnaphthalenesulfonate, 14 Kg of water was added. The resulting mixture was thoroughly mixed into a slurry.

The resulting slurry was sent by a diaphragm pump and dispersed in a horizontal sand mill ("UVM-2", trade name; product of AIMEX K.K.) filled with zirconia beads having an average diameter of 0.5 mm for 5 hours. Thereafter, 0.2 g of benzisothiazolinone sodium salt and water were added to adjust the concentration of the organic polyhalogen compound to 26% by mass, thereby obtaining Organic Polyhalogen Compound-2 Dispersion.

The organic polyhalogen compound grains contained in the thus-obtained polyhalogen compound dispersion had a median diameter of 0.41 μm and a maximum particle size of 2.0 μm or less. The organic polyhalogen compound Dispersion was filtered through a polypropylene-made filter having a pore size of 10.0 μm to remove foreign matters such as dust and then housed.

<Preparation of Organic Polyhalogen Compound-3 Dispersion>

To 10 Kg of Organic Polyhalogen Compound-3 (N-butyl-3-tribromomethanesulfonylbenzamide), 20 Kg of a 10% by mass aqueous solution of modified polyvinyl alcohol ("Poval MP203", trade name; product of Kuraray Co., Ltd.), and 0.4 Kg of a 20% by mass aqueous solution of sodium triisopropylnaphthalenesulfonate, 8 kg of water was added. The resulting mixture was thoroughly mixed into a slurry.

The resulting slurry was sent by a diaphragm pump and dispersed in a horizontal sand mill ("UVM-2", trade name; product of AIMEX K.K.) filled with zirconia beads having an average diameter of 0.5 mm for 5 hours. Thereafter, 0.2 g of benzisothiazolinone sodium salt and water were added to adjust the concentration of the organic polyhalogen compound to 25% by mass. The resulting dispersion solution was heated at 40° C. for 5 hours to obtain Organic Polyhalogen Compound-3 Dispersion.

The organic polyhalogen compound gains contained in the thus-obtained organic polyhalogen compound dispersion had a median diameter of 0.36 μm and a maximum particle size of 1.5 μm or less. The organic polyhalogen compound dispersion was filtered through a polypropylene-made filter having a pore size of 3.0 μm to remove foreign matters such as dust and then housed.

<Preparation of Phthalazine Compound-1 Solution>

In 174.57 Kg of water was dissolved 8 Kg of modified polyvinyl alcohol "MP203" (trade name) produced by Kuraray Co., Ltd. To the resulting solution were then added 3.15 Kg of a 20% by mass aqueous solution of sodium triisopropylnaphthalenesulfonate and 14.28 Kg of a 70% by mass aqueous solution of Phthalazine Compound-1 (6-isopropylphthalazine) to prepare a 5% by mass solution of Phthalazine Compound-1.

<Preparation of Aqueous Mercapto Compound-1 Solution>

In 993 g of water was dissolved 7 g of Mercapto Compound-1 (1-(3-sulfophenyl)-5-mercaptotetrazole sodium salt) to prepare a 0.7% by mass aqueous solution.

<Preparation of Pigment-1 Dispersion>

To 64 g of C.I. Pigment Blue 60 and 6.4 g of "Demol N" (trade name) produced by Kao Corporation was added 250 g of water. They were thoroughly mixed to form a slurry. The resulting slurry was charged in a vessel together with 800 g of zirconia beads having an average diameter of 0.5 mm, followed by dispersion for 25 hours in a dispersing machine ("1/4 G Sand Grinder Mill", product of AIMEX K.K.) to obtain Pigment-1 Dispersion.

The pigment particles contained in the thus-obtained Pigment-1 Dispersion had an average particle size of 0.21 μm.

<Preparation of SBR Latex Solution>

An SBR latex having a Tg of 23° C. was prepared as follows.

In a similar manner to that employed for high Tg latex P-3, 70.5 mass of styrene, 26.5 mass of butadiene and 3 mass of acrylic acid were emulsion-polymerized using ammonium persulfate as a polymerization initiator and an anionic surfactant as an emulsifier, followed by aging at 80° C. for 8 hours.

The resulting solution was cooled to 40° C., adjusted to pH 7.0 with aqueous ammonia and added with "SANDET BL" (trade name) produced by Sanyo Kasei K.K. to give its concentration of 0.22%. A 5% aqueous solution of sodium hydroxide was added to adjust the pH of the resulting mixture to 8.3 and further, the pH was adjusted to 8.4 with aqueous ammonia. At this time, $Na^+$ ion and $NH_4$+ ion were used at a molar ratio of 1:2.3.

To 1 Kg of the resulting solution was added 0.15 ml of a 7% aqueous solution of benzoisothiazolinone sodium salt to prepare an SBR latex solution.

(SBR Latex: Latex of -St(70.5)-Bu(26.5)-AA(3)-): Tg: 23° C.

Average particle size: 0.1 μm, concentration: 43% by mass, equilibrium moisture content at 25° C. and 60% RH: 0.6% by mass, ion conductivity: 4.2 mS/cm (ion conductivity was determined by using a conductivity meter "CM-30S" manufactured by Toa Denpa Kogyo K.K. for measuring the latex stock solution (43% by mass) at 25° C.), pH: 8.4.

SBR latices having different Tg were prepared in the same manner by changing a styrene:butadiene ratio as needed.

<Preparation of Coating Solution-1 for Emulsion Layer (Photosensitive Layer)>

The fatty acid silver salt dispersion (1000 g) obtained above, 104 ml of water, 30 g of Pigment-1 Dispersion, 6.3 g of Organic Polyhalogen Compound-2 Dispersion, 20.7 g g of Organic Polyhalogen Compound-3 Dispersion, 173 g of Phthalazine Compound-1 Solution, 1,082 g of SBR latex (Tg: 23° C.) solution, 258 g of Reducing Agent Complex-3 Dispersion and 9 g of Aqueous Mercapto Compound-1 Solution were successively added. Immediately before the coating, Silver Halide Mixed Emulsion A was added so that its amount relative to the organic acid silver salt would be as shown in Table 1. After thorough mixing, the resulting emulsion layer coating solution was sent as it was to a coating die and coated.

<Preparation of Coating Solution for Interlayer on Emulsion Surface>

To 772 g of a 10% by mass aqueous solution of polyvinyl alcohol "PVA-205" (trade name; product of Kuraray Co., Ltd.), 5.3 g of a 20% by mass dispersion of pigment and 226 g of a 27.5% by mass solution of methyl methacrylate/styrene/butyl acrylate/hydroxyethyl methacrylate/acrylic acid copolymer (copolymerization weight ratio: 64/9/20/5/2) latex, 2 ml of a 5% by mass aqueous solution of "Aerosol OT" (trade name; product of American Cyanamide), 10.5 ml of a 20% by mass aqueous solution of diammonium phthalate and water for making a total amount of 880 g were added. The resulting mixture was adjusted to pH 7.5 with NaOH, whereby a coating solution for interlayer was prepared. The resulting solution was transferred to a coating die to give a coverage of 10 ml/$m^2$.

The viscosity of the coating solution as measured by a Brookfield viscometer at 40° C. (No. 1 rotor, 60 rpm) was 651 [mPa·s].

<Preparation of Coating Solution for First Protective Layer on Emulsion Surface>

In water was dissolved 64 g of inert gelatin. To the resulting solution were added 80 g of a 27.5% by mass solution of methyl methacrylate/styrene/butyl acrylate/hydroxyethyl methacrylate/acrylic acid copolymer (copolymerization weight ratio: 64/9/20/5/2) latex, 23 ml of a 10% by mass methanol solution of phthalic acid, 23 ml of a 10% by mass aqueous solution of 4-methylphthalic acid, 28 ml of 0.5 mol/L of sulfuric acid, 5 ml of a 5% by mass aqueous solution of "Aerosol OT" (trade name; product of American Cyanamide), 0.5 g of phenoxyethanol, 0.1 g of benzisothiazolinone and water for making a total amount of 750 g, whereby a coating solution was prepared. Immediately before the coating, 26 ml of a 4% by mass chrome alum was mixed in a static mixer and the resulting mixture was transferred to a coating die to give a coverage of 18.6 ml/m$^2$.

The viscosity of the coating solution as measured by a Brookfield viscometer at 40° C. (No. 1 rotor, 60 rpm) was 20 [mPa·s].

<Preparation of Coating Solution for Second Protective Layer on Emulsion Surface>

In water was dissolved 80 g of inert gelatin. To the resulting solution were added 102 g of a 27.5% by mass solution of methyl methacrylate/styrene/butyl acrylate/hydroxyethyl methacrylate/acrylic acid copolymer (copolymerization weight ratio: 64/9/20/5/2) latex, 3.2 ml of a 5% by mass solution of a fluorine surfactant (F-1: N-perfluorooctylsulfonyl-N-propylalanine potassium salt), 32 ml of a 2% by mass aqueous solution of fluorine surfactant (F-2: polyethylene glycol mono(N-perfluorooctylsulfonyl-N-propyl-2-aminoethyl) ether [ethylene oxide average polymerization degree: 15]), 23 ml of a 5% by mass aqueous solution of "Aerosol OT" (trade name; product of American Cyanamide), 4 g of polymethyl methacrylate fine particles (average particle size: 0.7 μm), 21 g of polymethyl methacrylate fine particles (average particle size: 4.5 am), 1.6 g of 4-methylphthalic acid, 4.8 g of phthalic acid, 44 ml of 0.5 mol/L sulfuric acid, 10 ml of benzoisothiazolinone and water for making a total amount of 650 g. Just before coating, the resulting mixture was mixed with 445 ml of an aqueous solution containing 4% by mass chrome alum and 0.67% by mass phthalic acid in a static mixer. The resulting mixture was transferred, as a coating solution for surface protective layer, to a coating die to give a coverage of 8.3 ml/m$^2$.

The viscosity of the coating solution as measured by a Brookfield viscometer at 40° C. (No. 1 rotor, 60 rpm) was 19 [mPa·s].

<Preparation of Heat-Developable Photosensitive Material-1>

Onto the back surface of the undercoated support prepared above, the coating solution for antihalation layer and the coating solution for back surface protective layer were simultaneously applied one after another such that the antihalation layer had the coated amount of the solid fine-particle dye of 0.04 g/m$^2$ in terms of solid content and the back surface protective layer had a gelatin coated amount of 1.7 g/m$^2$, followed by drying, whereby a back layer was formed.

Onto the surface opposite to the back surface, an emulsion layer, an interlayer, a first protective layer and a second protective layer were simultaneously coated one on another in the order of mention from the undercoated surface by the slide bead coating method to prepare a sample of a heat-developable photosensitive material. At this time, the temperature of each of the emulsion layer and the interlayer was adjusted to 35° C., the first protective layer to 36° C. and the second protective layer to 37° C.

The coated amount (g/m$^2$) of each compound in the emulsion layer is shown below.

| | |
|---|---|
| Silver behenate | 6.19 |
| Pigment (C.I. Pigment Blue 60) | 0.036 |
| Polyhalogen Compound-2 | 0.04 |
| Polyhalogen Compound-3 | 0.12 |
| Phthalazine Compound-1 | 0.21 |
| SBR latex | 11.1 |
| Reducing Agent Complex-3 | 1.54 |
| Mercapto Compound-1 | 0.002 |
| Silver halide (in terms of Ag) | Amount described in TABLE 4 |

The coating and drying conditions were as follows.

The coating was performed at a speed of 160 m/min, the distance between the tip of coating die and the support was set at 0.10 to 0.30 mm and the pressure in the vacuum chamber was set lower by 196 to 882 Pa than the atmospheric pressure. The support was destaticized by ionized flow before the coating.

In the subsequent chilling zone, the coating solution was cooled by air flow showing a dry bulb temperature of 10 to 20° C. and thereafter, the sample was subjected to contact-free transportation and in a helical floating type dryer, was dried with drying air showing a dry bulb temperature of 23 to 45° C. and a wet bulb temperature of 15 to 21° C.

After drying, the humidity was adjusted to 40 to 60% RH at 25° C. and then, the layer surface was heated to 70 to 90° C. The heated layer surface was then cooled to 25° C.

The resulting heat-developable photosensitive material had a matting degree of, in terms of the Beck's smoothness, 550 seconds on the surface of the photosensitive layer side and 130 seconds on the back surface. Furthermore, the pH on the layer surface on the photosensitive layer side was measured and found to be 6.0.

Chemical structures of the compounds used in Examples of the present invention are set forth below.

Spectral Sensitizing Dye A

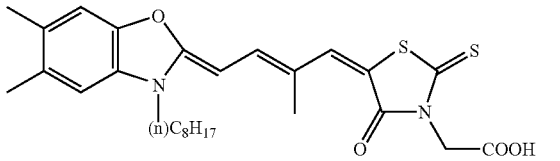

Spectral Sensitizing Dye B

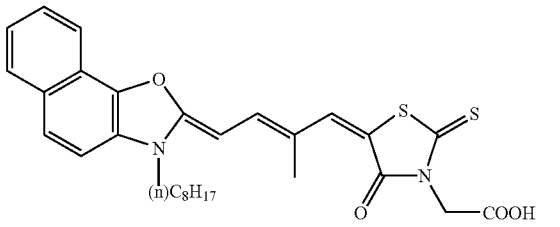

Tellurium Sensitizer B

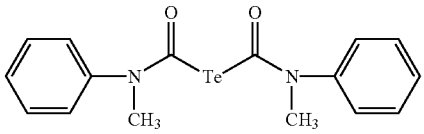

-continued
Base Precursor Compound 11
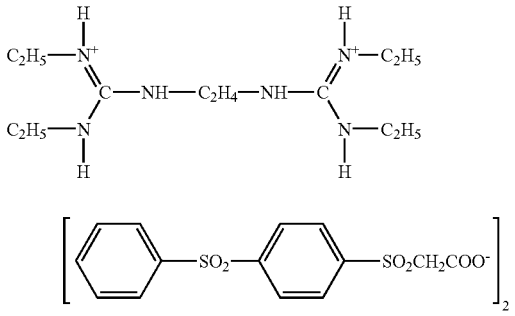
Cyanine Dye Compound 13
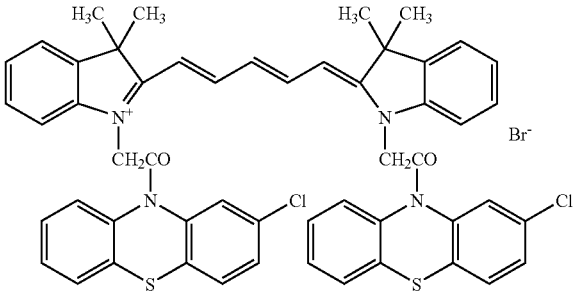
Blue Dye Compound 14
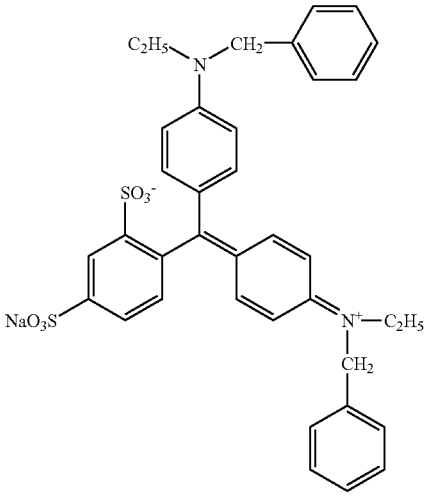
Yellow Dye Compound 15
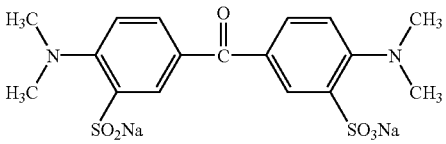
(Reducing agent-2)
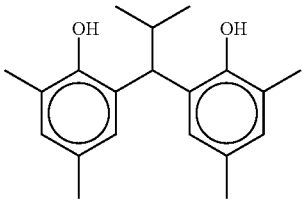
-continued
(Reducing agent Complex-3)
1:1 Complex of:
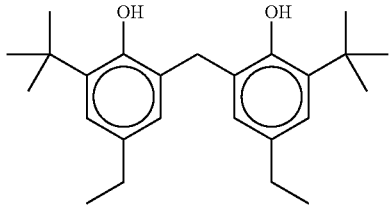
; and
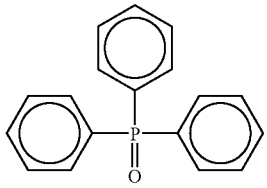
(Reducing agent-5)
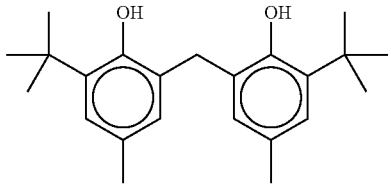
(Hydrogen bond forming compound-2)
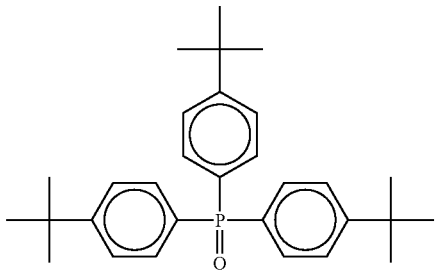
(Polyhalogen Compound-2)
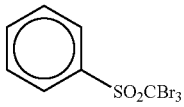
(Polyhalogen Compound-3)
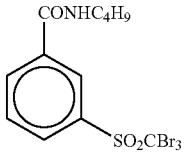
(Mercapto Compound-1)
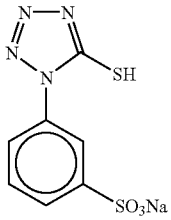

-continued (Phthalazine Compound-1)

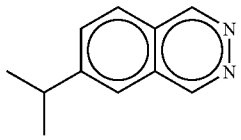

(Development Accelerator-1)

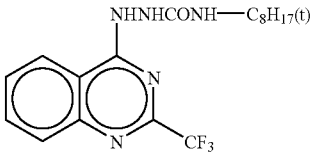

(F-1)

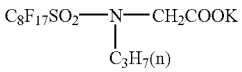

(F-2)

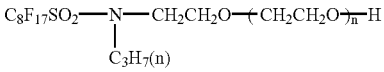

n = 15 (mean)

(F-3)

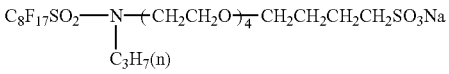

(F-4)

$C_8F_{17}SO_3K$ (F-5)

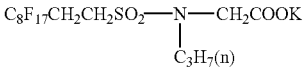

(F-6)

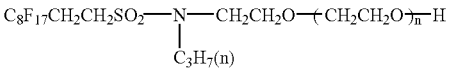

n = 15 (mean)

(F-7)

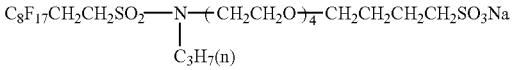

(F-8)

$C_8F_{17}CH_2CH_2SO_3K$

The sample thus obtained was cut into 356×432 mm and was wrapped with the below-described packaging material at 25° C. and 50% RH. After storage at room temperature for two weeks, it was evaluated for the below-described properties.

(Packaging Material)

50 μm of polyethylene containing 10 μm of PET/12 μm of PE/9 μm of aluminum foil/15 μm of Ny/3% of carbon Oxygen permeability: 0 ml/atm·$m^2$·25° C.·day, water permeability: 0 g/atm·$m^2$·25° C.·day Example 13

In a similar manner to Example 12 except that the temperature upon forming the grain of Silver Halide Emulsion 1 was changed, Silver Halide Emulsions 2 to 6 varied in grain size as shown in Table 4 were prepared. In a similar manner to Example 12 except for the change of halogen composition, Emulsions 7 and 8 varied in halogen composition as shown in Table 4 were prepared.

As in Example 12 except that the coated amount of silver halide of each of Silver halide Emulsions 1 to 8 was changed, Heat-developable Photosensitive Materials 2 to 14 as shown in Table 4 were prepared.

(Evaluation of Photographic Performance)

Each sample was exposed and developed using a remodeled Fuji Medical Dry Laser Imager FM-DPL.

The photosensitive material was exposed to a 660 nm semiconductor laser mounted on FM-DPL and having a maximum output of 60 mW (IIIB), while focusing to 100 μm*100 μm. Upon exposure, the exposure amount to laser was changed stepwise.

Development was carried out using the heat development section of FM-DPL while setting the temperature of 4 sheets of a panel heater at 112° C.-119° C.-121° C.-121° C. for 24 seconds. Upon evaluation of the progress of the development, heat development time was changed by altering the carrying speed.

The image obtained after exposure and development was evaluated based on a characteristic curve of density, which had been measured by a Macbeth densiometer, relative to exposure amount.

The density of the developed sample at a portion which has not been exposed to a semiconductor laser is designated as Dmin, while the density of the exposed portion at the maximum exposure amount is designated as Dmax. The reciprocal of an exposure amount giving a density of Dmin+1.0 is designated as sensitivity and expressed as a value relative to a reference photosensitive material.

Development time was adjusted to 16 seconds by changing the carrying speed of a heat development machine and a characteristic curve was drawn. As in the case of development for 24 seconds, the reciprocal of an exposure amount necessary for attaining the density of Dmin+1.0 is designated as sensitivity. The value calculated from sensitivity upon development for 24 seconds and that upon development for 16 seconds in accordance with the below-described equation is evaluated as the progress of development.

Progress of Development=Log (24-second sensitivity/16-second sensitivity)

The greater the value, the progress of development was slower, meaning that sensitivity is not stable against a change in development time. The smaller the value, the better.

(Evaluation of Printout Property) Condition 1

The sample after development was placed in an environment at 30° C. and 70% RH and was allowed to stand for 3 days under a fluorescent light having an illuminance of 1000 lux. An increase in the density of the fog portion relative to the density before treatment was evaluated as printout property.

(Evaluation of Printout Property) Condition 2

The sample after development was allowed to stand under an environment at 25° C. and 70% RH for 10 days under a fluorescent light having an illuminance of 300 lux. An increase in the density of the fog portion was evaluated as printout property.

The evaluation results of Samples 1 to 14 are shown in Table 4.

TABLE 4

| Sample No. | Silver halide emulsion: Emulsion No. | Silver halide emulsion: Halogen composition | Silver halide emulsion: Grain size | Coated amount of silver halide (relative to mol % of organic acid silver salt) | Dmin | Dmax | Progress of Development | Printout property under condition 1 | Remarks |
|---|---|---|---|---|---|---|---|---|---|
| 1 | Emulsion 1 | $AgI_{100}$ | 40 nm | 29% | 0.18 | 4.0 | 0.45 | 0.02 | Invention product |
| 2 | " | " | " | 14% | " | 4.2 | 0.35 | 0.02 | Invention product |
| 3 | " | " | " | 7% | " | 4.2 | 0.20 | 0.01 | Invention product |
| 4 | " | " | " | 4.9% | " | 3.9 | 0.15 | 0.00 | Invention product |
| 5 | " | " | " | 3.5% | 0.19 | 3.8 | 0.10 | " | Invention product |
| 6 | Emulsion 2 | $AgI_{100}$ | 55 nm | 9% | 0.18 | 3.9 | 0.22 | 0.01 | Invention product |
| 7 | Emulsion 3 | " | 65 nm | 9% | 0.18 | 3.7 | 0.22 | 0.01 | Invention product |
| 8 | Emulsion 4 | " | 32 nm | 4.9% | 0.18 | 4.2 | 0.13 | 0.00 | Invention product |
| 9 | Emulsion 5 | " | 23 nm | 3.5% | 0.18 | 4.2 | 0.07 | 0.00 | Invention product |
| 10 | Emulsion 6 | " | 100nm | 20% | 0.17 | 2.3 | 0.80 | 0.04 | Comparative Example |
| 11 | " | " | " | 10% | 0.18 | 2.5 | 0.55 | 0.02 | Comparative Example |
| 12 | " | " | " | 7% | 0.19 | 1.8 | 0.50 | 0.02 | Comparative Example |
| 13 | Emulsion 7 | $AgBr_{70}I_{30}$ | 42 nm | 7% | 0.24 | 4.2 | 0.08 | 0.10 | Comparative Example |
| 14 | Emulsion 8 | $AgBr_{97}I_{3}$ | 40 nm | 7% | 0.32 | 4.2 | 0.05 | 0.13 | Comparative Example |

As is apparent from the above-described results, it has been understood that the samples of the present invention are preferred because they are excellent in printout property and also excellent from the viewpoints of progress of development and Dmax performance. These performances can be attained by adjusting the grain size of the silver-iodide-rich emulsion of the present invention to 90 nm or less. It has also been understood that the less the number of moles of the silver-iodide-rich emulsion relative to the organic acid silver salt, the better.

Example 14

This Example indicates that the effects of the present invention can be attained not only by mixing prior to application of a silver halide as in Example 12 or 13 but also by conversion of an organic acid silver salt.

<Use of Conversion Method for Preparing Photosensitive Material Containing Silver-iodide-rich Emulsion>

In a similar manner to Example 12 except that conversion of a fatty acid silver salt was conducted by adding, instead of Silver Halide Emulsion A, a KI solution in <Preparation of Emulsion Layer (Photosensitive Layer) Coating Solution-1> and except that Sensitizing Dyes A,B and 5-methyl-2-mercaptobenzoimidazole were added in an amount equal to that of Emulsion 1, a heat-developable photosensitive material was formed.

By altering the amount of KI, Samples 15,16,17 were prepared.

Samples 15 to 17 thus prepared and Samples 2,4,8 of Example 13 were evaluated as in Example 13. The results are shown in Table 5.

TABLE 5

| Sample No. | Silver halide emulsion: Emulsion No. | Silver halide emulsion: Halogen composition | Silver halide emulsion: Grain size | Adding method of silver halide | Coated amount of silver halide (relative to mol % of organic acid) | Dmin | Dmax | Sensitivity | Progress of Development | Printout condition 1 | Remarks |
|---|---|---|---|---|---|---|---|---|---|---|---|
| 2 | Emulsion 1 | $AgI_{100}$ | 40 nm | Mixing | 14% | 0.18 | 4.2 | 60 | 0.35 | 0.02 | Invention product |
| 4 | Emulsion 1 | " | " | " | 4.9% | 0.18 | 3.9 | 100 | 0.15 | 0.00 | Invention product |
| 8 | Emulsion 4 | " | 32 nm | " | 4.9% | 0.18 | 4.2 | 65 | 0.13 | 0.00 | Invention product |

TABLE 5-continued

| Sample No. | Silver halide emulsion: Emulsion No. | Silver halide emulsion: Halogen composition | Silver halide emulsion: Grain size | Adding method of silver halide | Coated amount of silver halide (relative to mol % of organic acid) | Dmin | Dmax | Sensitivity | Progress of Development | Printout condition 1 | Remarks |
|---|---|---|---|---|---|---|---|---|---|---|---|
| 15 | Conversion | $AgI_{100}$ | 35 nm | Conversion | 20% | 0.18 | 4.0 | 5 | 0.46 | 0.02 | Invention product |
| 16 | " | " | " | " | 7% | " | 4.2 | 15 | 0.24 | 0.01 | Invention product |
| 17 | " | " | " | " | 4.9% | " | 4.2 | 25 | 0.20 | 0.01 | Invention product |

As the above table shows, effects of the present invention for development promotion are also available even if the samples are prepared by conversion method. The photosensitive material obtained by the conversion method however has low sensitivity. It is thus preferred that the silver-iodide-rich emulsion of the present invention is prepared in the absence of an organic acid silver salt.

Example 15

This Examples indicates that the silver-iodide-rich emulsion of the present invention is particularly preferred when exposed to a light of high illuminance such as laser light.

Measurement of the illuminance upon exposure to FM-DPL in Example 13 revealed that it was 4 W/mm$^2$ at the maximum output portion, while measurement of the illuminance upon exposure to light via step wedge using a Xenon light source revealed that it was 3 mW/mm$^2$. The exposure time was adjusted so as to give a desired density.

Samples 4 and 12 obtained in Example 13 were exposed under two conditions and their sensitivity was determined. The sensitivity was expressed by the reciprocal of a light amount (=illuminance×time) necessary for giving Dmin of +1.0 as a density, supposing that the sensitivity of these samples when exposed to a laser light is 100. The results are shown in Table 6.

TABLE 6

| Test No. | Sample No. | Silver halide emulsion: Emulsion No. | Silver halide emulsion: Halogen Composition | Silver halide emulsion: Grain size | Exposure: illuminance (W/mm$^2$) | Relative sensitivity | Remarks |
|---|---|---|---|---|---|---|---|
| 1 | 4 | Emulsion 1 | $AgI_{100}$ | 40 nm | Exposure to laser light (4 W/mm$^2$) | 100 | Invention product |
| 4 | 4 | " | " | " | Exposure to light (3 mW/mm$^2$) | 75 | Invention product |
| 5 | 12 | Emulsion 6 | $AgI_{100}$ | 100 nm | Exposure to laser light (4 W/mm$^2$) | 100 | Comparative Example |
| 8 | 12 | " | " | " | Exposure to light (3 mW/mm$^2$) | 135 | Comparative Example |

As is apparent from the above example, photosensitive materials using the silver-iodide-rich emulsion of the present invention are excellent in sensitivity particularly when exposed to a light of high illuminance such as laser light.

Example 16

A polyhalogen compound is indispensable in the present invention. The effect of it will next be indicated. In a similar manner to Example 12 except that Silver halide emulsion 1 or Silver halide emulsion 8 was used as an emulsion and the amount of Organic Polyhalogen Compound 2 or 3 was changed as shown in Table 7 without changing its ratio, Samples 20 to 25 were prepared.

As in Example 13, Dmix, Dmax, printout property under condition 1 and printout property under condition 2 of the samples thus obtained were studied. The results are shown in Table 7.

TABLE 7

| Sample No. | Silver halide emulsion: Emulsion No. | Silver halide emulsion: Halogen Composition | Silver halide emulsion: Grain size | Amount of Polyhalogen Compound (relative to mol % of organic acid) | Dmin | Dmax | Printout property under condition 1 | Printout property under condition 2 | Remarks |
|---|---|---|---|---|---|---|---|---|---|
| 20 | Emulsion 1 | $AgI_{100}$ | 40 nm | — | 0.22 | 4.2 | 0.30 | 0.25 | Comparative Example |
| 3 | " | " | " | 2.6% | 0.18 | 4.2 | 0.02 | 0.01 | Invention product |
| 21 | " | " | " | 8.5% | " | 3.6 | 0.01 | 0.01 | Invention product |
| 22 | " | " | " | 15% | " | 3.4 | 0.00 | 0.00 | Invention product |
| 23 | Emulsion 8 | $AgBr_{97}I_3$ | 40 nm | — | 0.96 | 4.2 | 0.35 | 0.27 | Comparative Example |
| 14 | " | " | " | 2.6% | 0.32 | 4.1 | 0.13 | 0.20 | Comparative Example |
| 24 | " | " | " | 8.5% | 0.19 | 3.9 | 0.04 | 0.17 | Comparative Example |
| 25 | " | " | " | 15% | 0.18 | 3.7 | 0.02 | 0.15 | Comparative Example |

As is apparent from Table 7, it has been found that the characteristics of the silver-iodide-rich emulsions of the present invention appear eminently in the presence of a polyhalogen compound. Table 4 has also revealed that it is difficult to create environmental conditions permitting the photosensitive materials of Comparative Examples having a smaller silver iodide content to have good printout property even if the amount of the polyhalogen compound is increased for improvement.

The silver-iodide-rich emulsions of the present invention produce good results in printout property even under different conditions (temperature, humidity, and illumination).

Example 17

In a similar manner to Example 13 except that the laser light was oscillated in a longitudinal multimode by the high frequency superposing method or the like, test was conducted. The results as favorable as those of Example 13 were obtained.

Example 18

In a similar manner to that employed for Sample 4 of Example 13 except that Emulsion 1 was replaced with a 8:2 mixture of Emulsion 4 and Emulsion 3, a heat-developable photosensitive material 26 was prepared. It was evaluated as in Example 13, whereby favorable results were obtained.

Example 19

In a similar manner to that employed for Sample 3 of Example 13 except for the use of the below-described compound instead of the reducing agent complex, a heat-developable photosensitive material was prepared.

<Preparation of Reducing Agent-5 Dispersion>

To 10 kg of Reducing Agent-5 (2,2'-methylenebis-(4-methyl-6-tert-butylphenol)) and 20 Kg of a 10% by mass aqueous solution of modified polyvinyl alcohol ("Poval MP203", trade name; product of Kuraray Co., Ltd.), 6 Kg of water was added and they were mixed thoroughly to form a slurry.

The resulting slurry was sent by a diaphragm pump and dispersed in a horizontal sand mill ("UVM-2", trade name; product of AIMEX K.K.) filled with zirconia beads having an average diameter of 0.5 mm for 3 hours and 30 minutes. The dispersion was then added with 0.2 g of benzisothiazolinone sodium salt and water to adjust the concentration of the reducing agent to 25% by mass, whereby Reducing Agent-5 Dispersion was prepared.

The reducing agent particles contained in the thus-obtained reducing agent dispersion had a median diameter of 0.38 μm and a maximum particle size of 1.5 μm or less. The resulting reducing agent dispersion was filtered through a polypropylene-made filter having a pore size of 3.0 μm to remove foreign matters such as dust and then housed.

<Preparation of Hydrogen Bond Forming Compound-2 Dispersion>

To 10 Kg of Hydrogen bond forming compound-2 (tri(4-t-butylphenyl)phosphine oxide) and 20 Kg of a 10% by mass aqueous solution of modified polyvinyl alcohol ("Poval MP203", trade name; product of Kuraray Co., Ltd.), 10 Kg of water was added. They were mixed thoroughly to form a slurry.

The resulting slurry was sent by a diaphragm pump and dispersed in a horizontal sand mill ("UVM-2", trade name; manufactured by AIMEX K.K.) filled with zirconia beads having an average diameter of 0.5 mm for 3 hours and 30 minutes. The resulting dispersion was then added with 0.2 g of benzisothiazolinone sodium salt and water to adjust the concentration of the hydrogen bond forming compound to 22% by mass, whereby Hydrogen bond forming compound-2 Dispersion was prepared.

The hydrogen bond forming compound particles contained in the thus-obtained hydrogen bond forming compound dispersion had a median diameter of 0.35 μm and a maximum particle size of 1.5 μm or less. The hydrogen bond forming compound dispersion was filtered through a polypropylene-made filter having a pore size of 3.0 μm to remove foreign matters such as dust and then housed.

<Preparation of Heat-developable Photosensitive Material 27>

In a similar manner to that employed for Sample 3 of Example 13 except for the use of Reducing agent 5 and Hydrogen bond forming compound 2 instead of Reducing Agent 3, Heat-developable Photosensitive Material 27 was prepared. The coated amount (g/m 2) of each compound for the emulsion layer is as follows:

| | |
|---|---|
| Silver behenate | 6.19 |
| Reducing Agent-5 | 0.76 |
| Hydrogen bond forming compound 2 | 0.59 |
| Pigment (C.I. Pigment Blue 60) | 0.032 |
| Polyhalogen Compound-2 | 0.04 |
| Polyhalogen Compound-3 | 0.12 |
| Phthalazine Compound-1 | 0.21 |
| SBR latex | 11.1 |
| Mercapto compound-1 | 0.002 |
| Silver halide (in terms of Ag) | 0.145 |

Evaluation was conducted as in Example 13. As a result, it has been found that the compound thus obtained was favorable.

Example 20

In a similar manner to Example 19 except for the use of Compound of Reducing agent 2 instead of Reducing agent 5, a heat developable photosensitive material 28 was prepared. Heat development was conducted for 14 seconds while changing the transfer rate of a heat developing machine. As a result, the material exhibited good sensitivity and graduation Example 21

The photographic performance of each of the photosensitive materials 1 to 5, 9, 13 and 14 of the present invention was evaluated. In a similar manner to Example 13 except that each of the four sheets of the panel heater was set at 18° C., evaluation was conducted. The results are shown in Table 8.

TABLE 8

| Sample No. | Silver halide emulsion: Emulsion No. | Silver halide emulsion: Halogen composition | Silver halide emulsion: Grain size | Coated amount of silver halide (relative to mol % of organic acid silver salt) | Dmin | Progress of development |
|---|---|---|---|---|---|---|
| 1 | Emulsion 1 | $AgI_{100}$ | 40 nm | 20% | 0.17 | 0.45 |
| 2 | " | " | " | 14% | " | 0.45 |
| 3 | " | " | " | 7% | " | 0.43 |
| 4 | " | " | " | 4.9% | " | 0.42 |
| 5 | " | " | " | 3.5% | " | 0.42 |
| 13 | Emulsion 7 | $AgBr_{70}I_{30}$ | 42 nm | 7% | 0.18 | 0.50 |
| 14 | Emulsion 8 | $AgBr_{97}I_{3}$ | 40 nm | 7% | 0.20 | 0.55 |

As is apparent from Table 8, it has been found that the photosensitive materials using the silver-iodide-rich emulsion according to the present invention is superior in progress of development to photosensitive materials using a silver-bromide-rich emulsion when developed at temperature as low as 108° C. Comparison between Table 4 (development temperature: 112 to 121° C.) and Table 8 (development temperature: 108° C.) suggests that the photosensitive material using a silver-iodide-rich emulsion exhibits marked development suppression at development temperature of 110° C. or greater compared with a photosensitive material using a silver-bromide-rich emulsion. Even under such development conditions, the samples of the present invention produce good results in progress of development.

The present invention provides a heat-developable photosensitive material that has high sensitivity and can provide a high image quality in spite of being a silver halide photosensitive material rich in silver iodide; and an image forming method using the material, and further provides a heat-developable photosensitive material that has a high sensitivity, is excellent in development stability and at the same time, is excellent in photoimage shelf life after development.

The entire disclosure of each and every foreign patent application from which the benefit of foreign priority has been claimed in the present application is incorporated herein by reference, as if fully set forth.

What is claimed is:

1. A method for forming an image, which comprises: exposing a heat-developable photosensitive material to a light having a peak intensity at a wavelength of 350 nm to 450 nm under an illuminance of 1 $mW/mm^2$ or greater for a period not greater than $10^{-4}$ second, in which the heat-developable photosensitive material comprises a transparent support, a photosensitive silver halide, non-photosensitive organic silver salt, a heat developer and a binder, the photosensitive silver halide having a silver iodide content of 90 mol % to 100 mol %; and then heat developing the exposed material.

2. The method for forming an image according to claim 1, wherein the photosensitive silver halide has a grain size of 5 nm to 80 nm.

3. The method for forming an image according to claim 1, wherein the photosensitive silver halide is a photosensitive silver halide that has been formed in the absence of the organic silver salt.

4. The method for forming an image according to claim 1, wherein the pAg on the layer surface of the heat-developable photosensitive material is 1 to 5.5.

5. The method for forming an image according to claim 1, wherein an exposure light source is a semiconductor laser having a light-emitting peak intensity at 390 nm to 430 nm.

6. The method for forming an image according to claim 5, wherein the laser has a light-emitting peak intensity at 405 nm.

* * * * *